US012214395B2

(12) United States Patent
Nozu et al.

(10) Patent No.: US 12,214,395 B2
(45) Date of Patent: Feb. 4, 2025

(54) EXTRUSION MOLDING METHOD FOR DIFFERENTIAL THICKNESS PIPE AND EXTRUSION MOLDING APPARATUS FOR DIFFERENTIAL THICKNESS PIPE

(71) Applicant: SANGO CO., LTD., Nagoya (JP)

(72) Inventors: Kentaro Nozu, Nagoya (JP); Michiharu Nakagaki, Nagoya (JP)

(73) Assignee: SANGO CO., LTD., Nagoya (JP)

( * ) Notice: Subject to any disclaimer, the term of this patent is extended or adjusted under 35 U.S.C. 154(b) by 392 days.

(21) Appl. No.: 17/640,573

(22) PCT Filed: Jun. 10, 2020

(86) PCT No.: PCT/JP2020/022822
§ 371 (c)(1),
(2) Date: Mar. 4, 2022

(87) PCT Pub. No.: WO2021/044689
PCT Pub. Date: Mar. 11, 2021

(65) Prior Publication Data

US 2022/0314290 A1 Oct. 6, 2022

(30) Foreign Application Priority Data

Sep. 6, 2019 (JP) ..... 2019-162744

(51) Int. Cl.
*B21C 25/08* (2006.01)
*B21C 23/08* (2006.01)

(52) U.S. Cl.
CPC ..... *B21C 25/08* (2013.01); *B21C 23/085* (2013.01)

(58) Field of Classification Search
CPC ..... B21C 1/24; B21C 23/085; B21C 23/10; B21C 25/08; B21C 37/16; B21C 25/04; B21K 1/063; B21K 21/08
(Continued)

(56) References Cited

U.S. PATENT DOCUMENTS 4,292,831 A 10/1981 Simon
6,470,726 B1 10/2002 Murata et al.
(Continued)

FOREIGN PATENT DOCUMENTS

CN 106660092 A 5/2017
JP S56168902 A 12/1981
(Continued)

OTHER PUBLICATIONS

International Search Report (PCT/ISA/210) with translation and Written Opinion (PCT/ISA/237) mailed on Jul. 14, 2020, by the Japanese Patent Office as the International Searching Authority for International Application No. PCT/JP2020/022822. (8 pages).
(Continued)

*Primary Examiner* — Jared O Brown
(74) *Attorney, Agent, or Firm* — BUCHANAN INGERSOLL & ROONEY PC

(57) ABSTRACT

In extrusion processing in which diameter reduction is performed by pressing a raw pipe having a core bar inserted therein into a die having a small inner diameter portion on its tip end side, a differential thickness pipe having a thick-walled portion at its tip end can be molded using a core bar having a small cross-section portion formed at its tip end. It is also possible to mold a differential thickness pipe having a thick-walled part at an intermediate axial position by using a raw pipe having a thin-walled portion at its tip end. For example, such a raw pipe can be molded by extrusion processing using a core bar having no small cross section portion at its tip end, prior to the above-described formation of the thick-walled portion. When higher dimensional accuracy is required, a so-called "counter punch" may be used in the formation of the thick-walled portion.

15 Claims, 32 Drawing Sheets

(58) Field of Classification Search
USPC ..... 72/260, 264, 370.24, 370.25
See application file for complete search history.

(56) References Cited

U.S. PATENT DOCUMENTS

| | | | | |
|---|---|---|---|---|
| 2015/0285297 | A1* | 10/2015 | Khanfar | B21C 23/085 29/428 |
| 2019/0076902 | A1 | 3/2019 | Mizumura et al. | |
| 2020/0324328 | A1* | 10/2020 | Lin | B21C 23/085 |

FOREIGN PATENT DOCUMENTS

| | | | |
|---|---|---|---|
| JP | S5756117 | A | 4/1982 |
| JP | 59073115 | A | 4/1984 |
| JP | S61135419 | A | 6/1986 |
| JP | 2001191110 | A | 7/2001 |
| JP | 2016068088 | A | 5/2016 |
| JP | 2017519642 | A | 7/2017 |
| WO | 2015157092 | A1 | 10/2015 |
| WO | 2017154481 | A1 | 9/2017 |

OTHER PUBLICATIONS

Notice of Reasons for Refusal with translation issued in corresponding Japanese Patent Application No. 2020-144151 by the Japanese Patent Office dated Jun. 29, 2021. (6 pages).

* cited by examiner

EXTRUSION MOLDING METHOD FOR DIFFERENTIAL THICKNESS PIPE AND EXTRUSION MOLDING APPARATUS FOR DIFFERENTIAL THICKNESS PIPE

TECHNICAL FIELD

The present invention relates to an extrusion molding method for a differential thickness pipe and an extrusion molding apparatus for a differential thickness pipe.

BACKGROUND ART

In the art, a different thickness pipe (which is also referred to as a "butted pipe" and "butted tube" etc.), in which a thick-walled portion is formed in a part in its axial direction of the pipe for the purpose of reducing the weight in a thin-walled portion (part other than the thick-walled portion) while achieving desired mechanical strength in the thick-walled portion has been known.

As a manufacturing method for a differential thickness pipe as described above, for example, a manufacturing method for a double inner butted pipe characterized by including a step of drawing one end of a raw pipe, a step of inserting a first core bar having small diameter portions at both ends and a large diameter portion in a middle part and having a tapered portion between the large diameter portion and the small diameter portions into the pipe with the one end drawn and thereafter making them pass through a die having a required diameter to bringing the inner peripheral surface of the pipe into close contact with the outer peripheral surface of the first core bar and thereby forming thick-walled portion s at both ends of the pipe, a step of extracting the first core bar held in the pipe by the previous step, a step of inserting a second core bar having the same diameter as the small diameter portion of the first core bar into the pipe with the thick-walled portion on the extracting side transferred to the outer peripheral part by the previous step and thereafter making them pass through a die having a required diameter to transfer the thick-walled portion transferred to the outer peripheral part again to the inner peripheral portion, and a step of extracting the second core bar held in the pipe by the previous step, has been known (for example, refer to the Patent Document 1 (PTL1)).

It is said that, in accordance with the above-mentioned manufacturing method, a wide variety of double inner butted pipes can be manufactured at low cost by exchanging dies and core bars, and an ideal material as a material used for a bicycle frame or the like can be obtained. However, the above-mentioned manufacturing method requires many steps to obtain the desired double inner butted pipe. In addition, since the hardness of the thick-walled portion transferred to the outer peripheral portion by the step of extracting the first core bar after being formed at both ends of the pipe by being made to pass through the die having the required diameter with the first core bar inserted is increased by work hardening (strain hardening), a very high processing load is required to transfer the thick-walled portion to the inner peripheral portion again. Therefore, it is difficult to manufacture a differential thickness pipe with high production efficiency and at a low cost by the above-mentioned manufacturing method.

On the other hand, in the art, a manufacturing method for a variable cross-sectional extruded material whose cross-sectional shape changes in a direction of its extrusion axis by advancing a punch while moving a mandrel for molding a hollow portion with respect to a die for molding an outer peripheral surface of the extruded material to extrude a raw pipe, has been known, among manufacturing methods for an extruded material having at least one hollow portion (for example, refer to the Patent Document 2 (PTL2)).

It is said that, in accordance with the above-mentioned manufacturing method, by changing a positional relation between the die and the mandrel in the extrusion processing, a variable cross-section extruded material having a cross-sectional shape or cross-sectional area required for each part in its length direction can be obtained depending on its intended use. However, in order to obtain a variable cross-sectional extruded material having a desired cross-sectional shape or cross-sectional area by the above-mentioned manufacturing method, a mechanism for controlling the positional relation between the die and the mandrel and a moving direction and moving speed of the mandrel is required. Therefore, there is a risk that the size of apparatus for carrying out the above-mentioned manufacturing method may be increased and the configuration thereof may be complicated and a manufacturing cost of the differential thickness pipe may be increased as a result.

CITATION LIST

Patent Literature

[PTL1] Japanese Patent Application Laid-Open (kokai) No. S57-56117

[PTL2] Japanese Patent Application Laid-Open (kokai) No. 2001-191110

SUMMARY OF INVENTION

Technical Problem

As mentioned above, in the art, there is a demand for a manufacturing method and a manufacturing apparatus by which a differential thickness pipe can be molded with high production efficiency and at a low cost.

Solution to Problem

In view of the above-mentioned subjects, as a result of wholehearted research, the present inventor has found that a differential thickness pipe having a thick-walled portion at its tip end can be easily molded by using a core bar having a small cross section portion formed at its tip end, in extrusion processing in which diameter reduction is performed by pressing a raw pipe having the core bar inserted therein into a die having a small inner diameter portion on its tip end side. In addition, by using a raw pipe having a thin-walled portion formed at its tip end, it is possible to form a differential thickness pipe having a thick-walled portion at an intermediate position in its axial direction. For example, such a raw pipe can be molded by extrusion processing using a core bar having no small cross section portion at its tip end, prior to the step of forming the thick-walled portion as mentioned above. Furthermore, when higher dimensional accuracy is required, a so-called "counter punch" may be used in the step of forming the thick-walled portion (which will be mentioned later for details in explanations about various embodiments of the present invention).

Specifically, an extrusion molding method for a differential thickness pipe according to the present invention (which may be referred to as a "present invention method" hereafter) includes a first step performed in a first extrusion molding apparatus. The first extrusion molding apparatus comprises a first core bar that is a core bar having a predetermined shape, a first die having a first die hole that is a through hole having a predetermined shape, and a first drive mechanism configured so as to press the first core bar into the first die hole. The first step is a step in which a differential thickness pipe having a predetermined shape is molded by pressing a pair of a first raw pipe having a predetermined shape and the first core bar into the first die hole with the first drive mechanism in a state where the first core bar is inserted at a predetermined position in the first raw pipe to perform extrusion processing.

The first raw pipe is a tubular member having a first wall thickness that is a predetermined wall thickness and a first outer diameter that is a predetermined outer diameter. The differential thickness pipe molded by the present invention method includes a first thin-walled portion and a first thick-walled portion. The first thin-walled portion is a portion having a second wall thickness that is a predetermined wall thickness smaller than the first wall thickness and a second outer diameter that is a predetermined outer diameter smaller than the first outer diameter. The first thick-walled portion is a portion having an outer diameter equal to the second outer diameter and a third wall thickness that is a predetermined wall thickness larger than the second wall thickness.

The first core bar includes a first small cross section portion, a first large cross section portion and a first cross section increasing portion. The first small cross section portion is a portion formed on a tip end side that is a downstream side in an extrusion direction and having a first cross section that is a cross section corresponding to a cross section of an internal space of the first thick-walled portion. The first large cross section portion is a portion formed on a base end side that is an upstream side in the extrusion direction and having a second cross section that is a cross section corresponding to a cross section of an internal space of the first thin-walled portion. The first cross section increasing portion is a portion formed between the first small cross section portion and the first large cross section portion and having a cross section expanding from the first cross section to the second cross section as approaching from the first small cross section portion to the first large cross section portion.

In addition, shapes of the cross sections of the internal spaces of the first thick-walled portion and the first thin-walled portion are not particularly limited, and can have a wide variety of shapes such as a polygonal shape, an elliptical shape and a circular shape, respectively. In other words, the shapes of the internal spaces of the first thick-walled portion and the first thin-walled portion are not particularly limited, and can be various shapes such as a polygonal columnar shape, an elliptical columnar shape and a cylindrical columnar shape, respectively. For example, when the internal spaces of the first thick-walled portion and the first thin-walled portion have a cylindrical columnar shape respectively, the first small cross section portion is a portion having a cylindrical columnar shape with a third outer diameter that is an outer diameter corresponding to the inner diameter of the first thick-walled portion, the first large cross section portion is a portion having a cylindrical columnar shape with a fourth outer diameter that is an outer diameter corresponding to the inner diameter of the first thin-walled portion, and the first cross section increasing portion is a portion having a shape with an outer diameter increasing from the third outer diameter to the fourth outer diameter as approaching from the first small cross section portion to the first large cross section portion.

The first die hole includes a first large inner diameter portion, a first small inner diameter portion and a first inner diameter reducing portion. The first large inner diameter portion is a portion formed on the base end side and having a first inner diameter that is an inner diameter corresponding to the first outer diameter. The first small inner diameter portion is a portion formed on the tip end side and having a second inner diameter that is an inner diameter corresponding to the second outer diameter. The first inner diameter reducing portion is a portion formed between the first large inner diameter portion and the first small inner diameter portion and having an inner diameter decreasing from the first inner diameter to the second inner diameter as approaching from the first large inner diameter portion to the first small inner diameter portion.

In addition, when the extrusion processing is started in the first step, an end portion on the base end side of the first small cross section portion is in a position closer to the base end than an end portion on the base end side of the first small inner diameter portion, in the extrusion direction.

In one aspect of the present invention method, the first step is performed using a second raw pipe that is the first raw pipe further comprising, at an end portion on the tip end side, a second thin-walled portion that is a portion having a fourth wall thickness that is a predetermined wall thickness smaller than the third wall thickness and a fifth outer diameter that is a predetermined outer diameter equal to or less than the second outer diameter. Thereby, a differential thickness pipe further comprising the second thin-walled portion closer to the tip end than the first thick-walled portion can be molded. The second raw pipe can be molded by performing a second step in a second extrusion molding apparatus comprising a third core bar that is a core bar having a predetermined shape, a second die having a second die hole that is a through hole having a predetermined shape, and a second drive mechanism configured so as to press the third core bar into the second die hole, before the first step. The second step is a step in which the second thin-walled portion is molded at an end portion on the tip end side of the first raw pipe by pressing a pair of the first raw pipe and the third core bar into the second die hole with the second drive mechanism in a state where the third core bar is inserted at a predetermined position in the first raw pipe to perform extrusion processing. When the extrusion processing is started in the second step, an end portion on the tip end side of the third core bar is in a same position as an end portion on the base end side of the second small inner diameter portion or in a position closer to the tip end than the end portion on the base end side of the second small inner diameter portion, in the extrusion direction.

In another aspect of the present invention method, in the first step, the extrusion processing is not performed on a predetermined region at an end portion on the base end side of the first raw pipe to leave the region as it is. Thereby, a differential thickness pipe further including a second thick-walled portion that is a portion having the first wall thickness and the first outer diameter at its end portion on the base end side. Moreover, as will be mentioned in detail later, a portion protruding outward in a radial direction from the first thin-walled portion (portion outside the second outer diameter) of the second thick-walled portion formed as mentioned above may be cut off using the first core bar further comprising a first pressing portion having a predetermined configuration.

In still another aspect of the present invention method, the first step is performed using a third raw pipe that is the first raw pipe further comprising a third thin-walled portion that is a portion having a fifth wall thickness that is a predetermined wall thickness smaller than the first wall thickness and an eighth outer diameter that is a predetermined outer diameter smaller than the first outer diameter and having a cross section identical to or larger than a cross section of the internal space of the first thin-walled portion at an end portion on the base end side. At this time, a differential thickness pipe further including a third thick-walled portion formed at an end portion on the base end side of the first thin-walled portion and the third thin-walled portion formed closer to the base end than the third thick-walled portion can be molded. Namely, a differential thickness pipe comprising a portion having an outer diameter larger than that of other portions and a wall thickness larger than that of the first thin-walled portion at an intermediate position in its axial direction Moreover, the present invention also relates to an extrusion molding apparatus for a differential thickness pipe (which may be referred to as a "present invention apparatus" hereafter) for molding a differential thickness pipe by performing the above-mentioned present invention method.

Advantageous Effects of Invention

In accordance with the present invention, by performing the above-mentioned first step, a differential thickness pipe having a thick-walled portion at its tip end can be easily molded. Moreover, by performing the first step using a raw pipe further comprising a thin-walled portion at an end portion on the tip end side, a differential thickness pipe having a thick-walled portion at an intermediate position in the axial direction can be easily molded. Furthermore, a differential thickness pipe having the second thick-walled portion at an end portion on the base end side and a differential thickness pipe having the third thick-walled portion at an intermediate position in the axial direction can be easily molded. Namely, in accordance with the present invention, it is possible to manufacture differential thickness pipes having various configurations with high production efficiency and at a low cost.

Other objectives, other features and accompanying advantages of the present invention will be easily understood from the following explanation of embodiments of the present invention, which will be described referring to drawings.

DESCRIPTION OF EMBODIMENTS

First Embodiment

Hereafter, an extrusion molding method for a differential thickness pipe according to a first embodiment of the present invention (which may be referred to as a "first method" hereafter) will be explained, referring to drawings.

<Configuration>

The first method includes a first step performed in a first extrusion molding apparatus. The first extrusion molding apparatus comprises a first core bar having a predetermined shape, a first die having a first die hole that is a through hole having a predetermined shape, and a first drive mechanism configured so as to press the first core bar into the first die hole. Although a detailed description of a basic configuration of the first extrusion molding apparatus is omitted since it is well known to those skilled in the art, components such as a core bar and a die are constituted by a material having properties (for example, mechanical strength and durability, etc.) that can withstand processing conditions such as a load which acts on the components in extrusion processing mentioned later, for example. The first drive mechanism for pressing the first core bar into the first die hole can be appropriately selected from various drive mechanisms well known in the art, depending on properties (for example, mechanical strength and hardness, etc.) of a material constituting a first raw pipe subjected to extrusion processing. Typically, a press machine such as a hydraulic press machine is adopted as the first drive mechanism.

The first step is a step in which a differential thickness pipe having a predetermined shape is molded by pressing a pair of a first raw pipe having a predetermined shape and the first core bar into the first die hole with the first drive mechanism in a state where the first core bar is inserted at a predetermined position in the first raw pipe to perform extrusion processing. Details of the first raw pipe, the first core bar and the first die used in the first step and the differential thickness pipe molded by performing the first step will be explained below referring to drawings.

Figure 1:
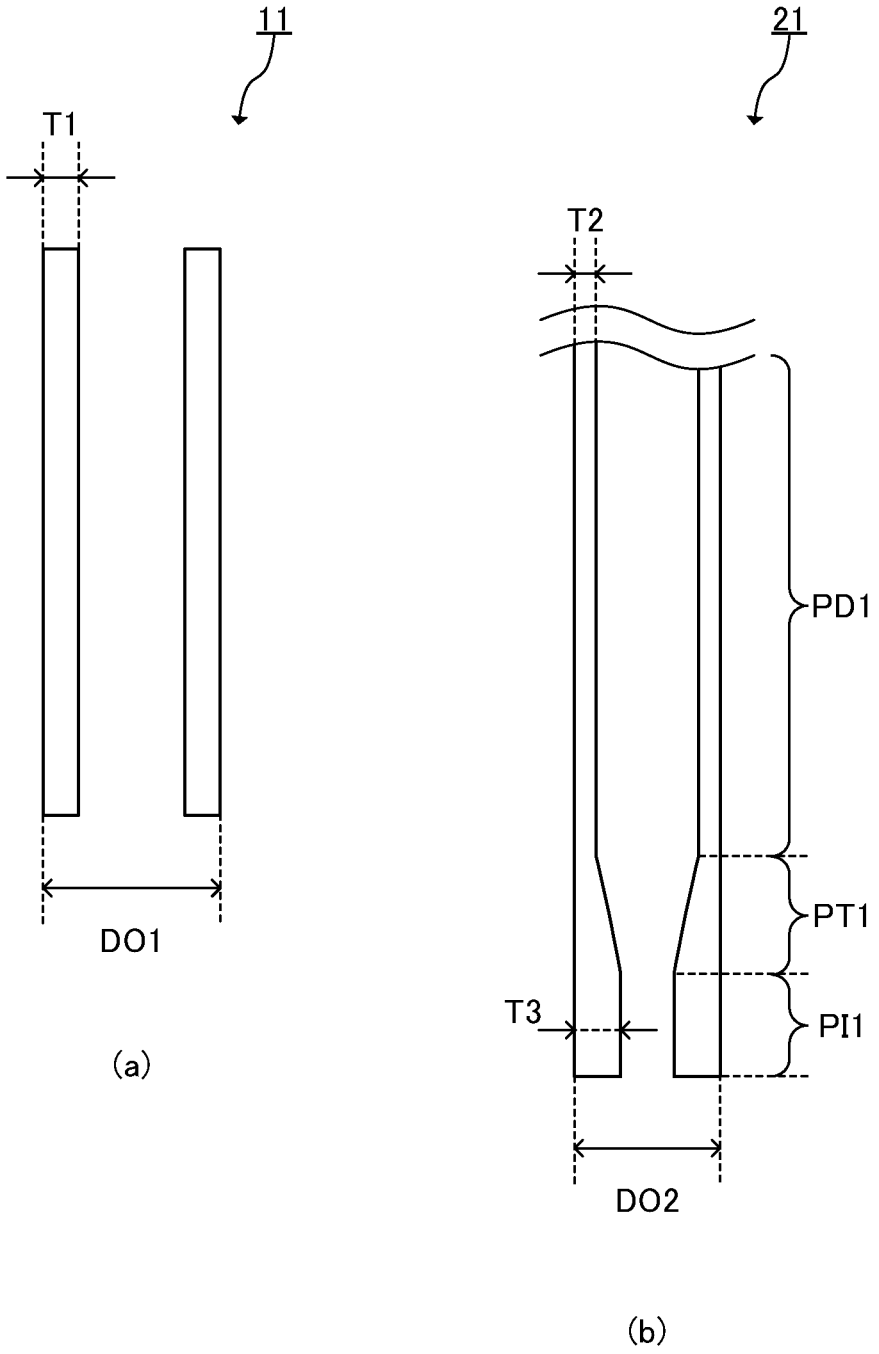
FIG. 1 is a schematic cross-sectional view for showing examples of a configuration of a first raw pipe used in an extrusion molding method for a differential thickness pipe according to a first embodiment of the present invention (first method) and a configuration of a differential thickness pipe molded from the first raw pipe.

FIG. 1 is a schematic cross-sectional view for showing examples of a configuration of a first raw pipe used in the first method and a configuration of a differential thickness pipe molded from the first raw pipe. As shown in (a) of FIG. 1, the first raw pipe 11 is a tubular member having a first wall thickness T1 that is a predetermined wall thickness and a first outer diameter DO1 that is a predetermined outer diameter. A material constituting the first raw pipe 11 is not particularly limited as long as it can be formed into a desired shape by plastic deformation in extrusion processing. Typically, the material constituting the first raw pipe 11 is a metal such as lead, tin, aluminum, copper, zirconium, titanium, molybdenum, vanadium, niobium, steel and the like.

Next, as shown in (b) of FIG. 1, the differential thickness pipe 21 molded by the first method includes a first thin-walled portion PD1 and a first thick-walled portion PI1. The first thin-walled portion PD1 is a portion having a second wall thickness T2 that is a predetermined wall thickness smaller than the first wall thickness T1 and a second outer diameter DO2 that is a predetermined outer diameter smaller than the first outer diameter DO1. The first thick-walled portion PI1 is a portion having an outer diameter equal to the second outer diameter DO2 and a third wall thickness T3 that is a predetermined wall thickness larger than the second wall thickness T2. Moreover, between the first thin-walled portion PD1 and the first thick-walled portion PI1, a first tapered portion PT1 that is a portion having a wall thickness increasing from the second wall thickness T2 to the third wall thickness T3 as approaching from the first thin-walled portion PD1 to the first thick-walled portion PI1. Details of the first taper portion PT1 will be mentioned later.

In addition, as mentioned above, shapes of cross sections of internal spaces of the first thick-walled portion PI1 and the first thin-walled portion PD1 are not particularly limited, and a wide variety of shapes such as a polygonal shape, an elliptical shape and a circular shape can be adopted, respectively. In other words, shapes of the internal spaces of the first thick-walled portion PI1 and the first thin-walled portion PD1 are not particularly limited, and can be various shapes such as a polygonal columnar shape, an elliptical columnar shape and a cylindrical columnar shape, respectively. Therefore, a shape of an internal space of the first tapered portion PT1 is also not particularly limited, as long as it has a shape with a cross section shrinking from a shape of a cross section of the first thin-walled portion PD1 to a shape of a cross section of the first thick-walled portion PI1 as approaching from the first thin-walled portion PD1 to the first thick-walled portion PI1.

The first core bar includes a first small cross section portion, a first large cross section portion and a first cross section increasing portion. The first small cross section portion is a portion formed on a tip end side that is a downstream side in an extrusion direction and having a first cross section that is a cross section corresponding to the cross section of the internal space of the first thick-walled portion. The first large cross section portion is a portion formed on a base end side that is an upstream side in the extrusion direction and having a second cross section that is a cross section corresponding to the cross section of the internal space of the first thin-walled portion. The first cross section increasing portion is a portion formed between the first small cross section portion and the first large cross section portion and having a cross section expanding from the first cross section to the second cross section as approaching from the first small cross section portion to the first large cross section portion.

In addition, as mentioned above, the shapes of the internal spaces of the first thick-walled portion PI1 and the first thin-walled portion PD1 of the differential thickness pipe 21 are not particularly limited, and a wide variety of shapes such as a polygonal columnar shape, an elliptical columnar shape and a cylindrical columnar shape can be adopted, respectively. However, in the following explanation, for the purpose of facilitating the understanding of the present invention, a case where the internal spaces of the first thick-walled portion PI1 and the first thin-walled portion PD1 of the differential thickness pipe 21 respectively have a cylindrical columnar shape will be explained.

Figure 2:
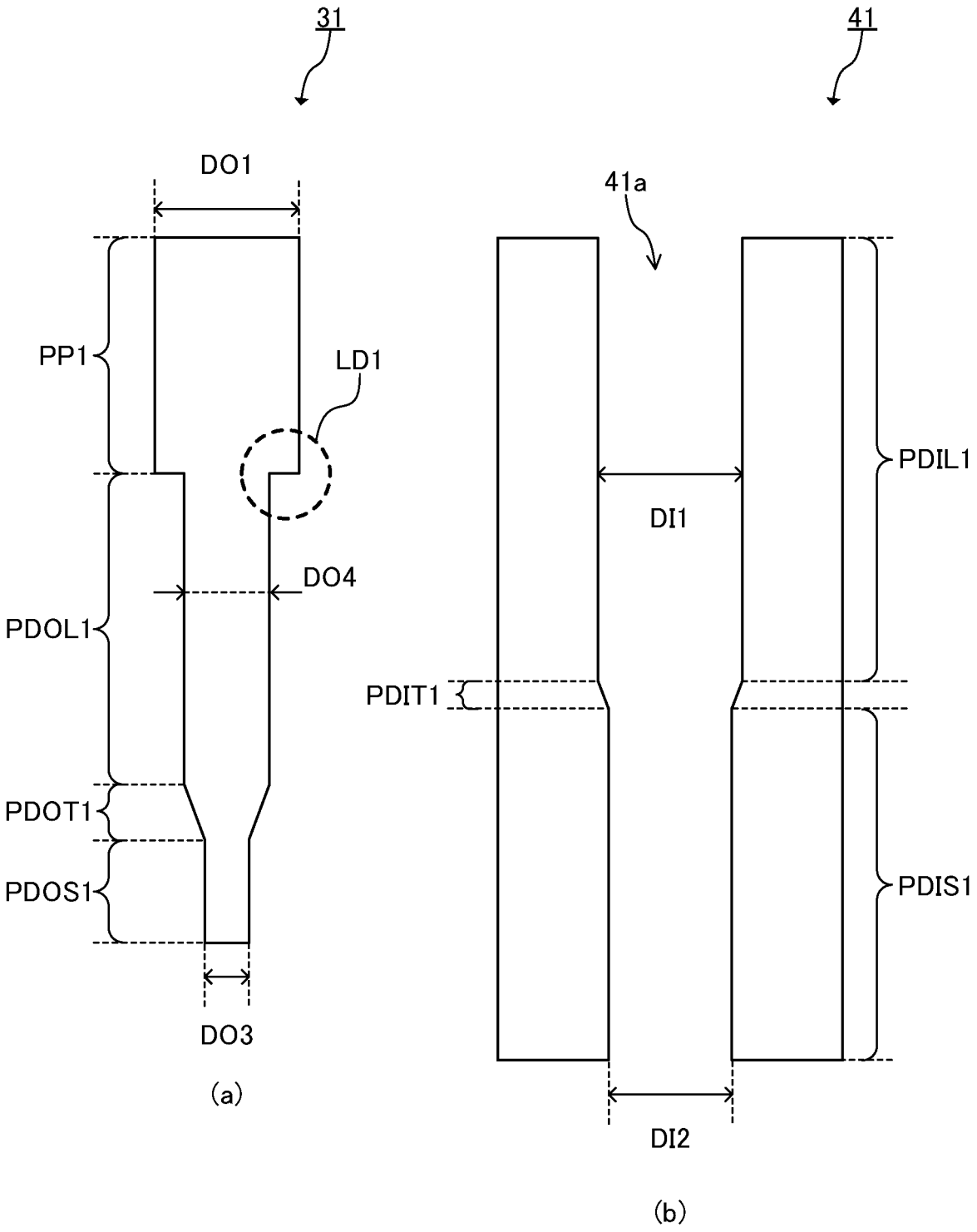
FIG. 2 is a schematic cross-sectional view for showing examples of configurations of a first core bar and a first die used in the first method.

(a) of FIG. 2 is a schematic cross-sectional view for showing an example of a configuration of a first core bar used in the first method. As shown in (a) of FIG. 2, the first core bar 31 includes a first small cross section portion PDOS1, a first large cross section portion PDOL1 and a first cross section increasing portion PDOT1. The first small cross section portion PDOS1 is a portion formed on a tip end side that is a downstream side in the extrusion direction (lower side in FIG. 2) and having a third outer diameter DO3 that is an outer diameter corresponding to an inner diameter of the first thick-walled portion PI1 of the differential thickness pipe 21. The first large cross section portion PDOL1 is a portion formed on a base end side that is an upstream side in the extrusion direction (upper side in FIG. 2) and having a fourth outer diameter DO4 that is an outer diameter corresponding to an inner diameter of the first thin-walled portion PD1 of the differential thickness pipe 21. The first cross section increasing portion PDOT1 is a portion formed between the first small cross section portion PDOS1 and the first large cross section portion PDOL1 and having an outer diameter increasing from the third outer diameter DO3 to the fourth outer diameter DO4 as approaching from the first small cross section portion PDOS1 to the first large cross section portion PDOL1.

In addition, a first pressing portion PP1 that is a cylindrical columnar portion having an outer diameter equal to the first outer diameter DO1 which is the outer diameter of the first raw pipe 11 is formed at the end portion on the base end side of the first core bar 31 shown in (a) of FIG. 2, and a level difference (portion LD1 surrounded by a broken line) is formed between the first pressing portion PP1 and the first large cross section portion PDOL1. By means of this level difference, a pair of the first raw pipe 11 and the first core bar 31 can be pressed into the first die hole 41*a* formed in the first die 41 while maintaining a state where the first core bar 31 is inserted at a predetermined position in the first raw pipe 11 to perform extrusion processing in the first step.

However, a mechanism for pressing the pair of the first raw pipe 11 and the first core bar 31 into the first die hole 41*a* while maintaining the state where the first core bar 31 is inserted at a predetermined position in the first raw pipe 11 in the first step is not limited to the above. For example, instead of integrally forming the first pressing portion PP1 as a part of the first core bar 31 as mentioned above, the first pressing portion PP1 may be formed as a member separate from the first core bar 31, and the first raw pipe 11 and the first core bar 31 may be pressed into the first die hole 41*a* while maintaining a predetermined positional relation by pressing the first pressing portion PP1 with the first drive mechanism. Alternatively, the first raw pipe 11 and the first core bar 31 may be pressed into the first die hole 41*a* by separate members, respectively.

Next, (b) of FIG. 2 is a schematic cross-sectional view for showing an example of a configuration of a first die used in the first method. As shown in (b) of FIG. 2, the first die hole 41*a* includes a first large inner diameter portion PDIL1, a first small inner diameter portion PDIS1 and a first inner diameter reducing portion PDIT1. The first large inner diameter portion PDIL1 is a portion formed on the base end side and having a first inner diameter DI1 that is an inner diameter corresponding to the first outer diameter DO1 that is the outer diameter of the first raw pipe 11. The first small inner diameter portion PDIS1 is a portion formed on the tip end side and having a second inner diameter DI2 that is an inner diameter corresponding to the second outer diameter DO2 of the differential thickness pipe 21. The first inner diameter reducing portion PDIT1 is a portion formed between the first large inner diameter portion PDIL1 and the first small inner diameter portion PDIS1 and having an inner diameter decreasing from the first inner diameter DI1 to the second inner diameter DI2 as approaching from the first large inner diameter portion PDIL1 to the first small inner diameter portion PDIS1.

Figure 3:
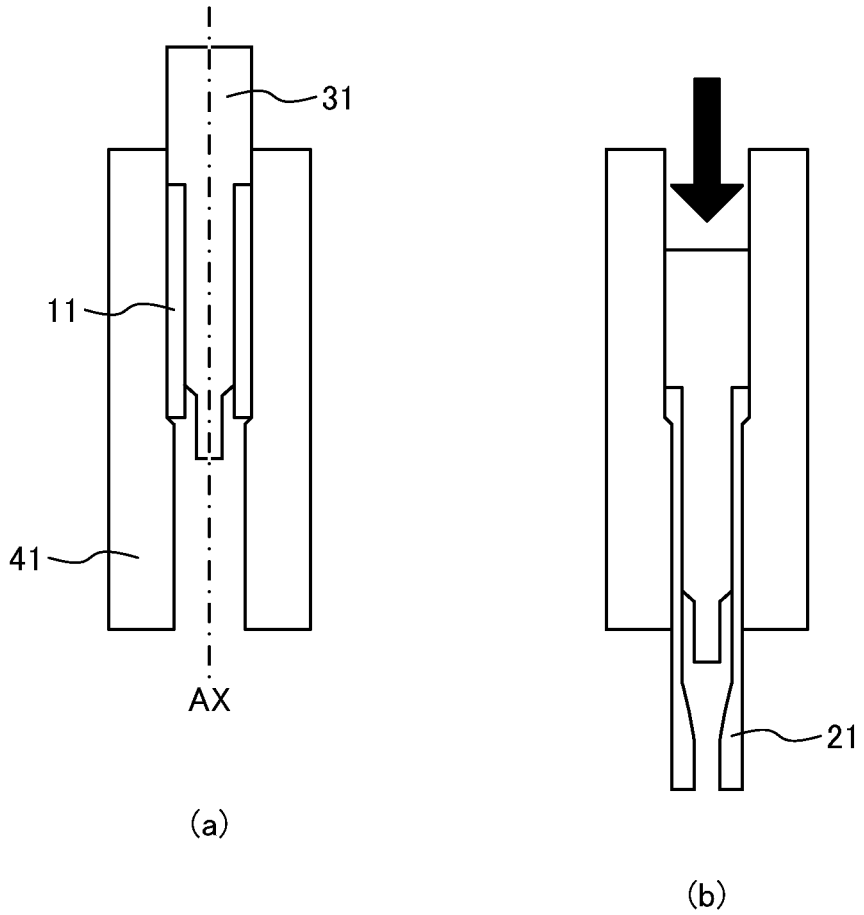
FIG. 3 is a schematic cross-sectional view for showing an example of a transition of a shape of the first raw pipe accompanying execution of extrusion processing in the first step performed in the first method.

The first step is performed in the first extrusion molding apparatus having the configuration as mentioned above. FIG. 3 is a schematic cross-sectional view for showing an example of a transition of a shape of the first raw pipe 11 accompanying execution of extrusion processing in the first step performed in the first method. In FIG. 3, in order to simplify the drawing, only a part of the reference signs attached to the respective parts shown in FIG. 1 and FIG. 2 is indicated. However, since the reference signs shown in FIG. 1 and FIG. 2 will be used for the sake of accuracy in the following explanation with respect to FIG. 3, please refer to FIG. 1 and FIG. 2 as necessary.

As shown in (a) of FIG. 3, the first raw pipe 11 is inserted into the first large inner diameter portion PDIL1 of the first die hole 41*a* formed in the first die 41, and the first core bar 31 is inserted into the first raw pipe 11. At this time, as mentioned above, the first level difference LD1 formed between the first pressing portion PP1 and the first large cross section portion PDOL1 of the first core bar 31 contacts with the end portion on the base end side of the first raw pipe 11. As a result, a positional relation between the first raw pipe 11 and the first core bar 31 is fixed. Namely, a state where the first core bar 31 is inserted at a predetermined position in the first raw pipe 11 is achieved.

As mentioned above, in the first step, a differential thickness pipe having the first thick-walled portion PI1 is molded by pressing the pair of the first raw pipe 11 and the first core bar 31 into the first die hole 41*a* to perform extrusion processing in a state where the first core bar 31 is inserted at a predetermined position in the first raw pipe 11. In this time period during which the first thick-walled portion PI1 is formed, it is necessary to execute extrusion processing through a gap corresponding to the third wall thickness T3 that is the thickness of the first thick-walled portion PI1.

Therefore, when the extrusion processing is started in the first step, the end portion on the base end side of the first small cross section portion PDOS1 is located at a position closer to the base end than the end portion on the base end side of the first small inner diameter portion PDIS1, in the extrusion direction. The distance between the end portion on the base end side of the first small cross section portion PDOS1 and the end portion on the base end side of the first small inner diameter portion PDIS1 can be appropriately determined based on the length in the extrusion direction of the first thick-walled portion PI1 to be formed and the third wall thickness T3 that is a wall thickness of the first thick-walled portion PI1, for example.

Moreover, the length of the first small cross section portion PDOS1 of the first core bar 31 can also be appropriately determined based on the length in the extrusion direction of the first thick-walled portion PI1 to be formed, for example. Specifically, in a case where the tip end of the first small cross section portion PDOS1 has not yet reached the end on the base end side of the first small inner diameter portion PDIS1 at a time point when a material for forming the first thick-walled portion PI1 reaches the end portion on the base end side of the first small inner diameter portion PDIS1, such as a case where the length of the first small cross section portion PDOS1 is excessively short, for example, there is a possibility that the material may go around further to the tip end side than the first small cross section portion PDOS1 to make the wall thickness on the tip end side of the first thick-walled portion PI1 thicker than the third wall thickness T3. From the viewpoint of avoiding such a problem, it is preferable that the tip end of the first small cross section portion PDOS1 has reached the end portion on the base end side of the first small inner diameter portion PDIS1 or the vicinity thereof at a time point when the material for forming the first thick-walled portion PI1 reaches the end portion on the base end side of the first small inner diameter portion PDIS1 at the latest.

Next, as shown in (b) of FIG. 3, the differential thickness pipe 21 having the desired first thick-walled portion PI1 is molded by pressing the first core bar 31 to the extrusion direction (downward in the drawing) with a not-shown first drive mechanism (refer to a black arrow in the drawing) to press the pair of the first raw pipe 11 and the first core bar 31 into the first die hole 41*a* to perform extrusion processing. In (b) of FIG. 3, although an end surface on the tip end side of the differential thickness pipe 21 is illustrated as a flat surface, the end surface does not necessarily become flat, as will be mentioned later. Therefore, in applications where the end surface is required to be flat, it is desirable to perform secondary processing of the end surface by cutting or the like, for example, after the extrusion processing.

<Details of First Step>

Here, the transition of the shape of the first raw pipe accompanying progress of the extrusion processing in the first step performed in the first method will be explained in more detail, referring to further drawings. FIG. 4 to FIG. 8 are schematic sectional views for showing an example of positions of the first core bar and shapes of the first raw pipe in respective stages of the extrusion processing in the first step performed in the first step. In FIG. 4 to FIG. 8, although only a part on the right side from a common axis AX of the first core bar, the first raw pipe and the first die hole (refer to (a) of FIG. 3) is illustrated, the same applies to a part on the left side from the axis AX. Moreover, also in FIG. 4 to FIG. 8, in order to simplify the drawing, only a part of the reference signs attached to the respective parts shown in FIG. 1 and FIG. 2 is indicated. However, since the reference signs shown in FIG. 1 and FIG. 2 will be used for the sake of accuracy in the following explanations with respect to these drawings, please refer to FIG. 1 and FIG. 2 as necessary.

Figure 4:
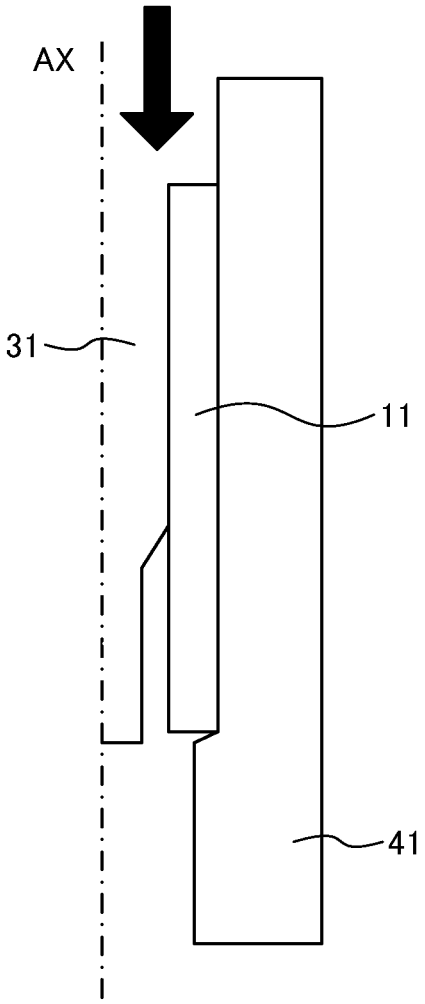
FIG. 4 is a schematic sectional view for showing an example of a position of a first core bar and a shape of the first raw pipe in a stage of extrusion processing in the first step performed in the first method.

In FIG. 4, similarly to (a) of FIG. 3, a state where the first raw pipe 11 is inserted into the first large inner diameter portion PDIL1 of the first die hole 41*a* and further the first core bar 31 is inserted at a predetermined position in the first raw pipe 11 is shown. Namely, FIG. 4 is a view for showing a state when the extrusion processing is started in the first step, and the end portion on the base end side of the first small cross section PDOS1 is located closer to the base end than the end portion on the base end side of the first small inner diameter portion PDIS1 in the extrusion direction (indicated by a black arrow).

Figure 5:
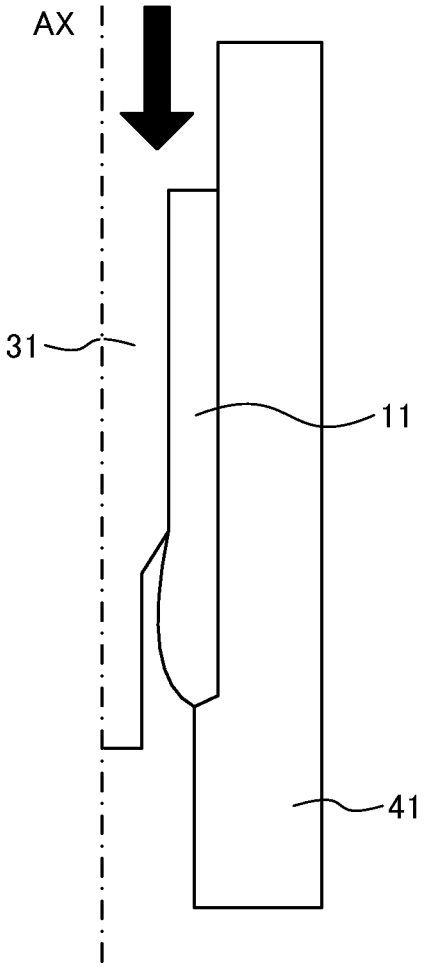
FIG. 5 is a schematic sectional view for showing an example of a position of the first core bar and a shape of the first raw pipe in a stage of extrusion processing in the first step performed in the first method.

Next, in FIG. 5, a state immediately after the first core bar 31 starts to be pressed to the downstream side (tip end side) in the extrusion direction together with the first raw pipe 11 by a first drive mechanism (not shown). By being pressed to the extrusion direction by the first pressing portion PP1 of the first core bar 31 and diameter reduction by the first inner diameter reducing portion PDIT1 of the first die hole 41*a*, the plastic flow of the material constituting the first raw pipe 11 toward the first small cross section PDOS1 of the first core bar 31 has been caused.

Figure 6:
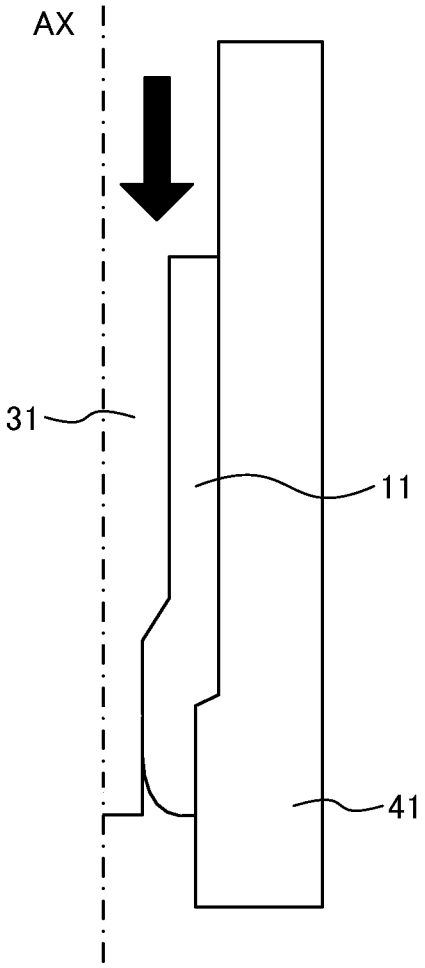
FIG. 6 is a schematic sectional view for showing an example of a position of the first core bar and a shape of the first raw pipe in a stage of extrusion processing in the first step performed in the first method.

In FIG. 6, a state where the extrusion processing is further advanced and the space between the first cross section increasing portion PDOT1 and first small cross section portion PDOS1 of the first core bar 31 and the first die 41 is being filled with the material constituting the first raw pipe 11 is shown. The first thick-walled portion PI1 of the differential thickness pipe 21 is formed of a material which has passed through a gap between the end portion on the base end side of the first small inner diameter portion PDIS1 and the first small cross section PDOS1 until the end portion on the base end side of the first small cross section PDOS1 of the first core bar 31 reaches the end portion on the base end side of the first small inner diameter portion PDIS1 of the first die hole 41*a*. The third wall thickness T3, which is the thickness of the first thick-walled portion PI1, is determined by the difference between the cross section of the first small inner diameter portion PDIS1 of the first die hole 41*a* and the cross section of the first small cross section PDOS1 of the first core bar 31. Therefore, when the internal space of the first thick-walled portion PI1 of the differential thickness pipe 21 has a cylindrical columnar shape as mentioned above, the third wall thickness T3 that is the thickness of the first thick-walled portion PI1 is determined by the difference between the second inner diameter DI2 that is the inner diameter of the first small inner diameter portion PDIS1 and the third outer diameter DO3 that is the outer diameter of the first small cross section portion PDOS1. Moreover, the length in the extrusion direction of the first thick-walled portion PI1 varies depending on the amount of the material passing through the gap between the end portion on the base end side of the first small inner diameter portion PDIS1 and the first small cross section portion PDOS1 until the end portion on the base end side of the first small cross section portion PDOS1 reaches the end portion on the base end side of the first small inner diameter portion PDIS1 and the area of the gap.

Figure 7:
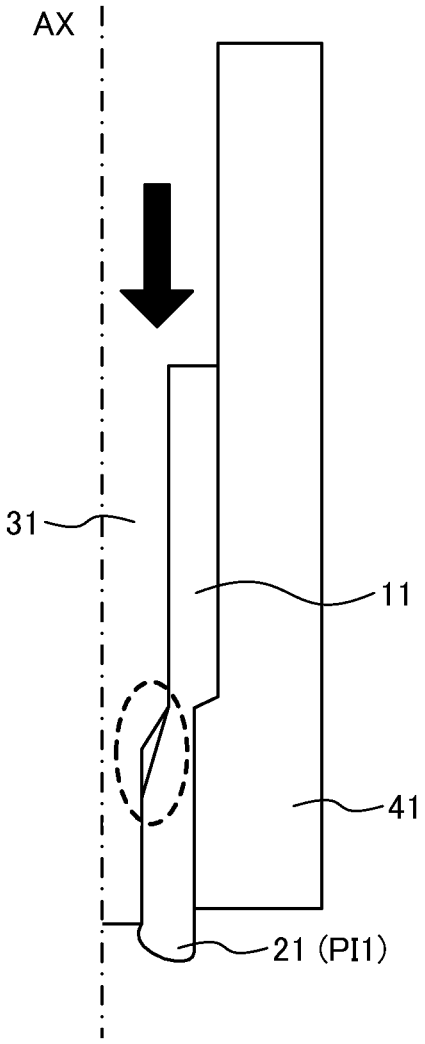
FIG. 7 is a schematic sectional view for showing an example of a position of the first core bar and a shape of the first raw pipe in a stage of extrusion processing in the first step performed in the first method.

Next, in FIG. 7, a state at a time point when the extrusion processing is further advanced and the end portion on the tip end side of the first large cross section portion PDOL1 of the first core bar 31 reaches the end portion on the base end side of the first small inner diameter portion PDIS1 of the first die hole 41*a* is shown. In the example shown in FIG. 7, a part of the first thick-walled portion PI1 of the differential thickness pipe 21 is extruded out of the tip end side of the first die hole 41*a*. Since there is no mold or the like which defines a shape on the tip end side of the first thick-walled portion PI1 in the example shown in FIG. 7, the end surface has become convex and a part of the material has gone around to the tip end side of the small cross section portion PDOS1 to make the wall thickness thicker than the third wall thickness T3, at the end portion on the tip end side of the first thick-walled portion PI1. Therefore, in applications where the end surface is required to be flat, as mentioned above, it is desirable to perform secondary processing of the end portion on the tip end side of the first thick-walled portion PI1 by cutting or the like, for example, after the extrusion processing.

Moreover, in a part in the vicinity of the end portion on the base end side of the first small cross section portion PDOS1 of the first core bar 31 and a part opposite to the first cross section increasing portion PDOT1 (parts surrounded by a broken line) of the first raw pipe 11 in the process of extrusion processing, a first tapered portion PT1 that is a tapered portion whose wall thickness decreases (inner diameter increases) as approaching from the tip end side to the base end side has been formed. Since the gap between the end portion on the base end side of the first small inner diameter portion PDIS1 and the first core bar 31 is gradually narrowed and the flow velocity of the material extruded to the tip end side is increased as the first cross section increasing portion PDOT1 of the first core bar 31 passes through a position opposite to the end portion on the base end side of the first small inner diameter portion PDIS1 of the first die hole 41*a*, the first tapered portion PT1 is formed to be a shape longer in the extrusion direction and having a gentler inclination than the first cross section increasing portion PDOT1. For this reason, a gap is formed between the part and the first core bar 31.

Figure 8:
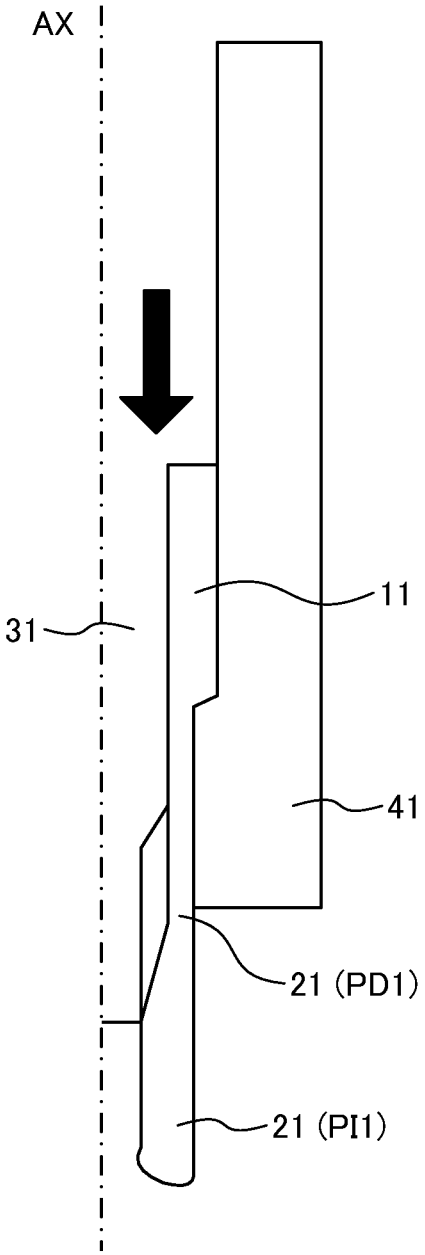
FIG. 8 is a schematic sectional view for showing an example of a position of the first core bar and a shape of the first raw pipe in a stage of extrusion processing in the first step performed in the first method.

After the stage shown in FIG. 7, the material constituting a part of the first raw pipe 11 pressed to the extrusion direction by the first pressing portion PP1 of the first core bar 31 passes through a gap between the end portion on the base end side of the first small inner diameter portion PDIS1 of the first die hole 41*a* and the first large cross section portion PDOL1 of the first core bar 31. As a result, as shown in FIG. 8, the first thin-walled portion PD1 of the differential thickness pipe 21 begins to be formed. The second wall thickness T2, which is the wall thickness of the first thin-walled portion PD1, is determined by the difference between the cross section of the first small inner diameter portion PDIS1 of the first die hole 41*a* and the cross section of the first large cross section portion PDOL1 of the first core bar 31. Therefore, when the internal space of the first thin-walled portion PD1 of the differential thickness pipe 21 has a cylindrical columnar shape as mentioned above, the second wall thickness T2 that is the wall thickness of the first thin-walled portion PD1 is determined by the difference between the second inner diameter DI2 that is the inner diameter of the first small inner diameter portion PDIS1 and the fourth outer diameter DO4 that is the outer diameter of the first large cross section portion PDOL1. Moreover, the length in the extrusion direction of the first thin-walled portion PD1 varies depending on the amount of the material passing through the gap between the end portion on the base end side of the first small inner diameter portion PDIS1 and the first large cross section portion PDOL1 after the end portion on the tip end side of the first large cross section portion PDOL1 reaches the end portion on the base end side of the first small inner diameter portion PDIS1 and the area of the gap In addition, as compared with the outer diameter (first outer diameter DO1) and wall thickness (first wall thickness T1) of the first raw pipe 11, the outer diameter (second outer diameter DO2) and wall thickness (second wall thickness T2) of the first thin-walled portion PD1 of the differential thickness pipe 21 are smaller. Therefore, as compared with the cross-sectional area of the first raw pipe 11, the cross-sectional area of the first thin-walled portion PD1 is smaller. As a result, as compared with the length in the extrusion direction of a part of the first raw pipe 11, which is a supply source of the material forming the first thin-walled portion PD1, the length in the extrusion direction of the first thin-walled portion PD1 is larger.

<Effect>

As explained above, in accordance with the first method, by performing the first step in the first extrusion molding apparatus comprising the first core bar, the first die and the first drive mechanism having the configuration as mentioned above, the differential thickness pipe including the first thin-walled portion and the first thick-walled portion can be easily molded. Namely, in accordance with the first method, the differential thickness pipe can be manufactured with high production efficiency and at a low cost.

Moreover, since a differential thickness pipe is molded by extrusion processing in the first method as mentioned above, difference between the thickness of the thin-walled portion and the thickness of the thick-walled portion can be made larger, as compared with a case where a differential thickness pipe is molded by draw processing, for example.

Specifically, in accordance with the first method, a differential thickness pipe having the third wall thickness T3, which is the thickness of the first thick-walled portion PI1 of the differential thickness pipe 21, 1.5 times the second wall thickness T2, which is the thickness of the first thin-walled portion PD1, or more can be molded. More preferably, in accordance with the first method, a differential thickness pipe having the third wall thickness T3, which is the thickness of the first thick-walled portion PI1 of the differential thickness pipe 21, twice the second wall thickness T2, which is the thickness of the first thin-walled portion PD1, or more can be molded.

Second Embodiment

Hereafter, an extrusion molding method for a differential thickness pipe according to a second embodiment of the present invention (which may be referred to as a "second method" hereafter) will be explained, referring to drawings.

For example, as shown in FIG. 7, at the end portion on the tip end side of the first thick-walled portion of the differential thickness pipe formed by the first method, the end surface may become convex or a part of the material may go around to the tip end side of the first small cross section portion to make the wall thickness thicker than the third wall thickness. Therefore, in applications where the end surface is required to be flat, it is necessary to perform secondary processing on the end portion on the tip end side of the first thick-walled portion by cutting or the like, for example, after the extrusion processing. However, when the secondary processing is performed after the extrusion processing like this, it may lead to a problem such as an increase in the manufacturing cost of a differential thickness pipe, for example.

<Configuration>

Therefore, the second method is the above-mentioned first method, wherein the first extrusion molding apparatus further comprises a second core bar that is a core bar having a cylindrical columnar shape with an outer diameter equal to the second outer diameter. And, the first step is performed in a state where this second core bar is inserted into the first small inner diameter portion from the tip end side and is energized toward the base end side. Furthermore, at least when the extrusion processing is started in the first step, an end portion on the base end side of the second core bar is in contact with an end portion on the tip end side of the first core bar.

Figure 9:
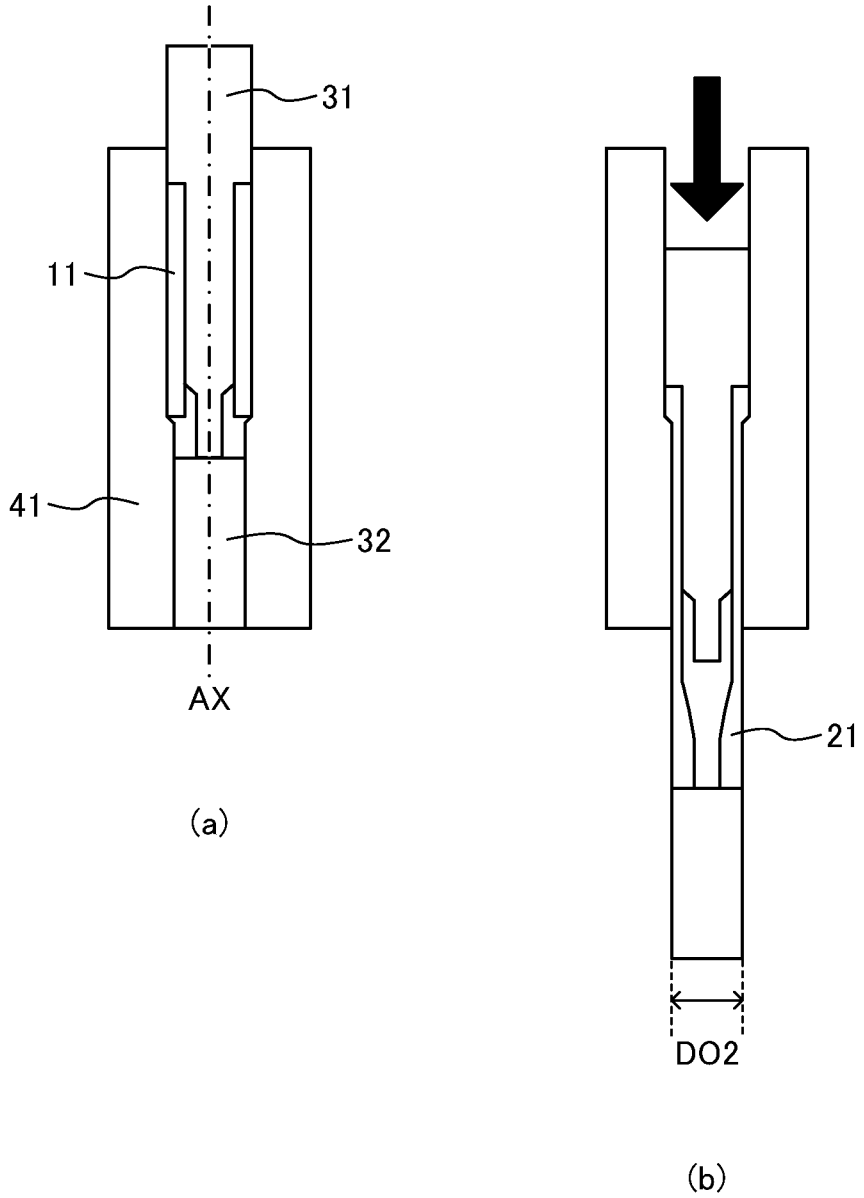
FIG. 9 is a schematic cross-sectional view for showing an example of a transition of a shape of the first raw pipe accompanying execution of extrusion processing in the first step performed in an extrusion molding method for a differential thickness pipe according to a second embodiment of the present invention (second method).

FIG. 9 is a schematic cross-sectional view for showing an example of a transition of a shape of the first raw pipe 11 accompanying execution of extrusion processing in the first step performed in the second method. Moreover, in FIG. 9, in order to simplify the drawing, only a part of the reference signs attached to the respective parts shown in FIG. 1 and FIG. 2 is indicated. However, since the reference signs shown in FIG. 1 and FIG. 2 will be used for the sake of accuracy in the following explanation with respect to FIG. 9, please refer to FIG. 1 and FIG. 2 as necessary.

(a) of FIG. 9A is the same as (3) of FIG. 3, except that the second core bar 32, which is a core bar having a cylindrical columnar shape having an outer diameter equal to the second outer diameter DO2, is inserted into the first small inner diameter portion PDIS1 of the first die hole 41*a* from the tip end side and is energized toward the base end side, and the end portion on the base end side of the second core bar 32 is in contact with the end portion on the tip end side of the first core bar 31.

Next, as shown in (b) of FIG. 9, by pressing the first core bar 31 to the extrusion direction (downward in the drawing) with a not-shown first drive mechanism (refer to a black arrow in the drawing) to press the pair of the first raw pipe 11 and the first core bar 31 into the first die hole 41*a* to perform extrusion processing, the differential thickness pipe 21 having a desired first thick-walled portion PI1 is molded. However, in the second method, the tip end side of a space where the first thick-walled portion PI1 of the differential thickness pipe 21 is formed is blocked by the end surface on the base end side of the second core bar 32. Therefore, in accordance with the second method, the end surface on the tip end side of the first thick-walled portion PI1 can be formed as a plane corresponding to the end surface on the base end side of the second core bar 32.

<Details of First Step>

Here, the transition of the shape of the first raw pipe accompanying progress of the extrusion processing in the first step performed in the second method will be explained in more detail, referring to further drawings. FIG. 10 to FIG. 14 are schematic cross-sectional views for showing an example of positions of the first core bar and the shapes of the first raw pipe in respective stages of the extrusion processing performed in the first step. The first extrusion molding apparatus shown in FIG. 10 to FIG. 14 has the same configuration as the first extrusion molding apparatus shown in FIG. 4 to FIG. 8 except that the first extrusion molding apparatus further includes the second core bar 32 that is a core bar having a cylindrical columnar shape with an outer diameter equal to the second outer diameter DO2, and this second core bar 32 is inserted into the first small inner diameter portion PDIS1 of the first die hole 41*a* from the tip end side and is energized toward the base end side. Moreover, each of the stages of the extrusion processing shown in FIG. 10 to FIG. 14 corresponds to each of the stages of the extrusion processing shown in FIG. 4 to FIG. 8, respectively.

Furthermore, also in FIG. 10 to FIG. 14, similarly to FIG. 4 to FIG. 8, although only a part on the right side from a common axis AX of the first core bar, the first raw pipe and the first die hole (refer to (a) of FIG. 9) is illustrated, the same applies to a part on the left side from the axis AX. In addition, also in FIG. 10 to FIG. 14, in order to simplify the drawing, only a part of the reference signs attached to the respective parts shown in FIG. 1 and FIG. 2 is indicated. However, since the reference signs shown in FIG. 1 and FIG. 2 will be used for the sake of accuracy in the following explanations with respect to these drawings, please refer to FIG. 1 and FIG. 2 as necessary.

Figure 10:
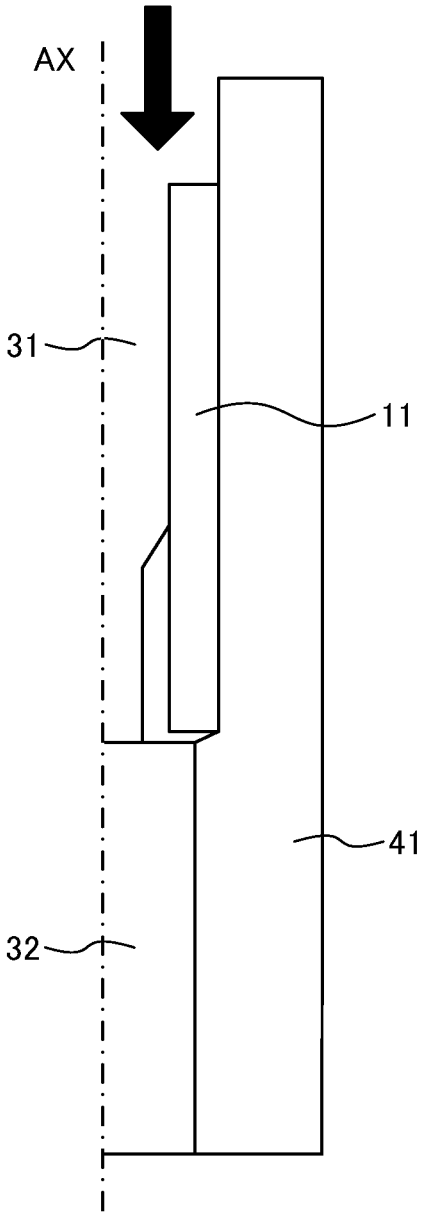
FIG. 10 is a schematic sectional view for showing an example of positions of the first core bar and a second core bar and a shape of the first raw pipe in a stage of extrusion processing in the first step performed in the second method.

In FIG. 10, similarly to FIG. 4, a state where the first raw pipe 11 is inserted into the first large inner diameter portion PDIL1 of the first die hole 41*a* and further the first core bar 31 is inserted at a predetermined position in the first raw pipe 11 is shown. In addition, in FIG. 10, the second core bar 32 is inserted into the first small inner diameter portion PDIS1 of the first die hole 41*a* from the tip end side and is energized toward the base end side, and the end portion on the base end side of the second core bar 32 is in contact with the end portion on the tip end side of the first core bar 31. Namely, FIG. 10 is a view for showing a state when the extrusion processing is started in the first step.

Figure 11:
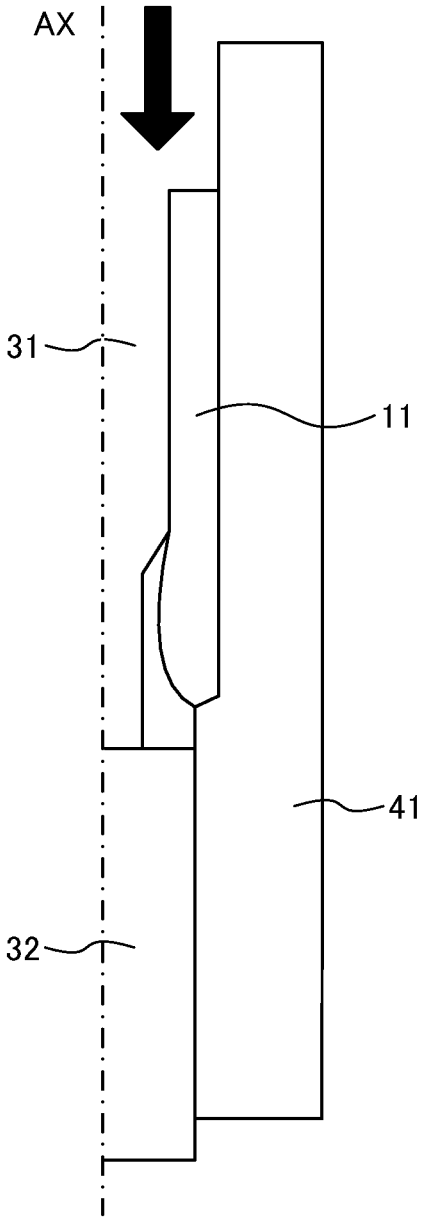
FIG. 11 is a schematic sectional view for showing an example of positions of the first core bar and the second core bar and a shape of the first raw pipe in a stage of extrusion processing in the first step performed in the second method.

Next, in FIG. 11, similarly to FIG. 5, a state immediately after the first core bar 31 starts to be pressed to the downstream side (tip end side) in the extrusion direction together with the first raw pipe 11 by a first drive mechanism (not shown). By being pressed to the extrusion direction by the first pressing portion PP1 of the first core bar 31 and diameter reduction by the first inner diameter reducing portion PDIT1 of the first die hole 41*a*, the plastic flow of the material constituting the first raw pipe 11 toward the first small cross section PDOS1 of the first core bar 31 has been caused. However, the material has not yet reached the second core bar 32.

Figure 12:
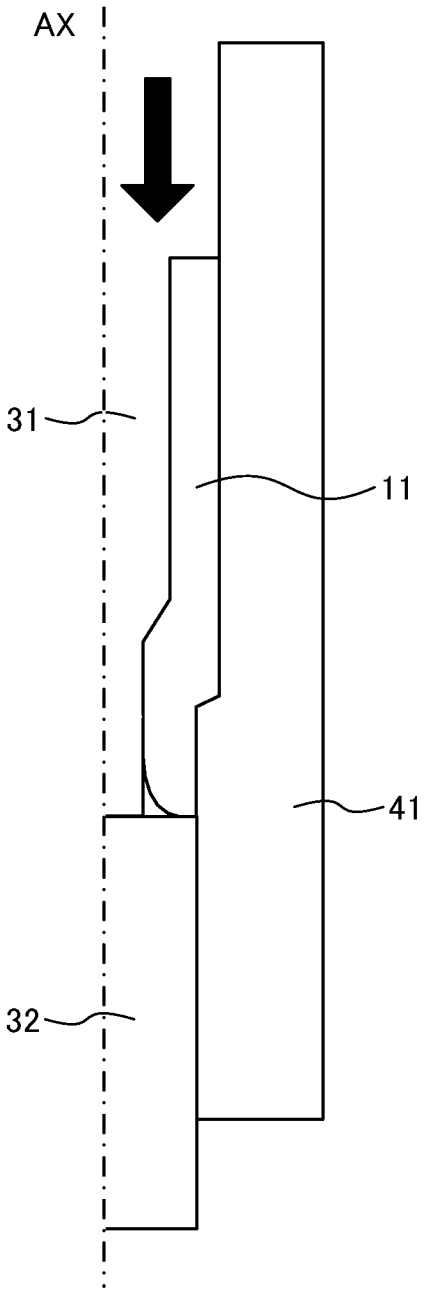
FIG. 12 is a schematic sectional view for showing an example of positions of the first core bar and the second core bar and a shape of the first raw pipe in a stage of extrusion processing in the first step performed in the second method.

In FIG. 12, similarly to FIG. 6, a state where the extrusion processing is further advanced and the space defined by the first cross section increasing portion PDOT1 and first small cross section portion PDOS1 of the first core bar 31, the first die 41 and the end surface on the base end side of the second core bar 32 is being filled with the material constituting the first raw pipe 11 is shown. Whereas the tip end side of the space where the first thick-walled portion PI1 of the differential thickness pipe 21 is formed is open in the first method shown in FIG. 6, the tip end side of the space is blocked by the end surface on the base end side of the second core bar 32 in the second method shown in FIG. 12. Also in this case, the third wall thickness T3, which is the thickness of the first thick-walled portion PI1, is determined by the difference between the cross section of the first small inner diameter portion PDIS1 of the first die hole 41*a* and the cross section of the first small cross section PDOS1 of the first core bar 31.

Therefore, when the internal space of the first thick-walled portion PI1 of the differential thickness pipe 21 has a cylindrical columnar shape as mentioned above, the third wall thickness T3 that is the thickness of the first thick-walled portion PI1 is determined by the difference between the second inner diameter DI2 that is the inner diameter of the first small inner diameter portion PDIS1 and the third outer diameter DO3 that is the outer diameter of the first small cross section portion PDOS1. Moreover, the length in the extrusion direction of the first thick-walled portion PI1 of the differential thickness pipe 21 varies depending on the amount of the material passing through the gap between the end portion on the base end side of the first small inner diameter portion PDIS1 and the first small cross section portion PDOS1 until the end portion on the base end side of the first small cross section portion PDOS1 reaches the end portion on the base end side of the first small inner diameter portion PDIS1 and the area of the gap.

Figure 13:
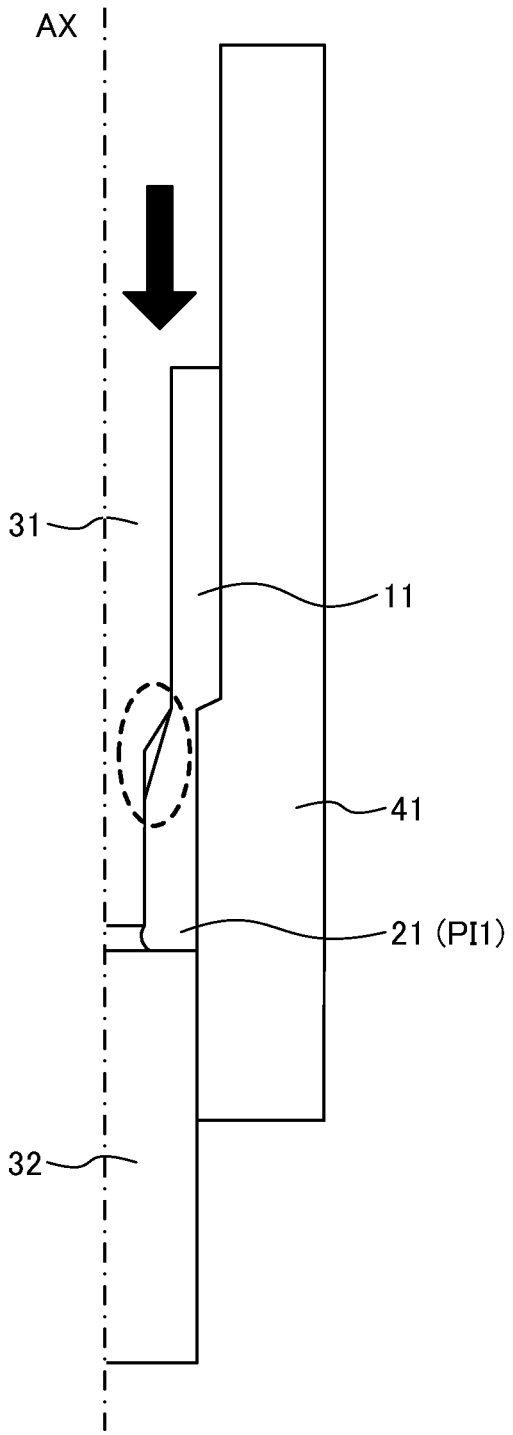
FIG. 13 is a schematic sectional view for showing an example of positions of the first core bar and the second core bar and a shape of the first raw pipe in a stage of extrusion processing in the first step performed in the second method.

Next, in FIG. 13, similarly to FIG. 7, a state at a time point when the extrusion processing is further advanced and the end portion on the tip end side of the first large cross section portion PDOL1 of the first core bar 31 reaches the end portion on the base end side of the first small inner diameter portion PDIS1 of the first die hole 41*a* is shown. Also in this case, in a part in the vicinity of the end portion on the base end side of the first small cross section portion PDOS1 of the first core bar 31 and a part opposite to the first cross section increasing portion PDOT1 (parts surrounded by a broken line) of the first raw pipe 11 in the process of extrusion processing, a tapered portion (first tapered portion PT1) has been formed, and a gap has been formed between the part and the first core bar 31.

However, in the second method exemplified in FIG. 13, as mentioned above, the tip end side of the space where the first thick-walled portion PI1 of the differential thickness pipe 21 is formed is blocked by the end surface on the base end side of the second core bar 32. Therefore, the end surface on the tip end side of the first thick-walled portion PI1 is formed as a flat surface corresponding to the end surface on the base end side of the second core bar 32. However, when the end portion on the tip end side of the first thick-walled portion PI1 of the differential thickness pipe 21 is extruded further to the tip end side than the tip end of the first small cross section portion PDOS1 of the first core bar 31, the second core bar 32 is pressed by the end portion on the tip side of the first thick-walled portion PI1 to be separated from the first core bar 31, and a gap is created between these two core bars. As a result, as shown in FIG. 13, at the end portion on the tip end side of the first thick-walled portion PI1, a part of the material may go around to the tip end side of the first small cross section portion PDOS1 and a part having a wall thickness thicker than the third wall thickness T3 may be formed. In some applications of the differential thickness pipe 21, it may be desirable to perform secondary processing of such an unintended thick-walled portion by cutting or the like, for example, after the extrusion processing.

Figure 14:
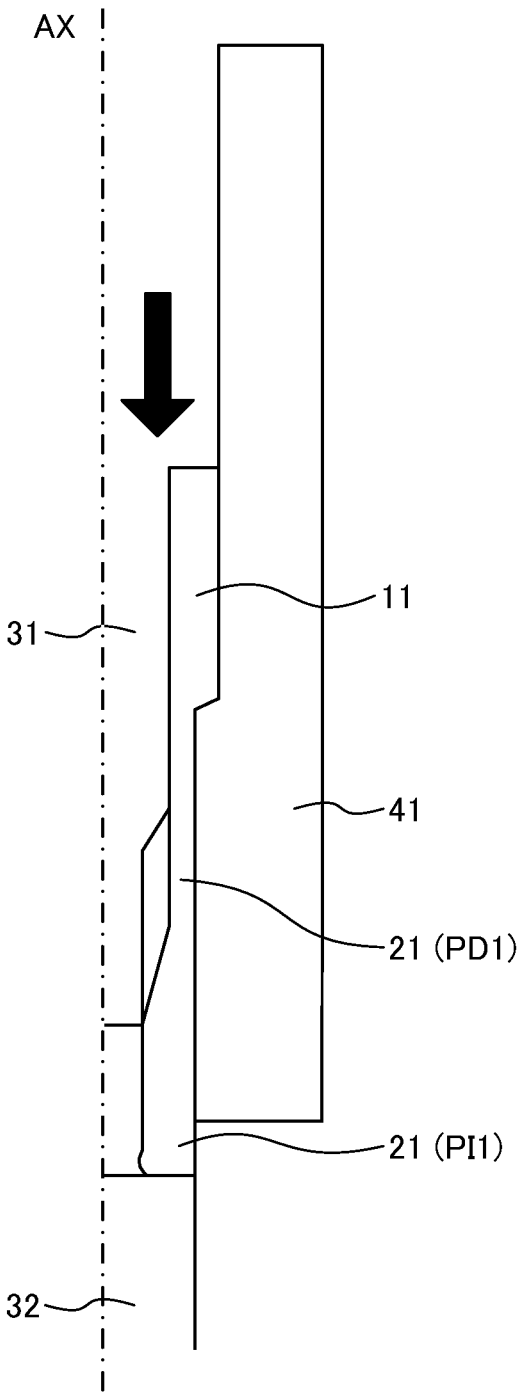
FIG. 14 is a schematic sectional view for showing an example of positions of the first core bar and the second core bar and a shape of the first raw pipe in a stage of extrusion processing in the first step performed in the second method.

After the stage shown in FIG. 13, the material constituting a part of the first raw pipe 11 pressed to the extrusion direction by the first pressing portion PP1 of the first core bar 31 passes through a gap between the end portion on the base end side of the first small inner diameter portion PDIS1 of the first die hole 41*a* and the first large cross section portion PDOL1 of the first core bar 31. As a result, as shown in FIG. 14, the first thin-walled portion PD1 of the differential thickness pipe 21 begins to be formed. Also in this case, the second wall thickness T2, which is the wall thickness of the first thin-walled portion PD1, is determined by the difference between the cross section of the first small inner diameter portion PDIS1 of the first die hole 41*a* and the cross section of the first large cross section portion PDOL1 of the first core bar 31. Therefore, when the internal space of the first thin-walled portion PD1 of the differential thickness pipe 21 has a cylindrical columnar shape as mentioned above, the second wall thickness T2 that is the wall thickness of the first thin-walled portion PD1 is determined by the difference between the second inner diameter DI2 that is the inner diameter of the first small inner diameter portion PDIS1 and the fourth outer diameter DO4 that is the outer diameter of the first large cross section portion PDOL1. Moreover, the length in the extrusion direction of the first thin-walled portion PD1 varies depending on the amount of the material passing through the gap between the end portion on the base end side of the first small inner diameter portion PDIS1 and the first large cross section portion PDOL1 after the end portion on the tip end side of the first large cross section portion PDOL1 reaches the end portion on the base end side of the first small inner diameter portion PDIS1 and the area of the gap.

<Effect>

As explained above, in the second method, the tip end side of the space where the first thick-walled portion of the differential thickness pipe is formed is blocked by the end surface on the base end side of the second core bar. Therefore, in accordance with the second method, the end surface on the tip end side of the first thick-walled portion can be formed as a plane corresponding to the end surface on the base end side of the second core bar.

Third Embodiment

Hereafter, an extrusion molding method for a differential thickness pipe according to a third embodiment of the present invention (which may be referred to as a "third method" hereafter) will be explained, referring to drawings.

As explained above, in the differential thickness pipes molded by the first method and the second method, the first thick-walled portion is formed at the end portion on the tip side. However, in some applications, it may be necessary to form the first thick-walled portion at a predetermined position between both end portions instead of the end portion in the axial direction of the differential thickness pipe. In such a case, for example, the first thick-walled portion can be formed at an intermediate position in the axial direction of the differential thickness pipe, by forming a sufficiently long first thick-walled portion in the above-mentioned first step and reducing the wall thickness of the tip end side of the inner peripheral surface of the first thick-walled portion through secondary processing, such as cutting or the like, for example, to form a thin-walled portion. However, when the secondary processing is performed after the extrusion processing like this, it may lead to a problem such as an increase in the manufacturing cost of a differential thickness pipe, for example.

<Configuration>

Therefore, the third method is the above-mentioned first method, wherein the above-mentioned first step is performed using a second raw pipe that is the first raw pipe further comprising, at an end portion on the tip end side, a second thin-walled portion that is a portion having a fourth wall thickness which is a predetermined wall thickness smaller than the third wall thickness and a fifth outer diameter which is a predetermined outer diameter equal to or less than the second outer diameter.

As described above, the fifth outer diameter, which is the outer diameter of the second thin-walled portion, is a predetermined outer diameter equal to or less than the second outer diameter, which is the outer diameter of a part other than the second thin-walled portion of the differential thickness pipe molded by the third method. When the fifth outer diameter is equal to the second outer diameter, since all of the first thin-walled portion, the first thick-walled portion and the second thin-walled portion of the differential thickness pipe molded by the third method have the same outer diameter, the outer peripheral surfaces of these portions are flush with each other. On the other hand, when the fifth outer diameter is smaller than the second outer diameter, the outer diameter of the second thin-walled portion is smaller than the outer diameter of the first thin-walled portion and the first thick-walled portion of the differential thickness pipe molded by the third method, and a level difference is generated between the first thick-walled portion and the second thin-walled portion on the outer peripheral surface of the differential thickness pipe.

Moreover, the shape and size of a cross section of an internal space of the second thin-walled portion of the second raw pipe may be the same as the shape and size of a cross sections of an internal spaces of a part other than the second thin-walled portion of the second raw pipe or may be different therefrom. For example, the shape of the cross section of one of the second thin-walled portion and the part other than the second thin-walled portion of the second raw pipe may be non-circular (for example, a polygonal shape, an elliptical shape, etc.), and the other may be circular. Alternatively, both of the shapes of the cross sections of the second thin-walled portion and the part other than the second thin-walled portion of the second raw pipe may be non-circular or circular, and the sizes of the cross sections of both of these may be the same or different from each other. When both of the shapes of the cross sections of the second thin-walled portion and the part other than the second thin-walled portion are circular (namely, when both of the internal spaces of these have a cylindrical columnar shape), the inner diameter of the second thin-walled portion determined by the fourth wall thickness and the fifth outer diameter may be the same as or different from the inner diameter of the part other than the second thin-walled portion of the second raw pipe. Furthermore, the fourth wall thickness, which is the wall thickness of the second thin-walled portion, may be the same as or different from the second wall thickness, which is the wall thickness of the first thin-walled portion.

As the above, the differential thickness pipe formed by the third method further includes the second thin-walled portion closer to the tip end than the first thick-walled portion. Namely, in the differential thickness pipe molded by the third method, the first thick-walled portion is formed between the first thin-walled portion and the second thin-walled portion, which is an intermediate portion in the axial direction thereof.

Figure 15:
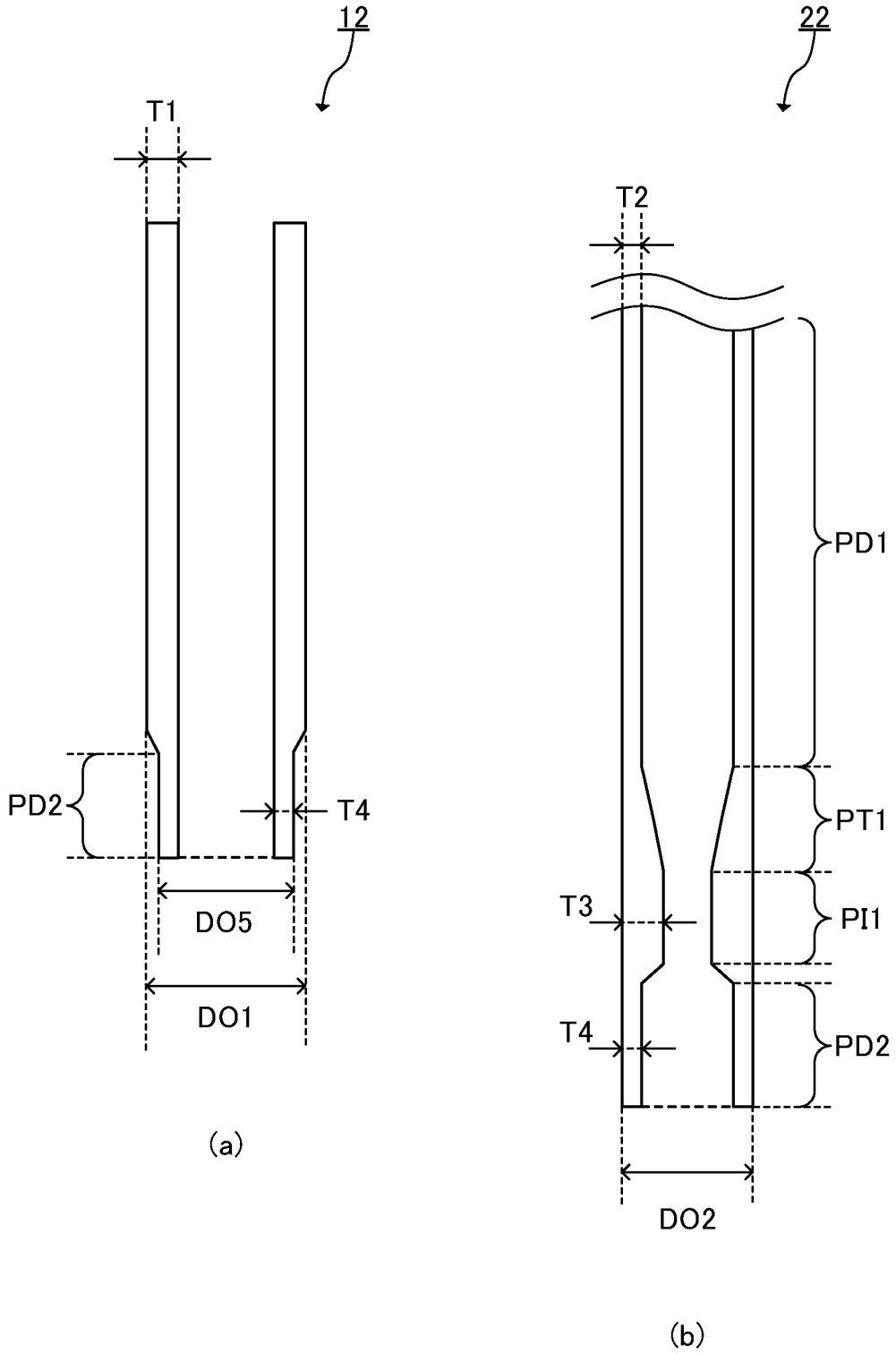
FIG. 15 is a schematic cross-sectional view for showing examples of a configuration of a second raw pipe used in an extrusion molding method for a differential thickness pipe according to a third embodiment of the present invention (third method) and a configuration of a differential thickness pipe molded from the raw pipe.

FIG. 15 is a schematic cross-sectional view for showing examples of a configuration of a second raw pipe used in the third method and a configuration of a differential thickness pipe molded from the second raw pipe. As shown in (a) of FIG. 15, the second raw pipe 12 used in the third method has the same configuration as the first raw pipe 11 used in the first method and the second method, except that the second raw pipe 12 further comprises the second thin-walled portion PD2 that is a portion having the fourth wall thickness T4 which is a predetermined wall thickness smaller than the third wall thickness T3 and the fifth outer diameter DO5 at the end portion on the tip end side.

On the other hand, as shown in (b) of FIG. 15, the differential thickness pipe 22 molded by the third method has the same configuration as the differential thickness pipe 21 molded by the first method and the second method except that the second thin-walled portion PD2 is further formed closer to the tip end than the first thick-walled portion PI1.

Since the first core bar and the first die used in the third method have the same configuration as the first core bar and the first die used in the first method and the second method as exemplified in FIG. 2, the explanation thereof will be omitted here.

Figure 16:
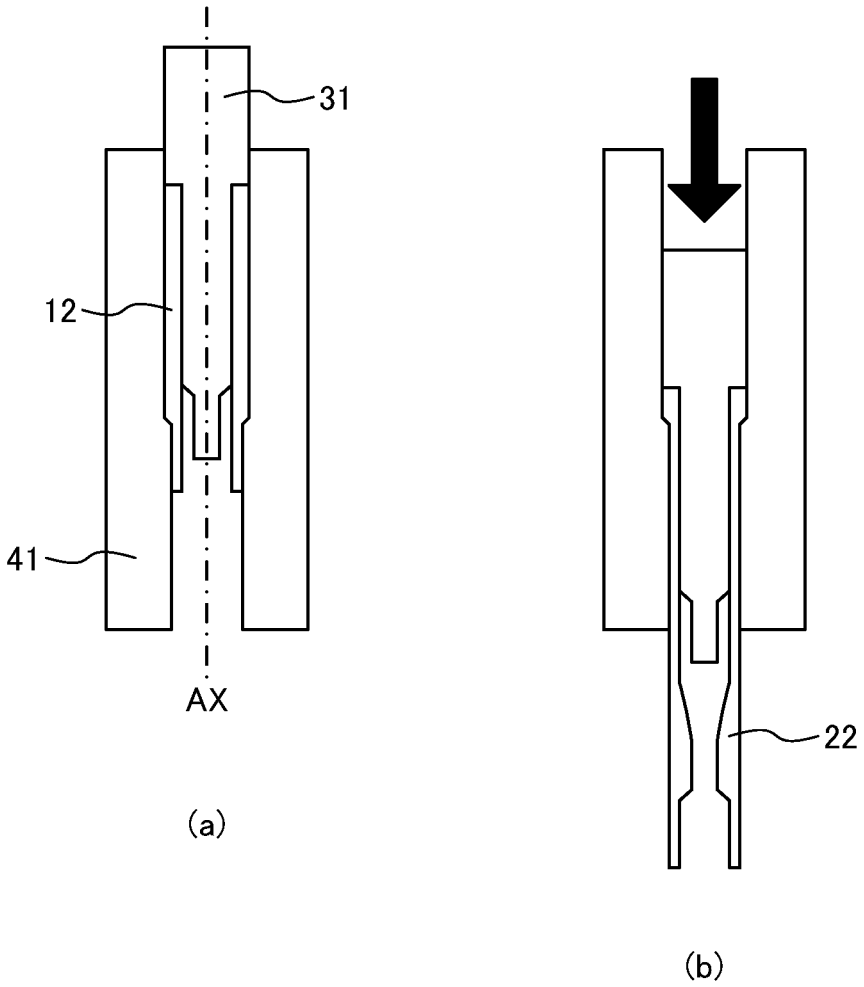
FIG. 16 is a schematic cross-sectional view for showing an example of a transition of a shape of the second raw pipe accompanying execution of extrusion processing in the first step performed in the third method.

FIG. 16 is a schematic cross-sectional view for showing an example of a transition of a shape of the second raw pipe accompanying execution of extrusion processing in the first step performed in the third method. In addition, in FIG. 16, in order to simplify the drawing, only a part of the reference signs attached to the respective parts shown in FIG. 2 and FIG. 15 is indicated. However, since the reference signs shown in FIG. 2 and FIG. 15 will be used for the sake of accuracy in the following explanations with respect to FIG. 16, please refer to FIG. 2 and FIG. 15 as necessary.

As shown in (a) of FIG. 16, the second raw pipe 12 is inserted into the first large inner diameter portion PDIL1 of the first die hole 41*a* formed in the first die 41, and the first core bar 31 is inserted into the second raw pipe 12. At this time, as mentioned above, the first level difference LD1 formed between the first pressing portion PP1 and the first large cross section portion PDOL1 of the first core bar 31 contacts with the end portion on the base end side of the second raw pipe 12. As a result, a positional relation between the second raw pipe 12 and the first core bar 31 is fixed. Namely, a state where the first core bar 31 is inserted at a predetermined position in the second raw pipe 12 is achieved.

Also in the third method, similarly to the first method, the first thick-walled portion PI1 is molded by pressing the pair of the second raw pipe 12 and the first core bar 31 into the first die hole 41*a* by the first drive mechanism to performing the extrusion processing in the state where the first core bar 31 is inserted at a predetermined position in the second raw pipe 12 in the first step. Specifically, as shown in (b) of FIG. 16, the differential thickness pipe 22 having the desired first thick-walled portion PI1 is molded by pressing (the first pressing portion PP1 of) the first core bar 31 to the extrusion direction (downward in the drawing) with a not-shown first drive mechanism (refer to a black arrow in the drawing) to press the pair of the second raw pipe 12 and the first core bar 31 into the first die hole 41*a* to perform extrusion processing.

However, in the third method, since the first step is performed using the second raw pipe comprising the second thin-walled portion at the end portion on the tip side as mentioned above, the first thick-walled portion is formed between the first thin-walled portion and the second thin-walled portion, which is an intermediate position in the axial direction of the differential thickness pipe.

<Details of First Step>

Figure 17:
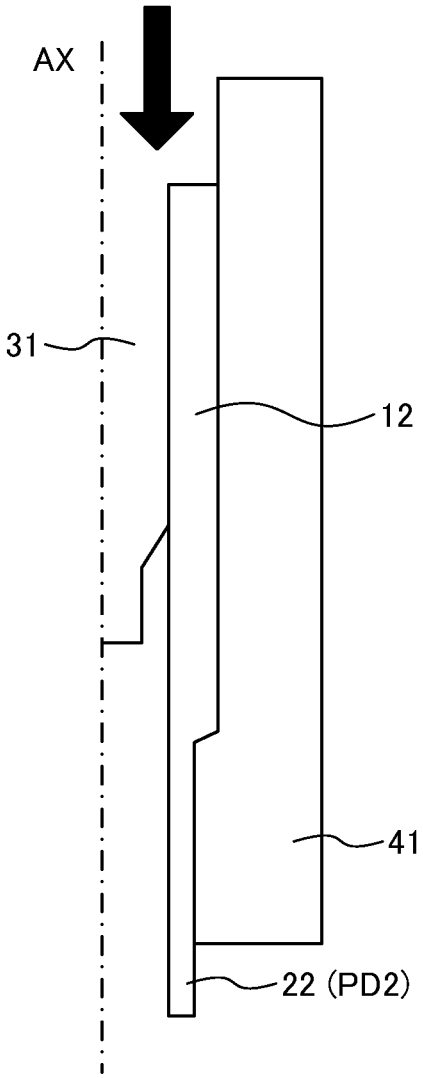
FIG. 17 is a schematic sectional view for showing an example of a position of the first core bar and a shape of the second raw pipe in a stage of extrusion processing in the first step performed in the third method.

Here, the transition of the shape of the second raw pipe accompanying progress of the extrusion processing in the first step performed in the third method will be explained in more detail, referring to further drawings. FIG. 17 to FIG. 21 are schematic cross-sectional views for showing an example of positions of the first core bar and the shapes of the second raw pipe in respective stages of the extrusion processing performed in the first step. The first step performed in the third method is the same as the first step performed in the first method, except that the second raw pipe 12 that is the first raw pipe 11 further comprising the second thin-walled portion PD2, which is a portion having the fourth wall thickness T4 and the second outer diameter DO2 is provided at the end portion on the tip end side, is used in place of with the first raw pipe 11 that is a tubular member having the first wall thickness T1 and the first outer diameter DO1. Therefore, the first core bar 31 and the first die 41 which the first extrusion molding apparatus used in the third method comprises have the same configurations as the first core bar 31 and the first die 41 which the first extrusion molding apparatus used in the first method and second method as exemplified in FIG. 2 comprises In FIG. 17, a state where the second raw pipe 12 is inserted into the first large inner diameter portion PDIL1 of the first die hole 41*a* and further the first core bar 31 is inserted at a predetermined position in the second raw pipe 12 is shown. Namely, FIG. 17 is a view for showing a state when the extrusion processing is started in the first step.

Figure 18:
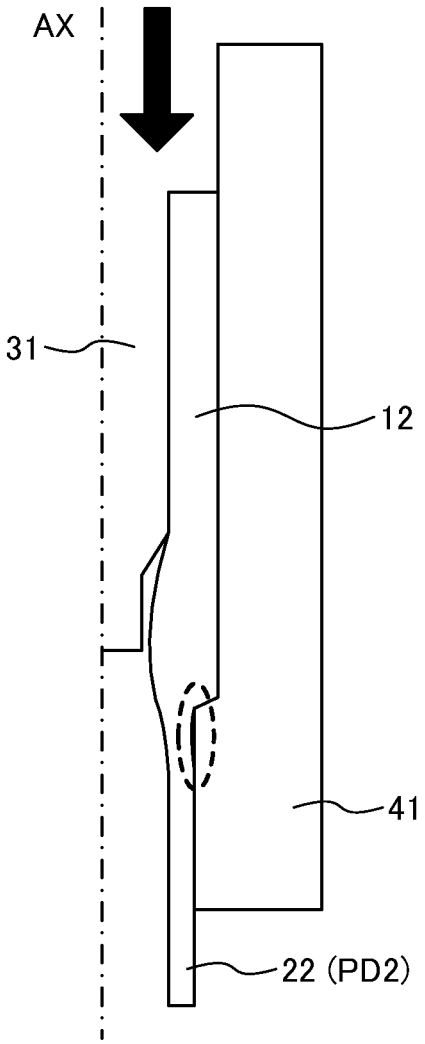
FIG. 18 is a schematic sectional view for showing an example of a position of the first core bar and a shape of the second raw pipe in a stage of extrusion processing in the first step performed in the third method.

Next, in FIG. 18, a state immediately after the first core bar 31 starts to be pressed to the downstream side (tip end side) in the extrusion direction together with the second raw pipe 12 by a first drive mechanism (not shown). By being pressed to the extrusion direction by the first pressing portion PP1 of the first core bar 31 and diameter reduction by the first inner diameter reducing portion PDIT1 of the first die hole 41*a*, the plastic flow of the material constituting the second raw pipe 12 toward the first small cross section PDOS1 of the first core bar 31 has been caused. At this time, for example, depending on the configuration of the first extrusion molding apparatus such as the length of the first small cross section portion PDOS1 of the first core bar 31, or the like, the outer peripheral surface in the vicinity of the boundary between the second thin-walled portion PD2 and the first thick-walled portion PI1 of the differential thickness pipe 22 to be molded may be peeled off from the inner peripheral surface of the first small inner diameter portion PDIS1 of the first die hole 41*a* to generate a slight depression in this part (refer to the part surrounded by a broken line). In applications where such a depression causes a quality problem, for example, it is desirable to perform secondary processing of this part by cutting or the like, for example, after the extrusion processing.

Figure 19:
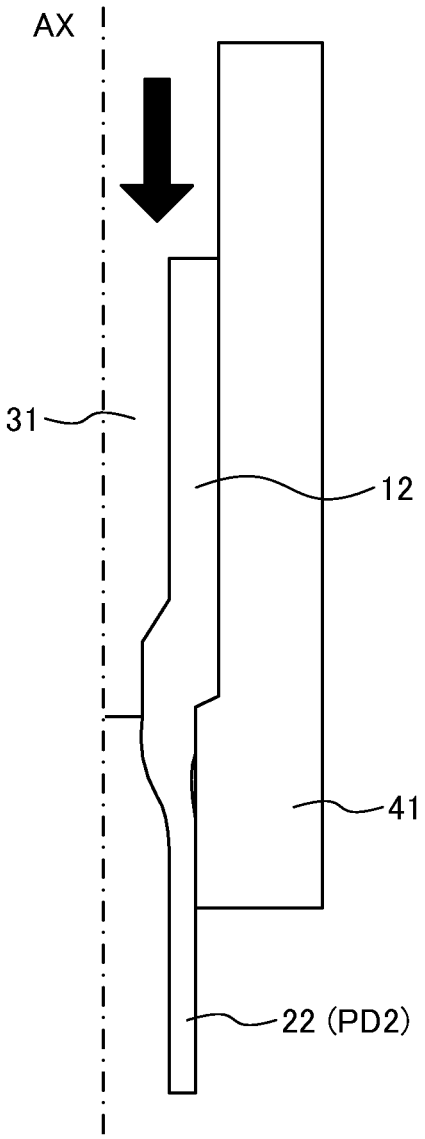
FIG. 19 is a schematic sectional view for showing an example of a position of the first core bar and a shape of the second raw pipe in a stage of extrusion processing in the first step performed in the third method.

In FIG. 19, a state where the extrusion processing is further advanced, the space defined by the first cross section increasing portion PDOT1 and first small cross section PDOS1 of the first core bar 31 and the first die 41 has been filled with the material constituting the second raw pipe 12, and a part of the first thick-walled portion PI1 of the differential thickness pipe 22 is being extruded through a gap between the end portion on the tip end side of the first core bar 31 and the first small inner diameter portion PDIS1 of the first die hole 41*a* is shown. Since there is no mold or the like which defines a shape on the tip end side of the first thick-walled portion PI1 in the example shown in FIG. 19, a part of the material has gone around to the tip end side of the small cross section portion PDOS1 of the first core bar 31 to make the wall thickness slightly thicker than the third wall thickness T3, at the end portion on the tip end side of the first thick-walled portion PI1. Therefore, for example, in applications where higher dimensional accuracy is required, it is desirable to perform secondary processing of this portion by cutting or the like, for example, after the extrusion processing.

Figure 20:
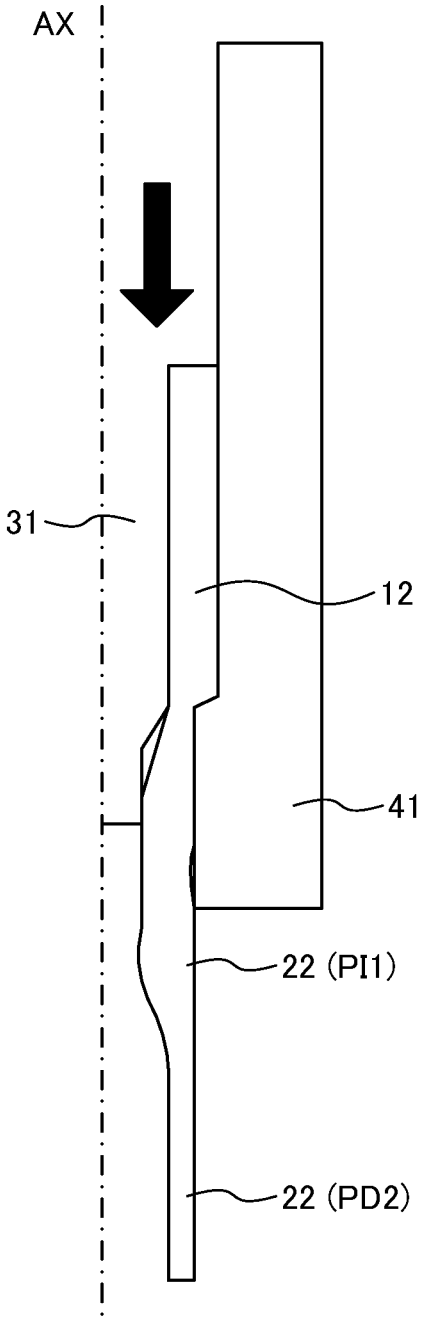
FIG. 20 is a schematic sectional view for showing an example of a position of the first core bar and a shape of the second raw pipe in a stage of extrusion processing in the first step performed in the third method.
Figure 21:
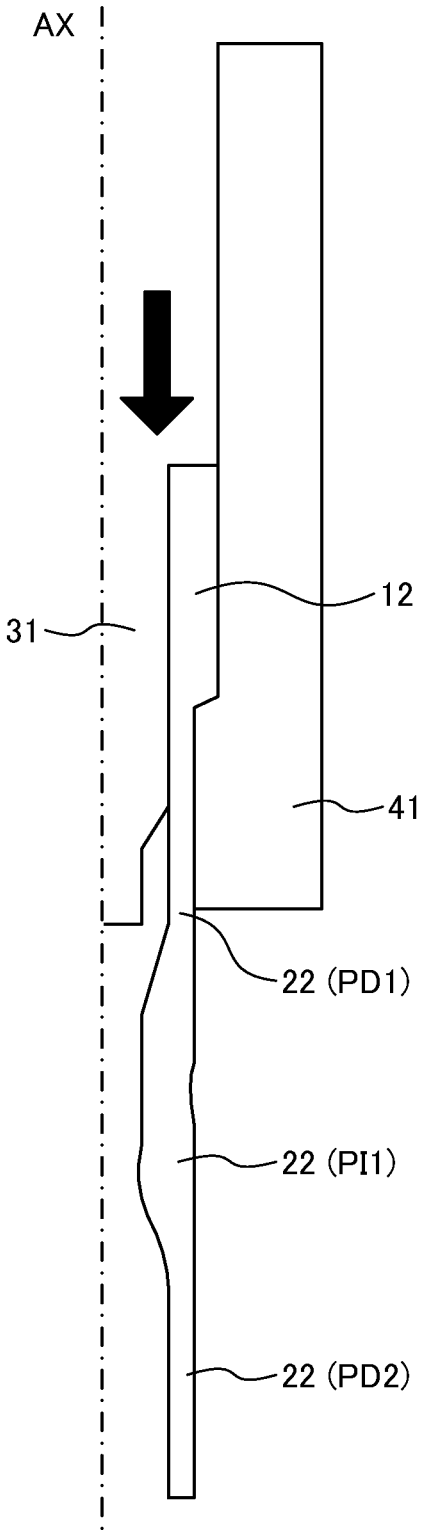
FIG. 21 is a schematic sectional view for showing an example of a position of the first core bar and a shape of the second raw pipe in a stage of extrusion processing in the first step performed in the third method.

Next, in FIG. 20, a state at a time point when the extrusion processing is further advanced and the end portion on the tip end side of the first large cross section portion PDOL1 of the first core bar 31 reaches the end portion on the base end side of the first small inner diameter portion PDIS1 of the first die hole 41*a* is shown. After this stage, the material constituting a part of the second raw pipe 12 pressed to the extrusion direction by the first pressing portion PP1 of the first core bar 31 passes through a gap between the end portion on the base end side of the first small inner diameter portion PDIS1 of the first die hole 41*a* and the first large cross section portion PDOL1 of the first core bar 31. As a result, as shown in FIG. 21, the first thin-walled portion PD1 of the differential thickness pipe 22 begins to be formed. Namely, in the differential thickness pipe 22 molded by the third method, the first thick-walled portion PI1 is formed at a predetermined position between both end portions, instead of the end portion in the axial direction.

<Effect>

As explained above, in the third method, the above-mentioned first step is performed by using the second raw pipe that is the first raw pipe further comprising the second thin-walled portion which is a portion having the fourth wall thickness and the second outer diameter in place of the first raw pipe which is a tubular member having the first wall thickness and the first outer diameter. Therefore, in accordance with the third method, it is possible to easily mold a differential thickness pipe having the first thick-walled portion formed at a predetermined position between both end portions instead of the end portion in the axial direction.

Fourth Embodiment

Hereafter, an extrusion molding method for a differential thickness pipe according to a fourth embodiment of the present invention (which may be referred to as a "fourth method" hereafter) will be explained, referring to drawings.

As mentioned above, in the third method, the above-mentioned first step is performed by using the second raw pipe that is the first raw pipe further comprising the second thin-walled portion which is a portion having the fourth wall thickness and the second outer diameter in place of the first raw pipe which is a tubular member having the first wall thickness and the first outer diameter. Therefore, in accordance with the third method, it is possible to easily mold a differential thickness pipe having the first thick-walled portion formed at a predetermined position between both end portions instead of the end portion in the axial direction.

By the way, the second raw pipe, which is the first raw pipe further comprising the second thin-walled portion at the end portion on the tip side as described above, can be easily molded from the first raw pipe, which is a tubular member having the first wall thickness and the first outer diameter, by extrusion processing.

<Configuration>

Therefore, the fourth method is the above-mentioned third method, which further includes a second step that is a step in which the second raw pipe further comprising the second thin-walled portion at the end portion on the tip side is molded from the first raw pipe that is a tubular member having the first wall thickness and the first outer diameter, by extrusion processing, before the above-mentioned first step.

A second extrusion molding apparatus used in the fourth method comprises a third core bar that is a core bar having a predetermined shape, a second die having a second die hole that is a through hole having a predetermined shape, and a second drive mechanism configured so as to press the third core bar into the second die hole. And, in the fourth method, the second step is performed before the first step.

The second step is a step in which the second thin-walled portion is molded at the end portion on the tip end side of the first raw pipe by pressing a pair of the first raw pipe and the third core bar into the second die hole with the second drive mechanism in a state where the third core bar is inserted at a predetermined position in the first raw pipe to perform extrusion processing. In accordance with the second step, for example, the second raw pipe 12 as shown in (a) of FIG. 15 can be easily formed from the first raw pipe 11 as shown in (a) of FIG. 1.

The third core bar is a core bar having a columnar shape with a third cross section that is a cross section corresponding to a cross section of an internal space of the second thin-walled portion. As described above, the second step is a step for molding the second thin-walled portion at the end portion on the tip end side of the first raw pipe. Therefore, the third core bar is inserted at a predetermined position in the first raw pipe so as to be able to define the cross section of the internal space of the second thin-walled portion for a time period during which the pair of the first raw pipe and the third core bar is pressed into the second die hole to be subjected to extrusion processing at least in the second step.

As mentioned above, the shape of the internal space of the second thin-walled portion is not particularly limited, and a wide variety of shapes such as a polygonal columnar shape, an elliptical columnar shape, and a cylindrical columnar shape can be adopted. However, in the following explanation, for the purpose of facilitating the understanding of the present invention, a case where the internal space of the second thin-walled portion has a cylindrical columnar shape like the internal space of the portion other than the second thin-walled portion will be explained.

Figure 22:
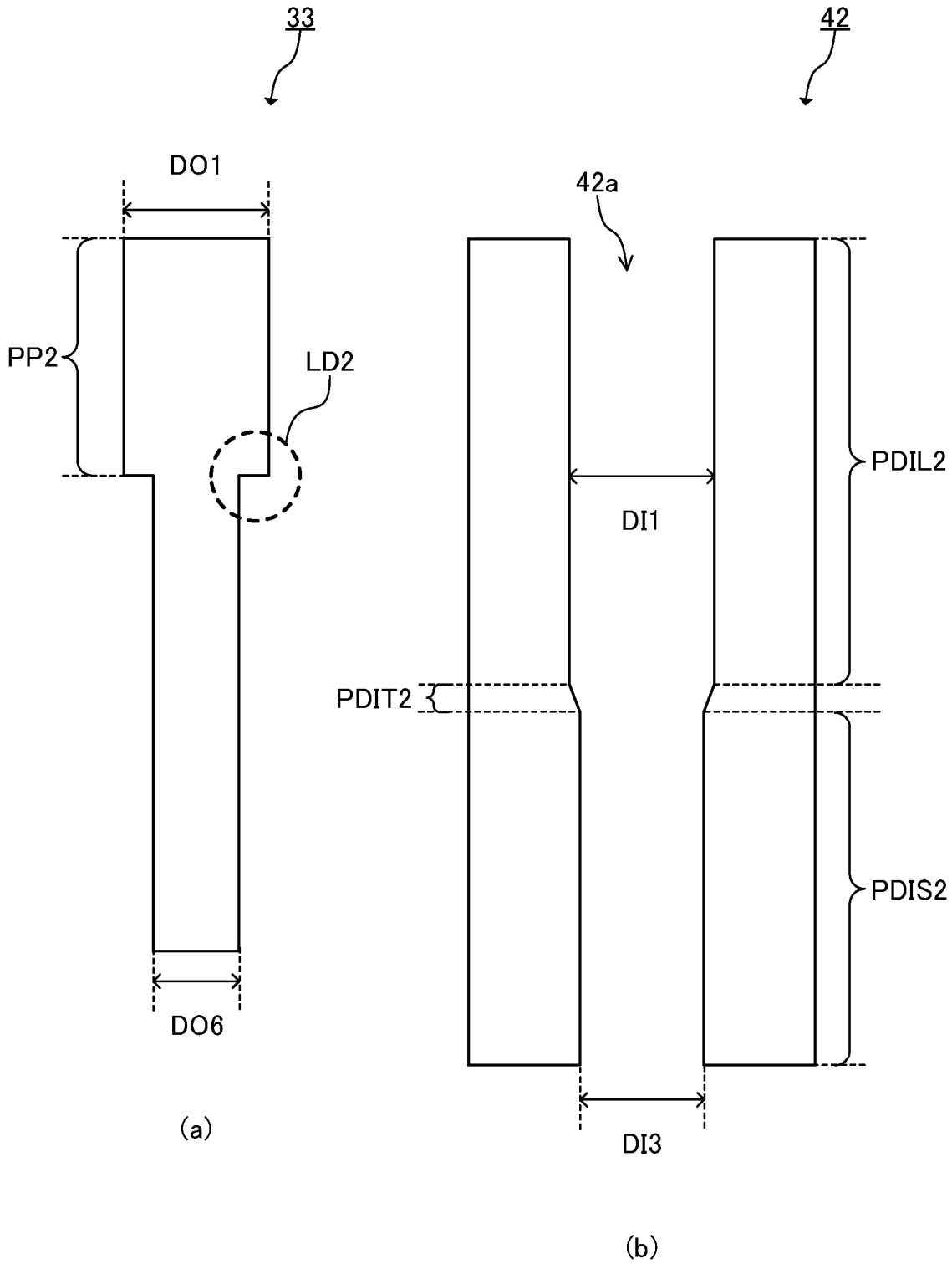
FIG. 22 is a schematic cross-sectional view for showing examples of configurations of a third core bar and a second die used in an extrusion molding method for a differential thickness pipe according to a fourth embodiment of the present invention (fourth method).

(a) of FIG. 22 is a schematic cross-sectional view for showing an example of a configuration of the third core bar used in the second step included in the fourth method. The third core bar 33 exemplified in (a) of FIG. 22 is a core bar having a cylindrical columnar shape with a sixth outer diameter DO6 that is an outer diameter corresponding to the inner diameter of the second thin-walled portion PD2 to be formed at the end portion on the tip end side of the first raw pipe 11. As mentioned above, the inner diameter of the second thin-walled portion may be equal to or different from the inner diameter of the portion other than the second thin-walled portion of the second raw pipe. Therefore, the sixth outer diameter DO6, which is the outer diameter of the third core bar 33, may be equal to or different from the fourth outer diameter DOS4, which is the outer diameter of the first large cross section portion PDOL1 of the first core bar 31.

The second pressing portion PP2 that is a cylindrical columnar portion having an outer diameter equal to the first outer diameter DO1 which is the outer diameter of the first raw pipe 11 is formed at the end portion on the base end side of the third core bar 33 shown in (a) of FIG. 22, and a level difference (portion LD2 surrounded by a broken line) is formed between the second pressing portion PP2 and the main body portion of the third core bar 33. By means of this level difference, a pair of the first raw pipe 11 and the third core bar 33 can be pressed into the second die hole 42*a* formed in the second die 42 while maintaining a state where the third core bar 33 is inserted at a predetermined position in the first raw pipe 11 to perform extrusion processing.

However, a mechanism for pressing the pair of the first raw pipe 11 and the third core bar 33 into the second die hole 42*a* while maintaining the state where the third core bar 33 is inserted at a predetermined position in the first raw pipe 11 in the second step is not limited to the above. For example, instead of integrally forming the second pressing portion PP2 as a part of the third core bar 33 as mentioned above, the second pressing portion PP2 may be formed as a member separate from the third core bar 33, and the first raw pipe 11 and the third core bar 33 may be pressed into the second die hole 42*a* while maintaining a predetermined positional relation by pressing the second pressing portion PP2 with the second drive mechanism. Alternatively, the first raw pipe 11 and the third core bar 33 may be pressed into the second die hole 42*a* by separate members, respectively.

Next, (b) of FIG. 22 is a schematic cross-sectional view for showing an example of a configuration of the second die 42 used in the second step included in the fourth method. As shown in (b) of FIG. 22, the second die hole 42*a* includes a second large inner diameter portion PDIL2, a second small inner diameter portion PDIS2 and a second inner diameter reducing portion PDIT2. The second large inner diameter portion PDIL2 is a portion formed on the base end side and having an inner diameter equal to the first inner diameter DI1 that is an inner diameter corresponding to the first outer diameter DO1 which is the outer diameter of the first raw pipe 11, similarly to the first large inner diameter portion PDIL1 of the first die hole 41*a*. The second small inner diameter portion PDIS2 is a portion formed on the tip end side and having a third inner diameter DI3 that is an inner diameter corresponding to the fifth outer diameter DO5 which is the outer diameter of the second thin-walled portion PD2 of the second raw pipe 12. The second inner diameter reducing portion PDIT2 is a portion formed between the second large inner diameter portion PDIL2 and the second small inner diameter portion PDIS2 and having an inner diameter decreasing from the first inner diameter DI1 to the third inner diameter DI3 as approaching from the second large inner diameter portion PDIL2 to the second small inner diameter portion PDIS2.

Figure 23:
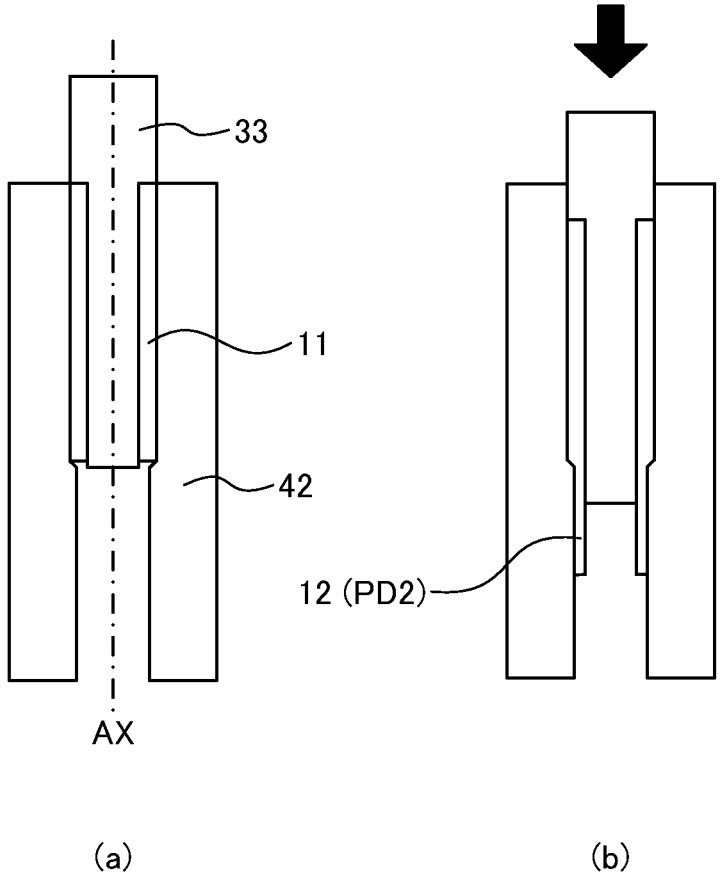
FIG. 23 is a schematic cross-sectional view for showing an example of a transition of a shape of the first raw pipe accompanying execution of extrusion processing in the second step performed in the fourth method.

The second step is performed in the second extrusion molding apparatus having the configuration as mentioned above. FIG. 23 is a schematic cross-sectional view for showing an example of a transition of a shape of the first raw pipe 11 accompanying execution of extrusion processing in the second step. In FIG. 23, in order to simplify the drawing, only a part of the reference signs attached to the respective parts shown in FIG. 22 is indicated. However, since the reference signs shown in FIG. 22 will be used for the sake of accuracy in the following explanation with respect to FIG. 23, please refer to FIG. 22 as necessary.

As shown in (a) of FIG. 23, the first raw pipe 11 is inserted into the second large inner diameter portion PDIL2 of the second die hole 42*a* formed in the second die 42, and the third core bar 33 is inserted into the first raw pipe 11. At this time, as mentioned above, the second level difference LD2 formed between the second pressing portion PP2 and the main body portion of the third core bar 33 contacts with the end portion on the base end side of the first raw pipe 11. As a result, a positional relation between the first raw pipe 11 and the third core bar 33 is fixed. Namely, a state where the third core bar 33 is inserted at a predetermined position in the first raw pipe 11 is achieved.

As mentioned above, in the second step, the second raw pipe 12 further comprising the second thin-walled portion PD2 in the end portion on the tip end side is formed from the first raw pipe 11 that is a tubular member having the first wall thickness T1 and the first outer diameter PO1, by pressing the pair of the first raw pipe 11 and the third core bar 33 into the second die hole 42*a* to perform the extrusion processing in a state where the third core bar 33 is inserted at a predetermined position in the first raw pipe 11. In this period during which the second thin-walled portion PD2 is formed, it is necessary to execute the extrusion processing through the gap corresponding to the fourth wall-thickness T4, which is the wall thickness of the second thin-walled portion PD2.

Therefore, when the extrusion processing is started in the second step, the end portion on the tip end side of the third core bar 33 is located at the same position as the end portion on the base end side of the small inner diameter portion PDIS2 or at a position closer to the tip end than the end portion on the base end side of the second small inner diameter portion PDIS2, in the extrusion direction. The length in the extrusion direction of the second thin-walled portion PD2 varies depending on the amount of the material passing through the gap corresponding to the fourth wall-thickness T4, which is the wall thickness of the second thin-walled portion PD2, in the extrusion processing in the second step and the area of the gap.

Next, as shown in (b) of FIG. 23, the second raw pipe 12 further comprising the second thin-walled portion PD2 at the end portion on the tip side is molded by pressing the third core bar 33 to the extrusion direction (downward in the drawing) with a not-shown second drive mechanism (refer to a black arrow in the drawing) to press the pair of the first raw pipe 11 and the third core bar 33 into the second die hole 42*a* to perform extrusion processing. In (b) of FIG. 23, although an end surface on the tip end side of the second thin-walled portion PD2 is illustrated as a flat surface, the end surface does not necessarily become flat. Therefore, in applications where the end surface is required to be flat, it is desirable to perform secondary processing of the end surface by cutting or the like, for example, after the extrusion processing. Alternatively, the end surface on the tip end side of the second thin-walled portion PD2 may be formed as a plane corresponding to the end surface on the base end side of a core bar like the second core bar 32 used in the first step included in the second method by inserting the core bar into the second small inner diameter portion PDIS2 of the second die hole 42*a* from the tip side and energizing the core bar toward the base end side to bring the end portion on the base end side of the core bar into contact with the end portion on the tip end side of the third core bar 33 at least when the extrusion processing is started in the second step.

Next, the above-mentioned first step is performed by using the second raw pipe 12 further comprising the second thin-walled portion PD2 molded as mentioned above at the end portion on the tip side instead of the first raw pipe 11. Since the first step performed in the fourth method is the same as the first step performed in the above-mentioned third method, the explanation thereof will not be repeated here.

<Effect>

As explained above, in accordance with the second step performed before the first step in the fourth method, the second raw pipe that is a first raw pipe further comprising the second thin-walled portion which is a portion having the fourth wall thickness and the second outer diameter at the end portion on the tip side can be easily molded from the first raw pipe that is a tubular member having the first wall thickness and the first outer diameter. Next, the above-mentioned first step is performed using the second raw pipe molded by the second step. Therefore, in accordance with the fourth method, it is possible to easily form a differential thickness pipe having the first thick-walled portion is formed at a predetermined position between both end portions instead of the end portion in the axial direction.

<Supplement>

In the above explanation regarding the fourth method, a case where the first extrusion molding apparatus used in the first step and the second extrusion molding apparatus used in the second step are separate extrusion molding apparatuses was explained. However, both the first step and the second step may be performed using one extrusion molding apparatus by configuring the core bars and/or the dies to be replaceable depending on steps to be performed, such as standardization of configuration of a portion for mounting the first core bar and the third core bar and/or standardization of configuration of a portion for mounting the first die and the second die, for example.

Specifically, for example, when the fifth outer diameter DO5 that is the outer diameter of the second thin-walled portion PD2 is equal to the second outer diameter DO2 that is the outer diameter of the first thick-walled portion PI1 and the first thin-walled portion PD1 of the differential thickness pipe, the first die 41 can be used as the second die 42 in the second step. In this case, when switching from the second step to the first step, the second extrusion molding apparatus can be changed to the first extrusion molding apparatus only by replacing the third core bar 33 used in the second step with the first core bar 31 to be used in the first step.

Fifth Embodiment

Hereafter, an extrusion molding method for a differential thickness pipe according to a fifth embodiment of the present invention (which may be referred to as a "fifth method" hereafter) will be explained, referring to drawings.

For example, as shown in FIG. 18 to FIG. 21, the outer peripheral surface in the vicinity of the boundary between the second thin-walled portion PD2 and the first thick-walled portion PI1 of the differential thickness pipe 22 to be molded by the third method and the fourth method may be peeled off from the inner peripheral surface of the first small inner diameter portion PDIS1 of the first die hole 41*a* to generate a slight depression in this part. As mentioned above, in applications where such a depression causes a quality problem, it is desirable to perform secondary processing of this part by cutting or the like, for example, after the extrusion processing. However, when the secondary processing is performed after the extrusion processing like this, it may lead to a problem such as an increase in the manufacturing cost of a differential thickness pipe, for example.

<Configuration>

Therefore, the fifth method is the above-mentioned third method or fourth method, wherein the first extrusion molding apparatus further comprises a fourth core bar having a columnar shape with a fourth cross section that is a cross section corresponding to a cross section of the internal space of the second thin-walled portion. And, the first step is performed in a state where the fourth core bar is inserted into the second thin-walled portion of the second raw pipe from the tip end side and is energized toward the base end side. Furthermore, at least when the extrusion processing is started in the first step, an end portion on the base end side of the fourth core bar is in contact with an end portion on the tip end side of the first core bar.

Figure 24:
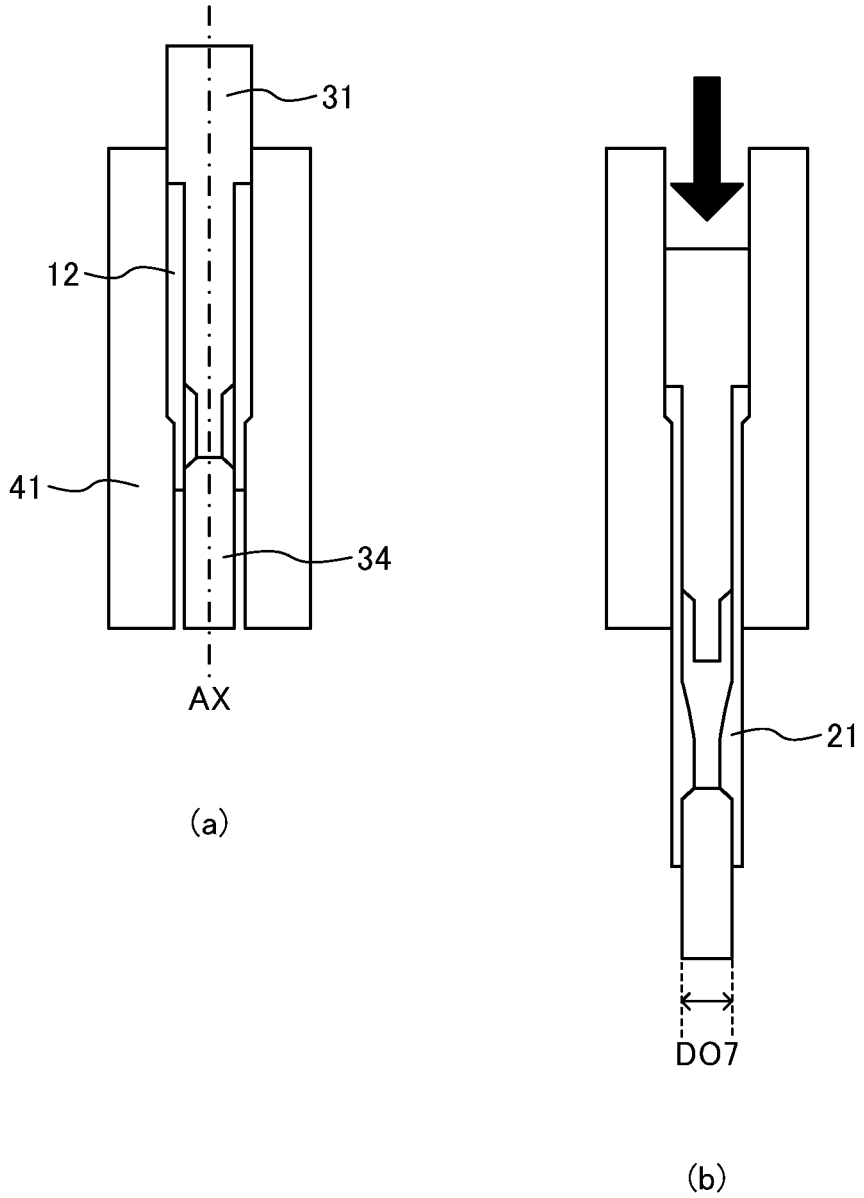
FIG. 24 is a schematic cross-sectional view for showing an example of a transition of a shape of the second raw pipe accompanying execution of extrusion processing in the first step performed in an extrusion molding method for a differential thickness pipe according to a fifth embodiment of the present invention (fifth method).

FIG. 24 is a schematic cross-sectional view for showing an example of a transition of a shape of the second raw pipe 12 accompanying execution of extrusion processing in the first step performed in the fifth method. In addition, in FIG. 24, in order to simplify the drawing, only a part of the reference signs attached to the respective parts shown in FIG. 2 and FIG. 15 is indicated. However, since the reference signs shown in FIG. 2 and FIG. 15 will be used for the sake of accuracy in the following explanations with respect to FIG. 24, please refer to FIG. 2 and FIG. 15 as necessary.

(a) of FIG. 24 is the same as (3) of FIG. 16, except that the fourth core bar 34 having a columnar shape with a fourth cross section that is a cross section corresponding to the cross section of the internal space of the second thin-walled portion PD2 is inserted into the second thin-walled portion PD2 of the second raw pipe 12 inserted into the small inner diameter portion PDIS1 of the first die hole 41*a* from the tip side and is energized toward the base end side, and the end portion on the base end side of the fourth core bar 34 is in contact with the end portion on the tip end side of the first core bar 31.

Next, as shown in (b) of FIG. 24, by pressing the first core bar 31 to the extrusion direction (downward in the drawing) with a not-shown first drive mechanism (refer to a black arrow in the drawing) to press the pair of the second raw pipe 12 and the first core bar 31 into the first die hole 41*a* to perform extrusion processing, the differential thickness pipe 21 having a desired first thick-walled portion PI1 is molded. However, in the fifth method, as mentioned above, the fourth core bar 34 is inserted into the second thin-walled portion PD2 of the second raw pipe 12 from the tip side. As a result, the space where the first thick-walled portion PI1 is formed is closed, and this closed space is filled with the material for forming the first thick-walled portion PI1 and thereby the part on the tip end side of the first thick-walled portion PI1 is formed. Therefore, it is possible to reduce the possibility that the outer peripheral surface in the vicinity of the boundary between the second thin-walled portion PD2 and the first thick-walled portion PI1 of the differential thickness pipe 22 may be peeled off from the inner peripheral surface of the first small inner diameter portion PDIS1 of the first die hole 41*a*.

Although the peripheral part of the end surface on the base end side of the fourth core bar 34 exemplified in FIG. 24 is chamfered, the shape of the end surface on the base end side of the fourth core bar 34 is not limited to such a shape and can be a shape corresponding to the shape required for the tip end side of the first thick-walled portion PI1 formed in the differential thickness pipe 22.

<Details of First Step>

Here, the transition of the shape of the second raw pipe accompanying progress of the extrusion processing in the first step performed in the fifth method will be explained in more detail, referring to further drawings. However, as mentioned above, the shape of the internal space of the second thin-walled portion is not particularly limited, and a wide variety of shapes such as polygonal columnar, an elliptical columnar, and a cylindrical columnar, for example, can be adopted. Therefore, the fourth core bar may also have a columnar shape having a fourth cross section that is a cross section having various shapes corresponding to the cross section of the internal space of the second thin-walled portion. However, in the following explanation, for the purpose of facilitating the understanding of the present invention, a case where the internal space of the second thin-walled portion has a cylindrical columnar shape similarly to the internal space of the portion other than the second thin-walled portion will be explained.

FIG. 25 to FIG. 29 are schematic cross-sectional views for showing an example of positions of the first core bar and the fourth core bar and the shapes of the second raw pipe in respective stages of the extrusion processing performed in the first step. The first extrusion molding apparatus shown in FIG. 25 to FIG. 29 has the same configuration as the first extrusion molding apparatus shown in FIG. 17 to FIG. 21 except that the first extrusion molding apparatus further includes the fourth core bar 34 having a cylindrical columnar shape with an outer diameter that is an outer diameter corresponding to the inner diameter of the second thin-walled portion PD2, and the fourth core bar 34 is inserted into the second thin-walled portion PD2 of the second raw pipe 12 from the tip end side and is energized toward the base end side. Moreover, each of the stages of the extrusion processing shown in FIG. 25 to FIG. 29 corresponds to each of the stages of the extrusion processing shown in FIG. 17 to FIG. 21, respectively.

Furthermore, also in FIG. 25 to FIG. 29, similarly to FIG. 17 to FIG. 21, although only a part on the right side from a common axis AX of the first core bar, the fourth core bar, the second raw pipe and the first die hole (refer to (a) of FIG. 24) is illustrated, the same applies to a part on the left side from the axis AX. In addition, also in FIG. 25 to FIG. 29, in order to simplify the drawing, only a part of the reference signs attached to the respective parts shown in FIG. 2 and FIG. 15 is indicated. However, since the reference signs shown in FIG. 2 and FIG. 15 will be used for the sake of accuracy in the following explanations with respect to these drawings, please refer to FIG. 2 and FIG. 15 as necessary.

Figure 25:
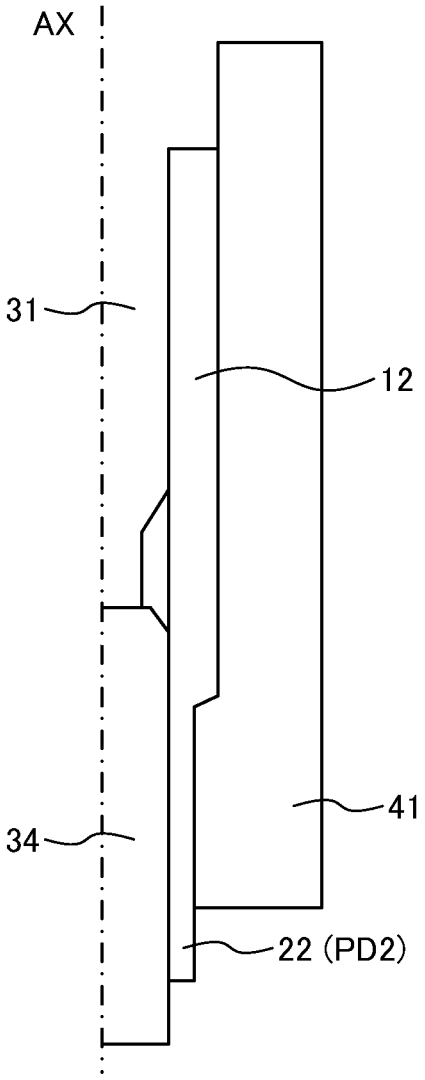
FIG. 25 is a schematic sectional view for showing an example of positions of the first core bar and a fourth core bar and a shape of the second raw pipe in a stage of extrusion processing in the first step performed in the fifth method.

In FIG. 25, similarly to FIG. 17, a state where the second raw pipe 12 is inserted into the first large inner diameter portion PDIL1 of the first die hole 41*a* and further the first core bar 31 is inserted at a predetermined position in the second raw pipe 12 is shown. In addition, in FIG. 25, the fourth core bar 34 is inserted into the second thin-walled portion PD2 of the second raw pipe 12 inserted into the first small inner diameter portion PDIS1 of the first die hole 41*a* from the tip end side and is energized toward the base end side, and the end portion on the base end side of the fourth core bar 34 is in contact with the end portion on the tip end side of the first core bar 31. Namely, FIG. 25 is a view for showing a state when the extrusion processing is started in the first step.

Figure 26:
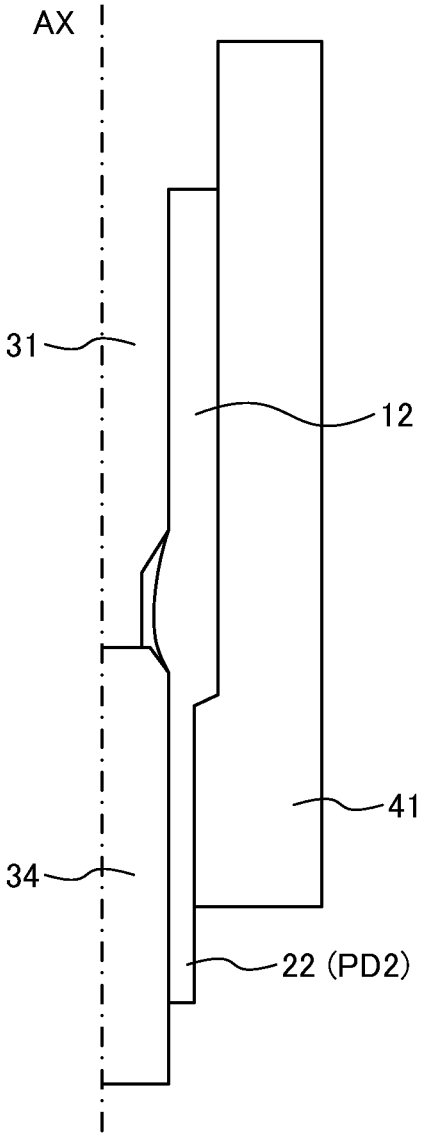
FIG. 26 is a schematic sectional view for showing an example of positions of the first core bar and the fourth core bar and a shape of the second raw pipe in a stage of extrusion processing in the first step performed in the fifth method.

Next, in FIG. 26, similarly to FIG. 18, a state immediately after the first core bar 31 starts to be pressed to the downstream side (tip end side) in the extrusion direction together with the second raw pipe 12 by a first drive mechanism (not shown). By being pressed to the extrusion direction by the first pressing portion PP1 of the first core bar 31 and diameter reduction by the first inner diameter reducing portion PDIT1 of the first die hole 41*a*, the plastic flow of the material constituting the second raw pipe 12 toward the first small cross section PDOS1 of the first core bar 31 has been caused. However, the material has not yet reached the fourth core bar 34.

At this stage, in the example shown in FIG. 18, the outer peripheral surface in the vicinity of the boundary between the second thin-walled portion PD2 and the first thick-walled portion PI1 of the formed differential thickness pipe 22 to be molded is peeled off from the inner peripheral surface of the first small inner diameter portion PDIS1 of the first die hole 41*a* to generate a slight depression in the part (refer to the parts surrounded by a broken line). However, in the fifth method exemplified in FIG. 26, since the fourth core bar 34 is inserted into the second thin-walled portion PD2 of the second raw pipe 12 from the tip side, the material for forming the first thick-walled portion PI1 fills the closed space and thereby the part on the tip end side of the first thick-walled portion PI1 is formed as mentioned above. As a result, the possibility that the above-mentioned outer peripheral surface of the differential thickness pipe 22 may be peeled off from the inner peripheral surface of the first small inner diameter portion PDIS1 to generate a slight depression in this part can be reduced.

Figure 27:
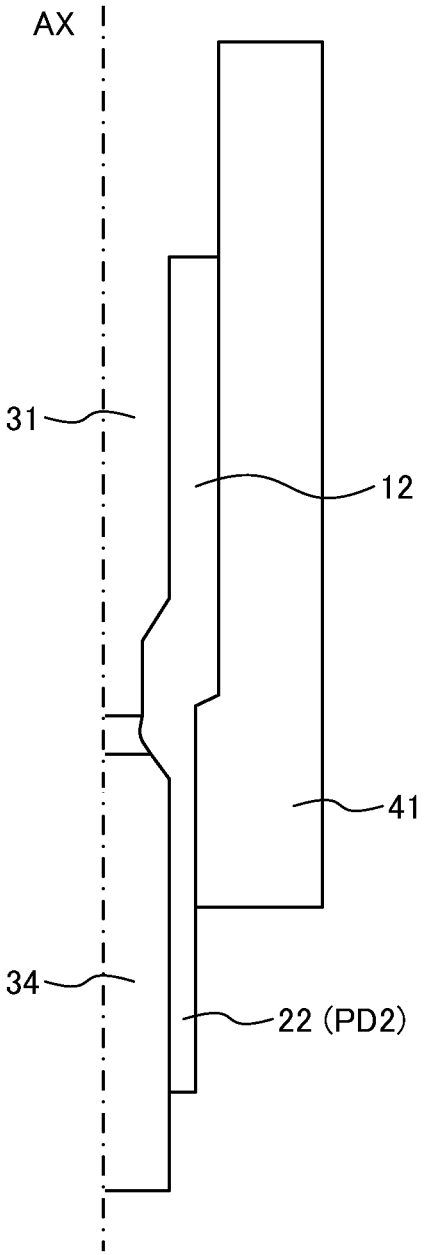
FIG. 27 is a schematic sectional view for showing an example of positions of the first core bar and the fourth core bar and a shape of the second raw pipe in a stage of extrusion processing in the first step performed in the fifth method.

In FIG. 27, similarly to FIG. 19, a state where the extrusion processing is further advanced, the space defined by the first cross section increasing portion PDOT1 and first small cross section PDOS1 of the first core bar 31 and the first die 41 has been filled with the material constituting the second raw pipe 12, and a part of the first thick-walled portion PI1 of the differential thickness pipe 22 is being extruded through a gap between the end portion on the tip end side of the first core bar 31 and the first small inner diameter portion PDIS1 of the first die hole 41*a* is shown. The fourth core bar 34 is pressed to the tip end side by the end portion on the tip side of the first thick-walled portion PI1 extruded further to the tip end side than the end portion on the tip end side of the first core bar 31 like this, the fourth core bar 34 is separated from the first core bar 31, and a gap is created between these two core bars. As a result, as shown in FIG. 27, at the end portion on the tip end side of the first thick-walled portion PI1, a part of the material may go around to the tip end side of the first small cross section portion PDOS1 and a part having a wall thickness thicker than the third wall thickness T3 may be formed. In some applications of the differential thickness pipe 22, it may be desirable to perform secondary processing of such an unintended thick-walled portion by cutting or the like, for example, after the extrusion processing.

Figure 28:
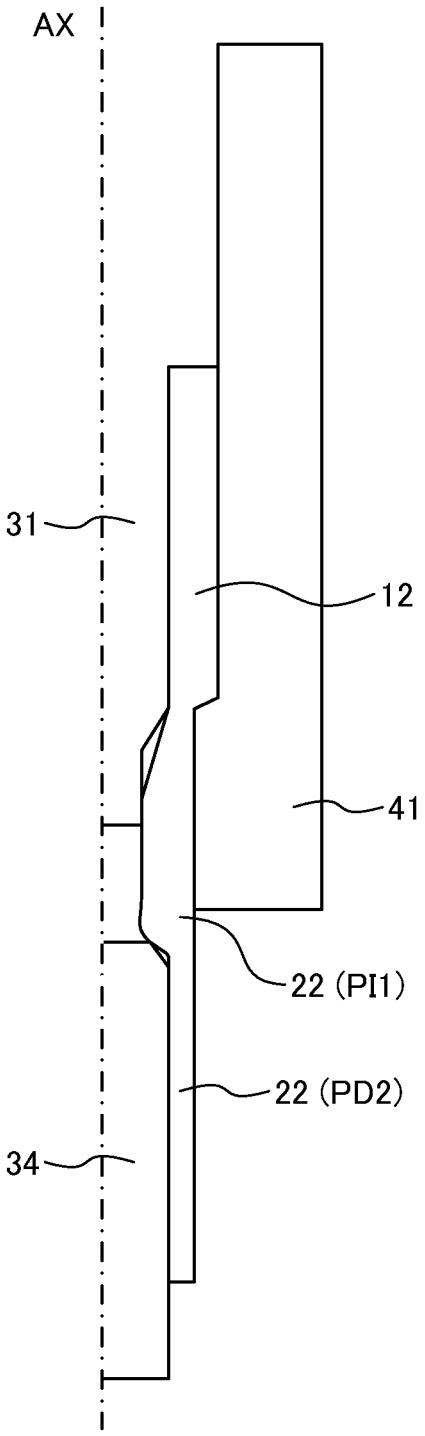
FIG. 28 is a schematic sectional view for showing an example of positions of the first core bar and the fourth core bar and a shape of the second raw pipe in a stage of extrusion processing in the first step performed in the fifth method.
Figure 29:
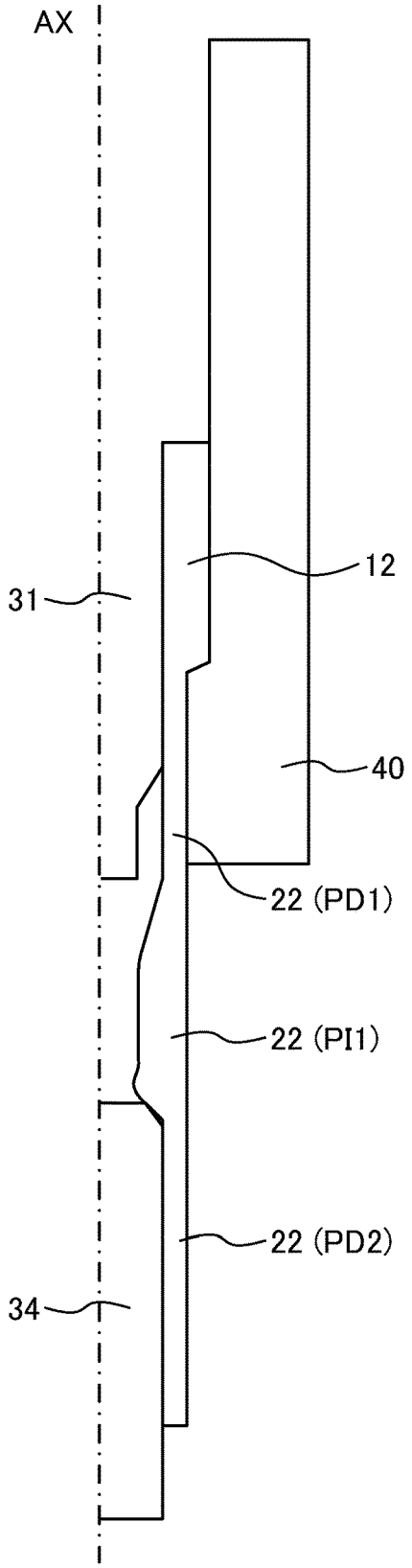
FIG. 29 is a schematic sectional view for showing an example of positions of the first core bar and the fourth core bar and a shape of the second raw pipe in a stage of extrusion processing in the first step performed in the fifth method.

Next, in FIG. 28, a state at a time point when the extrusion processing is further advanced and the end portion on the tip end side of the first large cross section portion PDOL1 of the first core bar 31 reaches the end portion on the base end side of the first small inner diameter portion PDIS1 of the first die hole 41*a* is shown. After this stage, the material constituting a part of the second raw pipe 12 pressed to the extrusion direction by the first pressing portion PP1 of the first core bar 31 passes through a gap between the end portion on the base end side of the first small inner diameter portion PDIS1 of the first die hole 41*a* and the first large cross section portion PDOL1 of the first core bar 31. As a result, as shown in FIG. 29, the first thin-walled portion PD1 of the differential thickness pipe 22 begins to be formed. Thus, also in the differential thickness pipe 22 molded by the fifth method, the first thick-walled portion PI1 is formed at a predetermined position between both end portions, instead of the end portion in the axial direction.

<Effect>

As explained above, in the fifth method, since the fourth core bar 34 is inserted into the second thin-walled portion PD2 of the second raw pipe 12 from the tip side, it is possible to reduce the peeling of the above-mentioned outer peripheral surface of the differential thickness pipe 22 from the inner peripheral surface of the first small inner diameter portion PDIS1 to reduce the occurrence of the depression in the part. Namely, in accordance with the fifth method, it is possible to easily and with high dimensional accuracy form a differential thickness pipe having a first thick-walled portion formed at a predetermined position between both ends instead of the end portion in the axial direction.

Sixth Embodiment

Hereafter, an extrusion molding method for a differential thickness pipe according to a sixth embodiment of the present invention (which may be referred to as a "sixth method" hereafter) will be explained, referring to drawings.

As explained above, in accordance with the first to fifth methods, the first thick-walled portion can be formed at the end portion on the tip side or an intermediate position (between the first thin-walled portion and the second thin-walled portion) in its axial direction of the differential thickness pipe. However, in some applications, it may be necessary to form a portion having an outer diameter larger than the other part and a wall thickness thicker than the first thin-walled portion at the end portion on the base end side of the differential thickness pipe.

<Configuration>

Therefore, the sixth method is any one of the above-mentioned first to fifth methods, wherein, in the first step, a second thick-walled portion that is a portion having the first wall thickness and the first outer diameter is formed at an end portion on the base end side of the differential thickness pipe by not performing the extrusion processing on a predetermined region at the end portion on the base end side of the first raw pipe to leave the region as it is.

The length of the second thick-walled portion in the axial direction of the differential thickness pipe is determined by the length of the end portion on the base end side of the first raw pipe left without extrusion processing in the first step. Since such a second thick-walled portion is formed by leaving the predetermined region at the end portion on the base end side of the first raw pipe in the first step without being subjected to extrusion processing, the wall thickness and outer diameter of the second thick-walled portion is formed are naturally the first wall thickness and the first outer diameter. Namely, the second thick-walled portion is a portion having a flange-like shape which protrudes outward in the radial direction.

Figure 30:
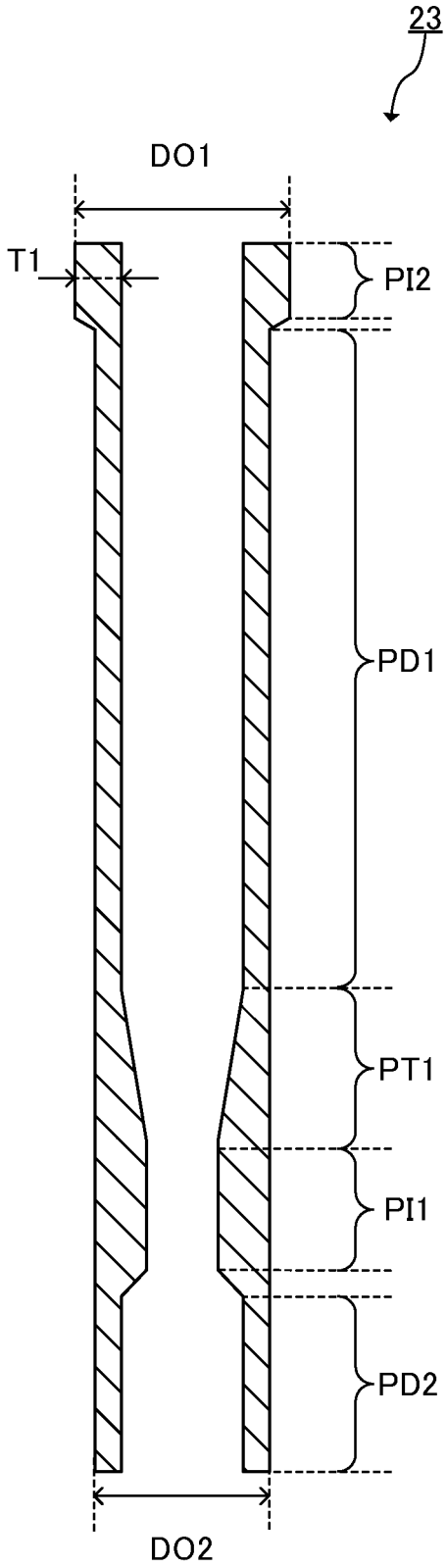
FIG. 30 is a schematic sectional view for showing an example of a configuration of a differential thickness pipe molded by an extrusion molding method for a differential thickness pipe according to a sixth embodiment of the present invention (sixth method).

FIG. 30 is a schematic sectional view for showing an example of a configuration of a differential thickness pipe molded by the sixth method. The differential thickness pipe 23 shown in FIG. 30 has the same configuration as the differential thickness pipe 22 shown in (b) of FIG. 15 except that the second thick-walled portion PI2 that is a portion having the first wall thickness T1 and the first outer diameter DO1 is formed at the end portion on the base end side.

<Effect>

As the above, in accordance with the sixth method, in the first step, the second thick-walled portion that is a portion having the first wall thickness and the first outer diameter can be easily formed at the end portion on the base end side of the differential thickness pipe by not performing the extrusion processing on a predetermined region at the end portion on the base end side of the first raw pipe to leave the region as it is. Therefore, a differential thickness pipe suitable for an application where a portion having an outer diameter larger than that of other portions of the differential thickness pipe, such as a flange, for example, is required can be manufactured with high production efficiency and at a low cost.

Seventh Embodiment

Hereafter, an extrusion molding method for a differential thickness pipe according to a seventh embodiment of the present invention (which may be referred to as a "seventh method" hereafter) will be explained, referring to drawings.

As mentioned above, in accordance with the sixth method, in the first step, the second thick-walled portion that is a portion having the first wall thickness and the first outer diameter can be easily formed at the end portion on the base end side of the differential thickness pipe by not performing the extrusion processing on a predetermined region at the end portion on the base end side of the first raw pipe to leave the region as it is.

Moreover, in the first step, the end portion on the tip end side of the first pressing portion formed on the end portion on the base end side of the first core bar can reach no further than the end portion on the tip end side of the first large inner diameter portion of the first die hole (namely, the end portion on the base end side of the first inner diameter reducing portion). As a result, at least at a part of the differential thickness pipe between the first large cross section portion of the first core bar and the first inner diameter decreasing portion of the first die hole (namely, the vicinity of the end portion on the base end side of the differential thickness pipe), a portion having an outer diameter larger than that of other portions and a wall thickness thicker than that of the first thin-walled portion Is formed.

However, in some applications, the first thin-walled portion extending to the end portion on the base end side of the differential thickness pipe is required, instead of the second thick-walled portion formed at the end portion on the end side of the differential thickness pipe. In such an application, the portion formed in the vicinity of the end portion on the base end side of the differential thickness pipe and having an outer diameter larger than that of other portions and a wall thickness thicker than that of the first thin-walled portion can be removed by secondary processing such as cutting, for example. However, when the secondary processing is performed after the extrusion processing like this, it may lead to a problem such as an increase in the manufacturing cost of the differential thickness pipe.

<Configuration>

Therefore, the seventh method is any one of the above-mentioned first to fifth methods, wherein the first core bar further comprises a first pressing portion that is a cylindrical columnar portion formed closer to the base end than the first large cross section portion and having an outer diameter equal to the first outer diameter that is the outer diameter of the first raw pipe. The first pressing portion is constituted by a core portion and an outer peripheral portion. The core portion is a cylindrical columnar portion having an outer diameter equal to the second outer diameter that is the outer diameter of the first thin-walled portion of the differential thickness pipe. The outer peripheral portion is a cylindrical tubular portion slidably disposed outside in a radial direction of the core portion and having an outer diameter equal to the first outer diameter that is the outer diameter of the first raw pipe and an inner diameter corresponding to the second outer diameter that is the outer diameter of the first thin-walled portion of the differential thickness pipe.

Furthermore, in the first step, a second thick-walled portion that is a portion having the first wall thickness and the first outer diameter is formed at an end portion on the base end side of the first raw pipe by not performing the extrusion processing on a predetermined region at the end portion on the base end side of the first raw pipe. In addition, the seventh method further includes a third step that is a step in which a portion outside the second outer diameter of the second thick-walled portion is cut off after the first step. In the third step, the outer peripheral portion of the first pressing portion is not pressed, but the core portion of the first pressing portion is pressed in the extrusion direction until a state where an end portion on the tip end side of the core portion of the first pressing portion is located closer to the tip end than an end portion on the base end side of the first small inner diameter portion of the first die hole is attained. Thereby, the portion outside the second outer diameter of the second thick-walled portion is cut off, and a differential thickness pipe with the first thin-walled portion extending to the end portion on the base end side can be easily molded.

Figure 31:
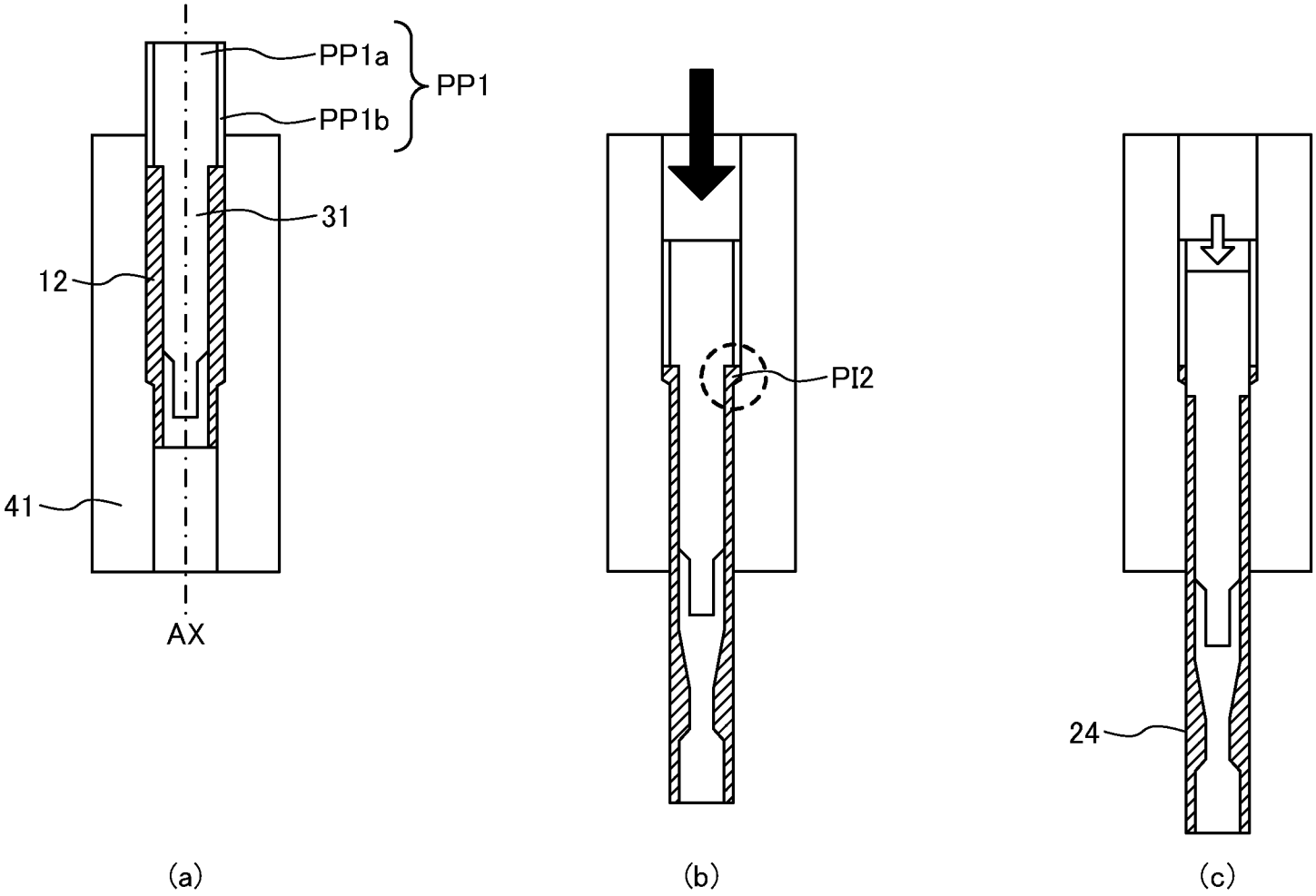
FIG. 31 is a schematic cross-sectional view for showing an example of a transition of a shape of the second raw pipe in the first step and the third step performed in an extrusion molding method for a differential thickness pipe according to a seventh embodiment of the present invention (seventh method).

FIG. 31 is a schematic cross-sectional view for showing an example of a transition of a shape of the second raw pipe 12 in the first step and the third step performed in the seventh method. In addition, in FIG. 31, in order to simplify the drawing, only a part of the reference signs attached to the respective parts shown in FIG. 2 and FIG. 15 is indicated. However, since the reference signs shown in FIG. 2 and FIG. 15 will be used for the sake of accuracy in the following explanations with respect to FIG. 31, please refer to FIG. 2 and FIG. 15 as necessary. Moreover, although a second raw pipe that is a first raw pipe having a second thin-walled portion at the end portion on the tip side is used in the example shown in FIG. 31, the same is true when a first raw pipe which does not comprise the second thin-walled portion at the end portion on the tip side is used.

As shown in (a) of FIG. 31, the first core bar 31 comprises the first pressing portion PP1 that is a cylindrical columnar portion formed closer to the base end than the first large cross section portion PDOL1 and having an outer diameter equal to the first outer diameter DO1 that is the outer diameter of the second raw pipe 12. The first pressing portion PP1 is constituted by the core portion PP1*a* and the outer peripheral portion PP1*b*. The second raw pipe 12 is inserted into the first large inner diameter portion PDIL1 of the first die hole 41*a* formed in the first die 41, and the first core bar 31 is inserted into the second raw pipe 12. At this time, as mentioned above, the first level difference LD1 formed between the first pressing portion PP1 and the first large cross section portion PDOL1 of the first core bar 31 contacts with the end portion on the base end side of the second raw pipe 12. As a result, a positional relation between the second raw pipe 12 and the first core bar 31 is fixed. Namely, a state where the first core bar 31 is inserted at a predetermined position in the second raw pipe 12 is achieved.

Also in the seventh method, similarly to the above-mentioned first method and the third method, the first thick-walled portion PI1 is molded by pressing the pair of the second raw pipe 12 and the first core bar 31 into the first die hole 41*a* by the first drive mechanism to performing the extrusion processing in the state where the first core bar 31 is inserted at a predetermined position in the second raw pipe 12 in the first step. Specifically, as shown in (b) of FIG. 31, (the first pressing portion PP1 of) the first core bar 31 is pressed to the extrusion direction (downward in the drawing) with a not-shown first drive mechanism (refer to a black arrow in the drawing) to press the pair of the second raw pipe 12 and the first core bar 31 into the first die hole 41*a* to perform extrusion processing. At this time, the core portion PP1*a* and the outer peripheral portion PP1*b* constituting the first pressing portion PP1 are pressed to the extrusion direction while maintaining the positional relation with each other. Thereby, the differential thickness pipe 22 having the desired first thick-walled portion PI1 is molded.

However, in the first step performed in the seventh method, the second thick-walled portion PI2 that is a portion having the first wall thickness T1 and the first outer diameter DO1 are formed at the end portion on the base end side of the second raw pipe 12 by not performing extrusion processing on a predetermined region at the end portion on the base end side of the second raw pipe 12 (refer to the portion surrounded by a broken line).

Next, in the third step performed in the seventh method, the outer peripheral portion PP1*b* of the first pressing portion PP1 is not pressed, but the end portion on the tip end side of the core portion PP1*a* of the first pressing portion PP1 is pressed in the extrusion direction until a state where the end portion on the tip end side of the core portion PP1*a* of the first pressing portion PP1 is located closer to the tip end than the end portion on the base end side of the first small inner diameter portion PDIS1 of the first die hole 41*a* is attained (refer to an outlined arrow in the drawing). Thereby, the portion outside the second outer diameter DO2 of the second thick-walled portion PI2 is cut off, and the differential thickness pipe 24 with the first thin-walled portion PD1 extending to the end portion on the base end side is molded.

<Effect>

As the above, in the seventh method, the second thick-walled portion left at the end portion on the base end side of the raw pipe in the first step can be easily cut off without rearranging the core bar and the die in a single extrusion molding apparatus. Namely, in accordance with the seventh method, it is possible to easily mold a differential thickness pipe having the first thin-walled portion extending to the end portion on the base end side.

Eighth Embodiment

Hereafter, an extrusion molding method for a differential thickness pipe according to an eighth embodiment of the present invention (which may be referred to as an "eighth method" hereafter) will be explained, referring to drawings.

As mentioned above, in accordance with the sixth method, in the first step, the second thick-walled portion that is a portion having the first wall thickness and the first outer diameter can be easily formed at the end portion on the base end side of the differential thickness pipe by not performing the extrusion processing on a predetermined region at the end portion on the base end side of the first raw pipe to leave the region as it is. However, in some applications, it may be necessary to form a portion having an outer diameter larger than those of other portions and a wall thickness larger than that of the first thin-walled portion at an intermediate position in the axial direction of the differential thickness pipe.

<Configuration>

Therefore, the eighth method is any one of the above-mentioned first to fifth methods, wherein the first step is performed using a third raw pipe that is a first raw pipe further comprising a third thin-walled portion at an end portion on the base end side. The third thin-walled portion is a portion having a fifth wall thickness that is a predetermined wall thickness smaller than the first wall thickness, which is the wall thickness of the first raw pipe, and an eighth outer diameter that is a predetermined outer diameter smaller than the first outer diameter, which is the outer diameter of the first raw pipe, and having a cross section identical to or larger than a cross section of the internal space of the first thin-walled portion of the differential thickness pipe.

Moreover, the first core bar used in the eighth method further comprises a first pressing portion that is a cylindrical columnar portion formed closer to the base end than the first large cross section portion and having an outer diameter equal to the first outer diameter. The first pressing portion comprises a reception portion that is a space open to an end surface on the tip end side of the first pressing portion and having a shape corresponding to the third thin-walled portion.

Furthermore, in the first step, the extrusion processing is performed in a state where the third thin-walled portion is accommodated in the reception portion. However, the extrusion processing is terminated before an end portion on the tip end side of the first pressing portion reaches an end portion on the tip end side of the first large inner diameter portion of the first die hole. Thereby, a third thick-walled portion that is a portion having the first wall thickness and the first outer diameter is left in a region adjacent to an end portion on the tip end side of the third thin-walled portion in the third raw pipe. Accordingly, the resulting differential thickness pipe further includes the third thick-walled portion formed at an end portion on the base end side of the first thin-walled portion and the third thin-walled portion formed closer to the base end than the third thick-walled portion. Namely, it is possible to mold a differential thickness pipe having a portion having an outer diameter larger than that of other portions and a wall thickness larger than that of the first thin-walled portion at an intermediate position in the axial direction of the differential thickness pipe.

As mentioned above, the cross section of the internal space of the third thin-walled portion of the third raw pipe is identical to or larger than the cross section of the internal space of the first thin-walled portion of the differential thickness pipe. As long as this requirement is satisfied, the shape and size of the cross section of the internal space of the third thin-walled portion of the third raw pipe may be identical to or different from the shape and size of the cross section of the internal space of the first thin-walled portion of the differential thickness pipe. For example, one of the shapes of the cross sections of the third thin-walled portion of the third raw pipe and the first thin-walled portion of the differential thickness pipe may be non-circular (for example, a polygonal shape, an elliptical shape, etc.) and the other may be circular. Alternatively, both of the shapes of the cross sections of the third thin-walled portion of the third raw pipe and the first thin-walled portion of the differential thickness pipe may be non-circular or circular, and both of the sizes of the cross sections of these portions may be the same or different. When the shapes of the cross sections of the third thin-walled portion of the third raw pipe and the first thin-walled portion of the differential thickness pipe are circular (namely, when both of the internal spaces of these portions have cylindrical columnar shapes), the inner diameter of the third thin-walled portion determined by the fifth wall thickness and the eighth outer diameter may be the same as or different from the inner diameter of the first thin-walled portion of the differential thickness pipe. Furthermore, the fifth wall thickness that is the wall thickness of the third thin-walled portion may be the same as or different from the second wall thickness that is the wall thickness of the first thin-walled portion. In addition, the eighth outer diameter that is the outer diameter of the third thin-walled portion of the third raw pipe is smaller than the first outer diameter that is the outer diameter of the first raw pipe. As long as this requirement is satisfied, the eighth outer diameter may be the same as or different from the second outer diameter that is the outer diameter of the first thin-walled portion and first thick-walled portion of the differential thickness pipe. In the latter case, the eighth outer diameter may be larger or smaller than the second outer diameter.

Figure 32:
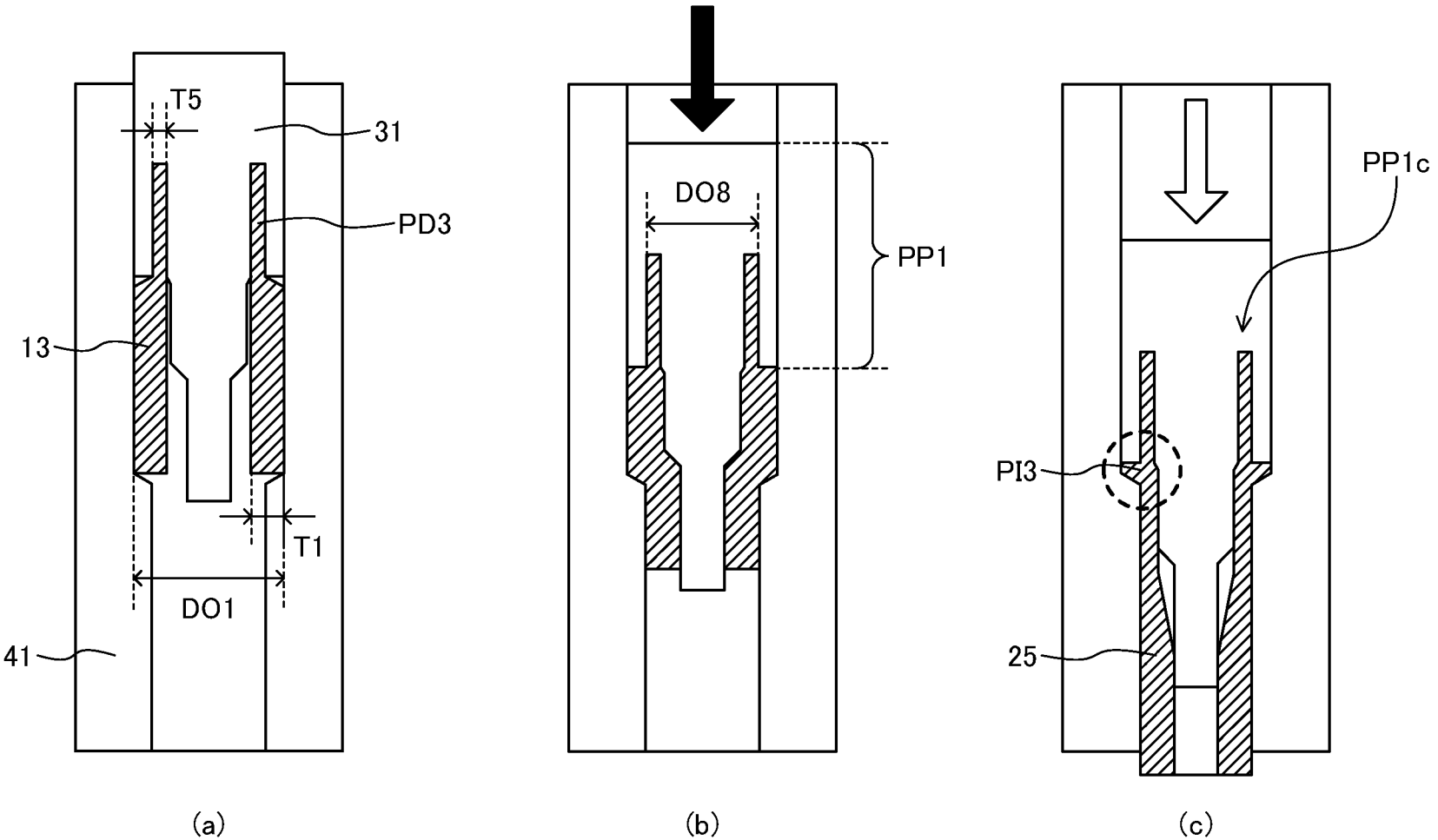
FIG. 32 is a schematic cross-sectional view for showing an example of a transition of a shape of a third raw pipe accompanying execution of extrusion processing in the first step performed in an extrusion molding method for a differential thickness pipe according to an eighth embodiment of the present invention (eighth method).

FIG. 32 is a schematic cross-sectional view for showing an example of a transition of the shape of the third raw pipe accompanying execution of extrusion processing in the first step performed in the eighth method. In addition, in FIG. 32, in order to simplify the drawing, only a part of the reference signs attached to the respective parts shown in FIG. 1 and FIG. 2 is indicated. However, since the reference signs shown in FIG. 1 and FIG. 2 will be used for the sake of accuracy in the following explanations with respect to FIG. 32, please refer to FIG. 1 and FIG. 2 as necessary. Moreover, although a third raw pipe that is a first raw pipe having no second thin-walled portion at the end portion on the tip side is used in the example shown in FIG. 32, the same is true when a third raw pipe that is a first raw pipe having the second thin-walled portion at the end portion on the tip side is used.

As shown in FIG. 32, in the eighth method, the first step is performed using the third raw pipe 13 that is the first raw pipe further comprising the third thin-walled portion PD3 at the end portion on the base end side. The third thin-walled portion PD3 has a fifth wall thickness T5 that is a predetermined wall thickness smaller than the first wall thickness T1 which is the wall thickness of the first raw pipe and an eighth outer diameter DO8 that is a predetermined outer diameter smaller than the first outer diameter DO1 which is the outer diameter of the first raw pipe. Furthermore, the cross section of the internal space of the third thin-walled portion PD3 exemplified in FIG. 32 is slightly larger than the cross section of the internal space of the first thin-walled portion PD1 of the differential thickness pipe 25. Moreover, the first core bar 31 used in the eighth method further comprises the first pressing portion PP1 that is a cylindrical columnar portion formed closet to the base end than the first large cross section portion PDOL1 and having an outer diameter equal to the first outer diameter DO1. The first pressing portion PP1 comprises the reception portion PP1*c* that is a space open to the end surface on the tip end side of the first pressing portion PP1 and having a shape corresponding to the third thin-walled portion PD3.

As shown in FIG. 32 (*a*), also in the eighth method, the third raw pipe 13 is inserted into the first large inner diameter portion PDIL1 of the first die hole 41*a* formed in the first die 41, and the first core bar 31 is inserted into the third raw pipe 13. At this time, as mentioned above, the third thin-walled portion PD3 of the third raw pipe 13 is accommodated in the reception portion PP1*c* formed in the first pressing portion PP1 of the first core bar 31. As a result, the positional relation between the third raw pipe 13 and the first core bar 31 is fixed. Namely, a state where the first core bar 31 is inserted at a predetermined position in the third raw pipe 13 is achieved.

Next, in the first step, extrusion processing is performed in a state where the third thin-walled portion PD3 is accommodated in the reception portion PP1*c*. In (b) of FIG. 32, a state after the first core bar 31 starts to be pressed toward the downstream side (tip side) in the extrusion direction together with the third raw pipe 13 by a not-shown first drive mechanism (refer to a black arrow in the drawing). By being pressed to the extrusion direction by the first pressing portion PP1 of the first core bar 31 and diameter reduction by the first inner diameter reducing portion PDIT1 of the first die hole 41*a*, the plastic flow of the material constituting the third raw pipe 13 toward the first small cross section PDOS1 of the first core bar 31 has been caused, and the first thick-walled portion PI1 begins to be formed.

In FIG. 32 (*c*), a state when the extrusion processing is further advanced and the end portion on the tip end side of the first large cross section portion PDOL1 of the first core bar 31 reaches a position closer to the tip end than the end portion on the base end side of the first small inner diameter portion PDIS1 of 41*a* is shown. In this state, the end portion on the tip end side of the first pressing portion PP1 of the first core bar 31 has not yet reached the end portion on the tip end side of the first large inner diameter portion PDOL1 of the first die hole 41*a*. By terminating the extrusion processing at this point, the third thick-walled portion PI3 that is a portion having the first wall thickness T1 and the first outer diameter DO1 is left in a region adjacent to the end portion on the tip end side of the third thin-walled portion PD3 in the third raw pipe 13 (refer to the part surrounded by a dashed line). Therefore, the resulting differential thickness pipe 25 further includes the third thick-walled portion PI3 formed in the end portion on the base end side of the first thin-walled portion PD1 and the third thin-walled portion PD3 formed closer to the base end than the third thick-walled portion PI3. Namely, it is possible to mold a differential thickness pipe comprising a portion having an outer diameter larger than that of other portions and a wall thickness larger than that of the first thin-walled portion PD1 at an intermediate position in the axial direction of the differential thickness pipe.

<Effect>

As the above, in the eighth method, the first step is performed using the third raw pipe that is the first raw pipe further comprising the third thin-walled portion at the end portion on the base end side, and the extrusion processing is terminated before the end portion on the tip end side of the first pressing portion of the first core bar reaches the end portion on the tip end of the first large inner diameter portion of the first die hole. Thereby, a differential thickness pipe further including the third thick-walled portion formed in the end portion on the base end side of the first thin-walled portion and the third thin-walled portion formed closer to the base end than the third thick-walled portion can be easily molded. Namely, it is possible to easily mold a differential thickness pipe comprising a portion having an outer diameter larger than that of other portions and a wall thickness larger than that of the first thin-walled portion at an intermediate position in the axial direction of the differential thickness pipe.

Ninth Embodiment

By the way, as mentioned at the beginning of the present specification, the present invention relates not only to the extrusion molding method for a differential thickness pipe such as the above-mentioned first to eighth methods, but also to an extrusion molding apparatus for a differential thickness pipe. Therefore, extrusion molding apparatuses for a differential thickness pipe according to various embodiments of the present invention will be explained below.

First, an extrusion molding apparatus for a differential thickness pipe according to a ninth embodiment of the present invention (which may be referred to as a "ninth apparatus" hereafter) will be explained.

<Configuration>

The ninth apparatus is an extrusion molding apparatus for a differential thickness pipe which comprises a first core bar having a predetermined shape, a first die having a first die hole that is a through hole having a predetermined shape, and a first drive mechanism configured so as to press the first core bar into the first die hole. The ninth apparatus is configured so as to mold a differential thickness pipe by performing a first step. The first step is a step in which the differential thickness pipe having a predetermined shape is molded by pressing a pair of a first raw pipe having a predetermined shape and the first core bar into the first die hole with the first drive mechanism in a state where the first core bar is inserted at a predetermined position in the first raw pipe.

As shown in (a) of FIG. 1, the first raw pipe 11 is a tubular member having a first wall thickness T1 that is a predetermined wall thickness and a first outer diameter DO1 that is a predetermined outer diameter.

As shown in (b) of FIG. 1, the differential thickness pipe 21 molded by the ninth apparatus includes a first thin-walled portion PD1 and a first thick-walled portion PI1. The first thin-walled portion PD1 is a portion having a second wall thickness T2 that is a predetermined wall thickness smaller than the first wall thickness T1 and a second outer diameter DO2 that is a predetermined outer diameter smaller than the first outer diameter DO1. The first thick-walled portion PI1 is a portion having a third wall thickness T3 that is q predetermined wall thicknesses larger than the second wall thickness T2 and the second outer diameter DO2.

As mentioned above, the shapes of the cross sections of the internal spaces of the first thick-walled portion PI1 and the first thin-walled portion PD1 are not particularly limited, and can have a wide variety of shapes such as a polygonal shape, an elliptical shape and a circular shape, respectively. In other words, the shapes of the internal spaces of the first thick-walled portion PI1 and the first thin-walled portion PD1 are not particularly limited, and can be various shapes such as a polygonal columnar shape, an elliptical columnar shape and a cylindrical columnar shape, respectively. Accordingly, the shape of the internal space of the first tapered portion PT1 is not particularly limited either, as long as the internal space of the first tapered portion PT1 has a shape having a cross section shrinking from the shape of the cross section of the internal space of the first thin-walled portion PD1 to the shape of the cross section of the internal space of the first thick-walled portion PI1 as approaching from the first thin-walled portion PD1 to the first thick-walled portion PI1.

The first core bar includes a first small cross section portion, a first large cross section portion and a first cross section increasing portion. The first small cross section portion is a portion formed on a tip end side that is a downstream side in an extrusion direction and having a first cross section that is a cross section corresponding to the cross section of the internal space of the first thick-walled portion. The first large cross section portion is a portion formed on a base end side that is an upstream side in the extrusion direction and having a second cross section that is a cross section corresponding to the cross section of the internal space of the first thin-walled portion. The first cross section increasing portion is a portion formed between the first small cross section portion and the first large cross section portion and having a cross section expanding from the first cross section to the second cross section as approaching from the first small cross section portion to the first large cross section portion.

In addition, as mentioned above, the shapes of the cross sections of the internal spaces of the first thick-walled portion and the first thin-walled portion are not particularly limited, and can have a wide variety of shapes such as a polygonal shape, an elliptical shape and a circular shape, respectively. Therefore, the cross sections of the first small cross section, the first large cross section portion and the first cross section increasing portion of the first core bar 31 also have various shapes corresponding to the shapes of the cross sections of the internal spaces of the first thick section PI1 and the first thin section PD1 and the first tapered portion PT1 of the differential thickness pipe 21.

In the explanation about the above-mentioned first method, for the purpose of facilitating the understanding of the present invention, the configuration in which the internal spaces of the first thick-walled portion PI1 and the first thin-walled portion PD1 of the differential thickness pipe 21 respectively have cylindrical columnar shapes was exemplified in (a) of FIG. 2. As shown in (a) of FIG. 2, the first core bar 31 includes a first small cross section portion PDOS1, a first large cross section portion PDOL1 and a first cross section increasing portion PDOT1. The first small cross section portion PDOS1 is a portion formed on a tip end side that is a downstream side in the extrusion direction (lower side toward FIG. 2) and having a third outer diameter DO3 that is an outer diameter corresponding to an inner diameter of the first thick-walled portion PI1 of the differential thickness pipe 21. The first large cross section portion PDOL1 is a portion formed on a base end side that is an upstream side in the extrusion direction (upper side in FIG. 2) and having a fourth outer diameter DO4 that is an outer diameter corresponding to an inner diameter of the first thin-walled portion PD1 of the differential thickness pipe 21. The first cross section increasing portion PDOT1 is a portion formed between the first small cross section portion PDOS1 and the first large cross section portion PDOL1 and having an outer diameter increasing from the third outer diameter DO3 to the fourth outer diameter DO4 as approaching from the first small cross section portion PDOS1 to the first large cross section portion PDOL1.

As shown in (b) of FIG. 2, the first die hole 41*a* includes a first large inner diameter portion PDIL1, a first small inner diameter portion PDIS1 and a first inner diameter reducing portion PDIT1. The first large inner diameter portion PDIL1 is a portion formed on the base end side and having a first inner diameter DI1 that is an inner diameter corresponding to the first outer diameter DO1 that is the outer diameter of the first raw pipe 11. The first small inner diameter portion PDIS1 is a portion formed on the tip end side and having a second inner diameter DI2 that is an inner diameter corresponding to the second outer diameter DO2 of the differential thickness pipe 21. The first inner diameter reducing portion PDIT1 is a portion formed between the first large inner diameter portion PDIL1 and the first small inner diameter portion PDIS1 and having an inner diameter decreasing from the first inner diameter DI1 to the second inner diameter DI2 as approaching from the first large inner diameter portion PDIL1 to the first small inner diameter portion PDIS1.

Moreover, the ninth apparatus is configured such that the end portion on the base end side of the first small cross section portion PDOS1 is located at a position closer to the base end than the end portion on the base end side of the first small inner diameter portion PDIS1 in the extrusion direction when the extrusion processing is started in the first step.

As the above, the ninth apparatus is an extrusion molding apparatus for a differential thickness pipe corresponding to the above-mentioned first method. Since the details of the configuration and operation of the ninth apparatus are clear from the explanation about the first method, the explanation thereof will be omitted here.

<Effect>

By performing the first step in the ninth apparatus having the configuration as mentioned above, the differential thickness pipe including the first thin-walled portion and the first thick-walled portion can be easily molded. Namely, in accordance with the ninth apparatus, a differential thickness pipe can be manufactured with high production efficiency and at a low cost.

Moreover, since the differential thickness pipe is molded by extrusion processing in the ninth apparatus as described above, a difference in the wall thickness between the thin-walled portion and the thick-walled portion can be made larger as compared with a case of a molding apparatus in which a differential thickness pipe is molded by draw processing, for example.

Specifically, in accordance with the ninth apparatus, the third wall thickness that is the wall thickness of the first thick-walled portion of the differential thickness pipe is 1.5 times or more the second wall thickness that is the wall thickness of the first thin-walled portion. More preferably, in accordance with the ninth apparatus, a differential thickness pipe having the third wall thickness twice the second wall thickness or more can be molded.

Tenth Embodiment

Next, an extrusion molding apparatus for a differential thickness pipe according to a tenth embodiment of the present invention (which may be referred to as a "tenth apparatus" hereafter) will be explained.

<Configuration>

The tenth apparatus is the above-mentioned ninth apparatus, further comprising a second core bar that is a core bar having a cylindrical columnar shape with an outer diameter equal to the second outer diameter, and is configured so as to perform the first step in a state where the second core bar is inserted into the first small inner diameter portion of the first die hole from the tip end side and is energized toward the base end side. Furthermore, the tenth apparatus is configured such that, at least when the extrusion processing is started in the first step, the end portion on the base end side of the second core bar is in contact with the end portion on the tip end side of said first core bar.

As the above, the tenth apparatus is an extrusion molding apparatus for a differential thickness pipe corresponding to the above-mentioned second method. Since the details of the configuration and operation of the tenth apparatus are clear from the explanation about the second method, the explanation thereof will be omitted here.

<Effect>

In the tenth apparatus, the tip end side of the space where the first thick-walled portion of the differential thickness pipe is to be formed is blocked by the end surface on the base end side of the second core bar. Therefore, in accordance with the tenth apparatus, the end surface on the tip end side of the first thick-walled portion can be formed as a plane corresponding to the end surface on the base end side of the second core bar.

Eleventh Embodiment

Next, an extrusion molding apparatus for a differential thickness pipe according to an eleventh embodiment of the present invention (which may be referred to as an "eleventh apparatus" hereafter) will be explained.

<Configuration>

The eleventh apparatus is the above-mentioned ninth apparatus, wherein the extrusion molding apparatus is configured so as to perform the first step using a second raw pipe that is the first raw pipe further comprising, at an end portion on the tip end side, a second thin-walled portion that is a portion having a fourth wall thickness that is a predetermined wall thickness smaller than the third wall thickness and a fifth outer diameter that is a predetermined outer diameter equal to or less than the second outer diameter. The differential thickness pipe molded by the eleventh apparatus further includes the second thin-walled portion closer to the tip end than the first thick-walled portion.

As the above, the eleventh apparatus is an extrusion molding apparatus for a differential thickness pipe corresponding to the above-mentioned third method. Since the details of the configuration and operation of the eleventh apparatus and the configuration of the second raw pipe are clear from the explanation about the third method, the description thereof will be omitted here.

<Effect>

In the eleventh apparatus, the above-mentioned first step is performed using the second raw pipe that is the first raw pipe further comprising the second thin-walled portion that is a portion having the fourth wall thickness and the second outer diameter at the end portion on the tip end side, instead of the first raw pipe that is a tubular member having a first wall thickness and a first outer diameter. Therefore, in accordance with the eleventh apparatus, it is possible to easily mold a differential thickness pipe having the first thick-walled portion formed at a predetermined position between both end portions instead of the end portion in the axial direction.

Twelfth Embodiment

Next, an extrusion molding apparatus for a differential thickness pipe according to a twelfth embodiment of the present invention (which may be referred to as a "twelfth apparatus" hereafter) will be explained.

<Configuration>

The twelfth apparatus is the above-mentioned eleventh apparatus described above, which further comprises a third core bar that is a core bar having a predetermined shape, a second die having a second die hole that is a through hole having a predetermined shape, and a second drive mechanism configured so as to press the second core bar into the second die hole. And, the twelfth apparatus is configured so as to perform a second step that before the first step. The second step is a step in which the second thin-walled portion is molded at an end portion on the tip end side of the first raw pipe by pressing a pair of the first raw pipe and the third core bar into the second die hole with the second drive mechanism in a state where the third core bar is inserted at a predetermined position in the first raw pipe to perform extrusion processing. In accordance with the twelfth apparatus, the second raw pipe 12 as shown in (a) of FIG. 15 can be easily molded from the first raw pipe 11 as shown in (a) of FIG. 1 (*a*), for example.

The third core bar is a core bar having a columnar shape with a third cross section that is a cross section corresponding to a cross section of an internal space of the second thin-walled portion. As described above, the second step is a step of molding the second thin-walled portion at the end portion on the tip end side of the first raw pipe. Therefore, the third core bar is inserted at a predetermined position in the first raw pipe such that the cross section of the internal space of the second thin-walled portion can be defined at least for a time period during which the pair of the first raw pipe and the third core bar is being pressed into the second die hole to be subjected to the extrusion processing.

In addition, as mentioned above in the explanation about the third method, the shape of the internal space of the second thin-walled portion is not particularly limited, and a wide variety of shapes such as a polygonal columnar shape, an elliptical columnar shape, and a cylindrical columnar shape can be adopted. However, in the following explanation, for the purpose of facilitating the understanding of the present invention, a case where the internal space of the second thin-walled portion has a cylindrical columnar shape like the internal space of the portion other than the second thin-walled portion will be explained.

The third core bar 33 exemplified in (a) of FIG. 22 is a core bar having a cylindrical columnar shape with a sixth outer diameter DO6 that is an outer diameter corresponding to the inner diameter of the second thin-walled portion PD2 to be formed at the end portion on the tip end side of the first raw pipe 11. As mentioned above in the explanation about the third method, the inner diameter of the second thin-walled portion may be equal to or different from the inner diameter of the portion other than the second thin-walled portion of the second raw pipe. Therefore, the sixth outer diameter DO6, which is the outer diameter of the third core bar 33, may be equal to or different from the fourth outer diameter DOS4, which is the outer diameter of the first large cross section portion PDOL1 of the first core bar 31.

As exemplified in (b) of FIG. 22, the second die hole 42*a* includes a second large inner diameter portion PDIL2, a second small inner diameter portion PDIS2 and a second inner diameter reducing portion PDIT2. The second large inner diameter portion PDIL2 is a portion formed on the base end side and having an inner diameter equal to the first inner diameter DI1 that is an inner diameter corresponding to the first outer diameter DO1 which is the outer diameter of the first raw pipe 11, similarly to the first large inner diameter portion PDIL1 of the first die hole 41*a*. The second small inner diameter portion PDIS2 is a portion formed on the tip end side and having a third inner diameter DI3 that is an inner diameter corresponding to the fifth outer diameter DO5 which is the outer diameter of the second thin-walled portion PD2 of the second raw pipe 12. The second inner diameter reducing portion PDIT2 is a portion formed between the second large inner diameter portion PDIL2 and the second small inner diameter portion PDIS2 and having an inner diameter decreasing from the first inner diameter DI1 to the third inner diameter DI3 as approaching from the second large inner diameter portion PDIL2 to the second small inner diameter portion PDIS2.

Moreover, in the twelfth apparatus, when the extrusion processing is started in the second step, the end portion on the tip end side of the third core bar is at the same position as the end portion on the base end side of the second small inner diameter portion in the extrusion direction. The second small inner diameter portion is configured to be located at a position closer to the tip side than the end portion on the base end side.

As the above, the twelfth apparatus is an extrusion molding apparatus for a differential thickness pipe corresponding to the above-mentioned fourth method. Since the details of the configuration and operation of the twelfth apparatus are clear from the explanation of the fourth method, the explanation thereof will be omitted here.

<Effect>

In accordance with the twelfth apparatus, the second step is performed before the first step, and the second raw pipe, which is the first raw pipe further comprising the second thin-walled portion that is a portion having the fourth wall thickness and the second outer diameter at the end portion on the tip end side, can be easily molded from the first raw pipe, which is a tubular member having the first wall thickness and the first outer diameter. Next, the above-mentioned first step is performed using the second raw pipe molded by the second step. Therefore, in accordance with the twelfth apparatus, it is possible to easily mold a differential thickness pipe having the first thick-walled portion formed at a predetermined position between both end portions instead of the end portion in the axial direction.

<Supplement>

As mentioned in the explanation about the fourth method, the extrusion molding apparatus may be configured such that the core bars and/or the dies can be replaced depending on steps to be performed, by means of standardization of configuration of a portion for mounting the first core bar and the third core bar and/or standardization of configuration of a portion for mounting the first die and the second die, for example.

Specifically, for example, when the fifth outer diameter DO5 that is the outer diameter of the second thin-walled portion PD2 is equal to the second outer diameter DO2 that is the outer diameter of the first thick-walled portion PI1 and the first thin-walled portion PD1 of the differential thickness pipe, the first die 41 can be used as the second die 42 in the second step. In this case, when switching from the second step to the first step, it is necessary only to replace the third core bar 33 used in the second step with the first core bar 31 to be used in the first step.

Thirteenth Embodiment

Next, an extrusion molding apparatus for a differential thickness pipe according to a thirteenth embodiment of the present invention (which may be referred to as a "thirteenth apparatus" hereafter) will be explained.

<Configuration>

The thirteenth apparatus is the above-mentioned eleventh or twelfth apparatus, which further comprises a fourth core bar having a columnar shape with a fourth cross section that is a cross section corresponding to a cross section of the internal space of the second thin-walled portion. And, the thirteenth apparatus is configured so as to perform the first step in a state where the fourth core bar is inserted into the second thin-walled portion of the second raw pipe from the tip end side and is energized toward the base end side. Furthermore, the thirteenth apparatus is configured such that an end portion on the base end side of the fourth core bar is in contact with an end portion on the tip end side of the first core bar at least when the extrusion processing is started in the first step.

As the above, the thirteenth apparatus is an extrusion molding apparatus for a differential thickness pipe corresponding to the above-mentioned fifth method. Since the details of the configuration and operation of the thirteenth apparatus are clear from the explanation of the fifth method, the explanation thereof will be omitted here.

<Effect>

In the thirteenth apparatus, since the fourth core bar 34 is inserted into the second thin-walled portion PD2 of the second raw pipe 12 from the tip side, it is possible to reduce the peeling of the outer peripheral surface of the differential thickness pipe 22 from the inner peripheral surface of the first small inner diameter portion PDIS1 as mentioned in the explanation about the fifth method to reduce the occurrence of the depression in the part. Namely, in accordance with the thirteenth apparatus, it is possible to easily and with high dimensional accuracy mold a differential thickness pipe having a first thick-walled portion formed at a predetermined position between both end portions instead of the end portion in the axial direction.

Fourteenth Embodiment

Next, an extrusion molding apparatus for a differential thickness pipe according to a fourteenth embodiment of the present invention (which may be referred to as a "fourteenth apparatus" hereafter) will be explained.

<Configuration>

The fourteenth apparatus is any one of the above-mentioned ninth to thirteenth apparatuses, which is configured so as to form a second thick-walled portion that is a portion having the first wall thickness and the first outer diameter at an end portion on the base end side of the differential thickness pipe by not performing the extrusion processing on a predetermined region at the end portion on the base end side of the first raw pipe to leave the region as it is, in the first step.

As the above, the fourteenth apparatus is an extrusion molding apparatus for a differential thickness pipe corresponding to the above-mentioned sixth method. Since the details of the configuration and operation of the fourteenth apparatus are clear from the explanation of the sixth method, the explanation thereof will be omitted here.

<Effect>

In accordance with the fourteenth apparatus, in the first step, the second thick-walled portion that is a portion having the first wall thickness and the first outer diameter can be easily formed by not performing the extrusion processing on a predetermined region at the end portion on the base end side of the first raw pipe to leave the region as it is. Therefore, it is possible to manufacture a differential thickness pipe suitable for applications in which a portion having an outer diameter larger than that of other portions of the differential thickness pipe, such as a flange, is required, with high production efficiency and at a low cost.

Fifteenth Embodiment

Next, an extrusion molding apparatus for a differential thickness pipe according to a fifteenth embodiment of the present invention (which may be referred to as a "fifteenth apparatus" hereafter) will be explained.

<Configuration>

The fifteenth device is any one of the above-mentioned ninth to thirteenth apparatuses, wherein the first core bar further includes a first pressing portion that is a cylindrical columnar portion formed closer to the base end than the first large cross section portion and having an outer diameter equal to the first outer diameter that is an outer diameter of the first raw pipe. The first pressing portion is constituted by a core portion and an outer peripheral portion. The core portion is a cylindrical columnar portion having an outer diameter equal to the second outer diameter that is the outer diameter of the first thin-walled portion of the differential thickness pipe. The outer peripheral portion is a cylindrical tubular portion slidably disposed outside in a radial direction of the core portion and having an outer diameter equal to the first outer diameter that is the outer diameter of the first raw pipe and an inner diameter corresponding to the second outer diameter that is the outer diameter of the first thin-walled portion of the differential thickness pipe.

Furthermore, the fifteenth apparatus is configured so as to form a second thick-walled portion that is a portion having the first wall thickness and the first outer diameter at an end portion on the base end side of the first raw pipe by not performing the extrusion processing on a predetermined region at the end portion on the base end side of the first raw pipe in the first step. In addition, the fifteenth apparatus is configured so as to perform the third step that is a step in which a portion outside the second outer diameter of the second thick-walled portion is cut off, after the first step. In the third step, the fifteenth apparatus does not press the outer peripheral portion of the first pressing portion, but presses the core portion of the first pressing portion in the extrusion direction until a state where an end portion on the tip end side of the core portion of the first pressing portion is located closer to the tip end than an end portion on the base end side of the first small inner diameter portion of the first die hole is attained. Thereby, the portion outside the second outer diameter of the second thick-walled portion is cut off, and a differential thickness pipe with the first thin-walled portion extending to the end portion on the base end side can be easily molded.

As is clear from the above, the fifteenth apparatus is an extrusion molding apparatus for a differential thickness pipe corresponding to the above-mentioned seventh method. Since the details of the configuration and operation of the fifteenth apparatus and the configuration of the first pressing portion which the first core bar comprises are clear from the explanation of the seventh method, the explanation thereof will be omitted here.

<Effect>

As the above, in accordance with the fifteenth apparatus, the second thick-walled portion left at the end portion on the base end side of the raw pipe in the first step can be easily cut off without rearranging the core bar and the die in a single extrusion molding apparatus. Namely, in accordance with the fifteenth apparatus, it is possible to easily mold a differential thickness pipe having the first thin-walled portion extending to the end portion on the base end side.

Sixteenth Embodiment

Next, an extrusion molding apparatus for a differential thickness pipe according to a sixteenth embodiment of the present invention (which may be referred to as a "sixteenth apparatus" hereafter) will be explained.

<Configuration>

The sixteenth device is any of the above-mentioned ninth to thirteenth apparatuses, which is configured so as to perform the first step using a third raw pipe that is the first raw pipe further comprising a third thin-walled portion at an end portion on the base end side. The third thin-walled portion is a portion having a fifth wall thickness that is a predetermined wall thickness smaller than the first wall thickness that is the wall thickness of the first raw pipe and an eighth outer diameter that is a predetermined outer diameter smaller than the first outer diameter that is the outer diameter of the first raw pipe, and having a cross section identical to or larger than a cross section of the internal space of the first thin-walled portion of the differential thickness pipe.

Moreover, the first core bar which the sixteenth apparatus comprises further comprises a first pressing portion that is a cylindrical columnar portion formed closer to the base end than the first large cross section portion and having an outer diameter equal to the first outer diameter. The first pressing portion comprises a reception portion that is a space open to the end surface on the tip end side of the first pressing portion and has a shape corresponding to the third thin-walled portion.

Furthermore, the sixteenth apparatus is configured to perform extrusion processing in a state where the third thin-walled portion is accommodated in the reception portion in the first step. However, the sixteenth apparatus is configured so as to terminate the extrusion processing before the end portion on the tip end side of the first pressing portion of the first core bar reaches the end portion on the tip end portion of the first large inner diameter portion of the first die hole. Thereby, the third thick-walled portion, which that is a portion having the first wall thickness and the first outer diameter is left in the region adjacent to the end portion on the tip end side of the third thin-walled portion in the third raw pipe. Therefore, the resulting differential thickness pipe includes a third thick-walled portion formed at end portion on the base end side the first thin-walled portion and a third thin-walled portion formed closer to the base end than the third thick-walled portion. Namely, the sixteenth apparatus can mold a differential thickness pipe having a portion having an outer diameter larger than that of other portions and a wall thickness larger than that of the first thin-walled portion at an intermediate position in the axial direction of the differential thickness pipe.

As is clear from the above, the sixteenth apparatus is an extrusion molding apparatus for a differential thickness pipe corresponding to the above-mentioned eighth method. Therefore, the details of the configuration of the third raw pipe used by the sixteenth apparatus, the configuration of the first core bar which the sixteenth apparatus comprises, and the configuration and operation of the sixteenth apparatus and the like are clear from the explanation of the eighth method, the explanation thereof will be omitted here.

<Effect>

As the above, the sixteenth apparatus is configured so as to perform the first step using the third raw pipe that is the first raw pipe further comprising the third thin-walled portion at the end portion on the base end side and terminate the first step before the end portion on the tip end side of the first pressing portion of the first core bar reaches the end portion on the tip side of the first large inner diameter portion of the first die hole. Thereby, the third thick-walled portion that is a portion having the first wall thickness and the first outer diameter is left in the region adjacent to the end portion on the tip end side of the third thin-walled portion in the third raw pipe. In accordance with the sixteenth apparatus, a differential thickness pipe having a portion having an outer diameter larger than that of other portions and a wall thickness larger than that of the first thin-walled portion at an intermediate position in the axial direction of the differential thickness pipe can be easily molded.

Although some the embodiments which have specific configurations have been explained as the above, sometimes referring to the drawings, for the purpose of explaining the present invention, it should not be interpreted that the scope of the present invention is limited to these exemplary embodiments, and it is needless to say that it is possible to add modifications properly within the limits of matters described in the claims and specification.

REFERENCE SIGNS LIST

11: First Raw Pipe, 12: Second Raw Pipe, 13: Third Raw Pipe, 21, 22, 23, 24, 25: Differential thickness pipe, 31: First Core Bar, 32: Second Core Bar, 33: Third Core Bar, 34: Fourth Core Bar, 41: First Die, 41*a*: First Die Hole, 42: Second Die, 42*a*: Second Die Hole, AX: Axis, T1: First Wall Thickness, T2: Second Wall Thickness, T3: Third Wall Thickness, T4: Fourth Wall Thickness, T5: Fifth Wall Thickness, DO1: First Outer Diameter, DO2: Second Outer Diameter, DO3: Third Outer Diameter, DO4: Fourth Outer Diameter, DO5: Fifth Outer Diameter, DO6: Sixth Outer Diameter, DO7: Seventh Outer Diameter, DO8: Eighth Outer Diameter, DI1: First Inner Diameter, DI2: Second Inner Diameter, DI3: Third Inner Diameter, PD1: First Thin-Walled Portion, PD2: Second Thin-Walled Portion, PD3: Third Thin-Walled Portion, PI1: First Thick-Walled Portion, PI2: Second Thick-Walled Portion, PI3: Third Thick-Walled Portion, PT1: First Tapered Portion, PDOS1: First Small Cross Section Portion, PDOL1: First Large Cross Section Portion, PDOT1: First Cross Section Increasing Portion, PDIS1: First Small Inner Diameter Portion, PDIS2: Second Small Inner Diameter Portion, PDIL1: First Large Inner Diameter Portion, PDIL2: Second Large Inner Diameter Portion, PDIT1: First Inner Diameter Reducing Part, PDIT2: Second Inner Diameter Reducing Part, PP1: First Pressing Portion, PP1*a*: Core Portion, PP1*b*: Outer Peripheral Portion, PP1*c*: Reception Portion, PP2: Second Pressing Portion, LD1: First Level Difference, LD2: Second Level Difference.

The invention claimed is:

1. An extrusion molding method for a differential thickness pipe, including a first step that is a step in which, in a first extrusion molding apparatus comprising a first core bar having a predetermined shape, a first die having a first die hole that is a through hole having a predetermined shape, and a first drive mechanism configured so as to press said first core bar into said first die hole, a differential thickness pipe having a predetermined shape is molded by pressing a pair of a first raw pipe having a predetermined shape and said first core bar into said first die hole with said first drive mechanism in a state where said first core bar is inserted at a predetermined position in said first raw pipe to perform extrusion processing, wherein:

said first raw pipe is a tubular member having a first wall thickness that is a predetermined wall thickness and a first outer diameter that is a predetermined outer diameter, said differential thickness pipe includes:

a first thin-walled portion that is a portion having a second wall thickness that is a predetermined wall thickness smaller than said first wall thickness and a second outer diameter that is a predetermined outer diameter smaller than said first outer diameter, and a first thick-walled portion that is a portion having an outer diameter equal to the second outer diameter and a third wall thickness that is a predetermined wall thickness larger than said second wall thickness, said first core bar includes:

a first small cross section portion that is a portion formed on a tip end side that is a downstream side in an extrusion direction and having a first cross section that is a cross section corresponding to a cross section of an internal space of said first thick-walled portion, a first large cross section portion that is a portion formed on a base end side that is an upstream side in said extrusion direction and having a second cross section that is a cross section corresponding to a cross section of an internal space of said first thin-walled portion, and a first cross section increasing portion that is a portion formed between said first small cross section portion and said first large cross section portion and having a cross section expanding from said first cross section to said second cross section as approaching from said first small cross section portion to said first large cross section portion, said first die hole includes:

a first large inner diameter portion that is a portion formed on a base end side and having a first inner diameter that is an inner diameter corresponding to said first outer diameter, a first small inner diameter portion that is a portion formed on a tip end side and having a second inner diameter that is an inner diameter corresponding to said second outer diameter, and a first inner diameter reducing portion that is a portion formed between said first large inner diameter portion and said first small inner diameter portion and having an inner diameter decreasing from said first inner diameter to said second inner diameter as approaching from said first large inner diameter portion to said first small inner diameter portion, and when said extrusion processing is started in said first step, an end portion on a base end side of said first small cross section portion is in a position closer to said base end than an end portion on a base end side of said first small inner diameter portion, in said extrusion direction, and said first step is performed using a second raw pipe that is said first raw pipe further comprising, at an end portion on a tip end side, a second thin-walled portion that is a portion having a fourth wall thickness which is a predetermined wall thickness smaller than said third wall thickness and a fifth outer diameter which is a predetermined outer diameter equal to or less than said second outer diameter, and said differential thickness pipe further includes said second thin-walled portion closer to a tip end of said differential thickness pipe than said first thick-walled portion.

2. The extrusion molding method for a differential thickness pipe according to claim 1, wherein:

a second step that is a step in which, in a second extrusion molding apparatus comprising a third core bar that is a core bar having a predetermined shape, a second die having a second die hole that is a through hole having a predetermined shape, and a second drive mechanism configured so as to press said third core bar into said second die hole, said second thin-walled portion is molded at an end portion on a tip end side of said first raw pipe by pressing a pair of said first raw pipe and said third core bar into said second die hole with said second drive mechanism in a state where said third core bar is inserted at a predetermined position in said first raw pipe to perform extrusion processing, is further included before said first step, and said third core bar is a core bar having a columnar shape with a third cross section that is a cross section corresponding to a cross section of an internal space of said second thin-walled portion, said second die hole includes:

a second large inner diameter portion that is a portion formed on a base end side and having an inner diameter equal to said first inner diameter, a second small inner diameter portion that is a portion formed on a tip end side and having a third inner diameter that is an inner diameter corresponding to said fifth outer diameter, and a second inner diameter reducing portion that is a portion formed between said second large inner diameter portion and said second small inner diameter portion and having an inner diameter decreasing from said inner diameter equal to said first inner diameter to said third inner diameter as approaching from said second large inner diameter portion to said second small inner diameter portion, and when said extrusion processing is started in said second step, an end portion on a tip end side of said third core bar is in a same position as an end portion on a base end side of said second small inner diameter portion or in a position closer to a tip end of said first raw pipe than said end portion on a base end side of said second small inner diameter portion, in said extrusion direction.

3. The extrusion molding method for a differential thickness pipe according to claim 2, wherein:

said internal space of said second thin-walled portion has a cylindrical columnar shape, and said third core bar is a core bar having a cylindrical columnar shape with a sixth outer diameter that is an outer diameter corresponding to an inner diameter of said second thin-walled portion.

4. The extrusion molding method for a differential thickness pipe according to claim 1, wherein:

said first extrusion molding apparatus further comprises a fourth core bar having a columnar shape with a fourth cross section that is a cross section corresponding to a cross section of an internal space of said second thin-walled portion, said first step is performed in a state where said fourth core bar is inserted into said second thin-walled portion from a tip end side of said second raw pipe and is energized toward a direction opposite to said extrusion direction, and at least when said extrusion processing is started in the first step, an end portion on a base end side of said fourth core bar is in contact with an end portion on said tip end side of said first core bar.

5. The extrusion molding method for a differential thickness pipe according to claim 4, wherein:

said internal space of said second thin-walled portion has a cylindrical columnar shape, and said fourth core bar is a core bar having a cylindrical columnar shape with a seventh outer diameter that is an outer diameter corresponding to an inner diameter of said second thin-walled portion.

6. An extrusion molding method for a differential thickness pipe, including a first step that is a step in which, in a first extrusion molding apparatus comprising a first core bar having a predetermined shape, a first die having a first die hole that is a through hole having a predetermined shape, and a first drive mechanism configured so as to press said first core bar into said first die hole, a differential thickness pipe having a predetermined shape is molded by pressing a pair of a first raw pipe having a predetermined shape and said first core bar into said first die hole with said first drive mechanism in a state where said first core bar is inserted at a predetermined position in said first raw pipe to perform extrusion processing, wherein:

said first raw pipe is a tubular member having a first wall thickness that is a predetermined wall thickness and a first outer diameter that is a predetermined outer diameter, said differential thickness pipe includes:

a first thin-walled portion that is a portion having a second wall thickness that is a predetermined wall thickness smaller than said first wall thickness and a second outer diameter that is a predetermined outer diameter smaller than said first outer diameter, and a first thick-walled portion that is a portion having an outer diameter equal to the second outer diameter and a third wall thickness that is a predetermined wall thickness larger than said second wall thickness, said first core bar includes:

a first small cross section portion that is a portion formed on a tip end side that is a downstream side in an extrusion direction and having a first cross section that is a cross section corresponding to a cross section of an internal space of said first thick-walled portion, a first large cross section portion that is a portion formed on a base end side that is an upstream side in said extrusion direction and having a second cross section that is a cross section corresponding to a cross section of an internal space of said first thin-walled portion, and a first cross section increasing portion that is a portion formed between said first small cross section portion and said first large cross section portion and having a cross section expanding from said first cross section to said second cross section as approaching from said first small cross section portion to said first large cross section portion, said first die hole includes:

a first large inner diameter portion that is a portion formed on a base end side and having a first inner diameter that is an inner diameter corresponding to said first outer diameter, a first small inner diameter portion that is a portion formed on a tip end side and having a second inner diameter that is an inner diameter corresponding to said second outer diameter, and a first inner diameter reducing portion that is a portion formed between said first large inner diameter portion and said first small inner diameter portion and having an inner diameter decreasing from said first inner diameter to said second inner diameter as approaching from said first large inner diameter portion to said first small inner diameter portion, and when said extrusion processing is started in said first step, an end portion on a base end side of said first small cross section portion is in a position closer to a base end of said first raw pipe than an end portion on a base end side of said first small inner diameter portion, in said extrusion direction, and said first extrusion molding apparatus further comprises a second core bar that is a core bar having a cylindrical columnar shape with an outer diameter equal to said second outer diameter, said first step is performed in a state where said second core bar is inserted into said first small inner diameter portion from a tip end side of said first die hole and is energized toward a direction opposite to said extrusion direction, and at least when said extrusion processing is started in said first step, an end portion on a base end side of said second core bar is in contact with an end portion on said tip end side of said first core bar.

7. An extrusion molding method for a differential thickness pipe, including a first step that is a step in which, in a first extrusion molding apparatus comprising a first core bar having a predetermined shape, a first die having a first die hole that is a through hole having a predetermined shape, and a first drive mechanism configured so as to press said first core bar into said first die hole, a differential thickness pipe having a predetermined shape is molded by pressing a pair of a first raw pipe having a predetermined shape and said first core bar into said first die hole with said first drive mechanism in a state where said first core bar is inserted at a predetermined position in said first raw pipe to perform extrusion processing, wherein:

said first raw pipe is a tubular member having a first wall thickness that is a predetermined wall thickness and a first outer diameter that is a predetermined outer diameter, said differential thickness pipe includes:

a first thin-walled portion that is a portion having a second wall thickness that is a predetermined wall thickness smaller than said first wall thickness and a second outer diameter that is a predetermined outer diameter smaller than said first outer diameter, and a first thick-walled portion that is a portion having an outer diameter equal to the second outer diameter and a third wall thickness that is a predetermined wall thickness larger than said second wall thickness, said first core bar includes:

a first small cross section portion that is a portion formed on a tip end side that is a downstream side in an extrusion direction and having a first cross section that is a cross section corresponding to a cross section of an internal space of said first thick-walled portion, a first large cross section portion that is a portion formed on a base end side that is an upstream side in said extrusion direction and having a second cross section that is a cross section corresponding to a cross section of an internal space of said first thin-walled portion, and a first cross section increasing portion that is a portion formed between said first small cross section portion and said first large cross section portion and having a cross section expanding from said first cross section to said second cross section as approaching from said first small cross section portion to said first large cross section portion, said first die hole includes:

a first large inner diameter portion that is a portion formed on a base end side and having a first inner diameter that is an inner diameter corresponding to said first outer diameter, a first small inner diameter portion that is a portion formed on a tip end side and having a second inner diameter that is an inner diameter corresponding to said second outer diameter, and a first inner diameter reducing portion that is a portion formed between said first large inner diameter portion and said first small inner diameter portion and having an inner diameter decreasing from said first inner diameter to said second inner diameter as approaching from said first large inner diameter portion to said first small inner diameter portion, and when said extrusion processing is started in said first step, an end portion on a base end side of said first small cross section portion is in a position closer to said base end than an end portion on a base end side of said first small inner diameter portion, in said extrusion direction, and said first core bar further comprises a first pressing portion that is a cylindrical columnar portion formed closer to said base end than said first large cross section portion and having an outer diameter equal to said first outer diameter, said first pressing portion is constituted by a core portion that is a cylindrical columnar portion having an outer diameter equal to said second outer diameter and an outer peripheral portion that is a cylindrical tubular portion slidably disposed outside in a radial direction of said core portion and having an outer diameter equal to said first outer diameter and an inner diameter corresponding to said second outer diameter, in said first step, a second thick-walled portion that is a portion having said first wall thickness and said first outer diameter is located at an end portion on a base end side of said first raw pipe by not performing said extrusion processing on a predetermined region at said end portion on said base end side of said first raw pipe, and after said first step, a third step that is a step in which a portion outside said second outer diameter of said second thick-walled portion is cut off by not pressing said outer peripheral portion of said first pressing portion and pressing said core portion of said first pressing portion in said extrusion direction until a state where an end portion on a tip end side of said core portion of said first pressing portion is located closer to a tip end of said first raw pipe than an end portion on a base end side of said first small inner diameter portion of said first die hole is attained is further included.

8. An extrusion molding method for a differential thickness pipe, including a first step that is a step in which, in a first extrusion molding apparatus comprising a first core bar having a predetermined shape, a first die having a first die hole that is a through hole having a predetermined shape, and a first drive mechanism configured so as to press said first core bar into said first die hole, a differential thickness pipe having a predetermined shape is molded by pressing a pair of a first raw pipe having a predetermined shape and said first core bar into said first die hole with said first drive mechanism in a state where said first core bar is inserted at a predetermined position in said first raw pipe to perform extrusion processing, wherein:

said first raw pipe is a tubular member having a first wall thickness that is a predetermined wall thickness and a first outer diameter that is a predetermined outer diameter, said differential thickness pipe includes:

a first thin-walled portion that is a portion having a second wall thickness that is a predetermined wall thickness smaller than said first wall thickness and a second outer diameter that is a predetermined outer diameter smaller than said first outer diameter, and a first thick-walled portion that is a portion having an outer diameter equal to the second outer diameter and a third wall thickness that is a predetermined wall thickness larger than said second wall thickness, said first core bar includes:

a first small cross section portion that is a portion formed on a tip end side that is a downstream side in an extrusion direction and having a first cross section that is a cross section corresponding to a cross section of an internal space of said first thick-walled portion, a first large cross section portion that is a portion formed on a base end side that is an upstream side in said extrusion direction and having a second cross section that is a cross section corresponding to a cross section of an internal space of said first thin-walled portion, and a first cross section increasing portion that is a portion formed between said first small cross section portion and said first large cross section portion and having a cross section expanding from said first cross section to said second cross section as approaching from said first small cross section portion to said first large cross section portion, said first die hole includes:

a first large inner diameter portion that is a portion formed on a base end side and having a first inner diameter that is an inner diameter corresponding to said first outer diameter, a first small inner diameter portion that is a portion formed on a tip end side and having a second inner diameter that is an inner diameter corresponding to said second outer diameter, and a first inner diameter reducing portion that is a portion formed between said first large inner diameter portion and said first small inner diameter portion and having an inner diameter decreasing from said first inner diameter to said second inner diameter as approaching from said first large inner diameter portion to said first small inner diameter portion, and when said extrusion processing is started in said first step, an end portion on a base end side of said first small cross section portion is in a position closer to a base end of said first raw pipe than an end portion on a base end side of said first small inner diameter portion, in said extrusion direction, and said first step is performed using a third raw pipe that is said first raw pipe further comprising, at an end portion on a base end side, a third thin-walled portion that is a portion having a fifth wall thickness that is a predetermined wall thickness smaller than said first wall thickness and an eighth outer diameter that is a predetermined outer diameter smaller than said first outer diameter and having a cross section identical to or larger than a cross section of said internal space of said first thin-walled portion, said first core bar further comprises a first pressing portion that is a cylindrical columnar portion formed closer to a base end of said first core pipe than said first large cross section portion and having an outer diameter equal to said first outer diameter, said first pressing portion comprises a reception portion that is a space open to an end surface on a tip end side of said first pressing portion and having a shape corresponding to said third thin-walled portion, in said first step, a third thick-walled portion that is a portion having said first wall thickness and said first outer diameter is left in a region adjacent to an end portion on a tip end side of said third thin-walled portion by performing said extrusion processing in a state where said third thin-walled portion is accommodated in said reception portion and terminating said extrusion processing before an end portion on a tip end side of said first pressing portion reaches an end portion on a tip end side of said first large inner diameter portion, and said differential thickness pipe further includes said third thick-walled portion formed at an end portion on a base end side of said first thin-walled portion and said third thin-walled portion formed closer to a base end of said differential thickness pipe than said third thick-walled portion.

9. An extrusion molding apparatus for a differential thickness pipe which comprises a first core bar having a predetermined shape, a first die having a first die hole that is a through hole having a predetermined shape, and a first drive mechanism configured so as to press said first core bar into said first die hole, and is configured so as to mold a differential thickness pipe having a predetermined shape by pressing a pair of a first raw pipe having a predetermined shape and said first core bar into said first die hole with said first drive mechanism in a state where said first core bar is inserted at a predetermined position in said first raw pipe to perform a first step that is a step in which said differential thickness pipe is molded, wherein:

said first raw pipe is a tubular member having a first wall thickness that is a predetermined wall thickness and a first outer diameter that is a predetermined outer diameter, said differential thickness pipe includes:

a first thin-walled portion that is a portion having a second wall thickness that is a predetermined wall thickness smaller than said first wall thickness and a second outer diameter that is a predetermined outer diameter smaller than said first outer diameter, and a first thick-walled portion that is a portion having an outer diameter equal to the second outer diameter and a third wall thickness that is a predetermined wall thickness larger than said second wall thickness, said first core bar includes:

a first small cross section portion that is a portion formed on a tip end side that is a downstream side in an extrusion direction and having a first cross section that is a cross section corresponding to a cross section of an internal space of said first thick-walled portion, a first large cross section portion that is a portion formed on a base end side that is an upstream side in said extrusion direction and having a second cross section that is a cross section corresponding to a cross section of an internal space of said first thin-walled portion, and a first cross section increasing portion that is a portion formed between said first small cross section portion and said first large cross section portion and having a cross section expanding from said first cross section to said second cross section as approaching from said first small cross section portion to said first large cross section portion, said first die hole includes:

a first large inner diameter portion that is a portion formed on a base end side and having a first inner diameter that is an inner diameter corresponding to said first outer diameter, a first small inner diameter portion that is a portion formed on a tip end side and having a second inner diameter that is an inner diameter corresponding to said second outer diameter, and a first inner diameter reducing portion that is a portion formed between said first large inner diameter portion and said first small inner diameter portion and having an inner diameter decreasing from said first inner diameter to said second inner diameter as approaching from said first large inner diameter portion to said first small inner diameter portion, and when said extrusion processing is started in said first step, an end portion on a base end side of said first small cross section portion is located at a position closer to a base end of said first raw pipe than an end portion on a base end side of said first small inner diameter portion, in said extrusion direction, and said extrusion molding apparatus is configured so as to perform said first step using a second raw pipe that is said first raw pipe further comprising, at an end portion on a tip end side, a second thin-walled portion that is a portion having a fourth wall thickness that is a predetermined wall thickness smaller than said third wall thickness and a fifth outer diameter that is a predetermined outer diameter equal to or less than said second outer diameter, and said differential thickness pipe further includes said second thin-walled portion closer to a tip end of said differential thickness pipe than said first thick-walled portion, and said extrusion molding apparatus further comprises a third core bar that is a core bar having a predetermined shape, a second die having a second die hole that is a through hole having a predetermined shape, and a second drive mechanism configured so as to press said third core bar into said second die hole, said extrusion molding apparatus is configured so as to perform a second step that is a step in which said second thin-walled portion is molded at an end portion on a tip end side of said first raw pipe by pressing a pair of said first raw pipe and said third core bar into said second die hole with said second drive mechanism in a state where said third core bar is inserted at a predetermined position in said first raw pipe to perform extrusion processing, before said first step, and said third core bar is a core bar having a columnar shape with a third cross section that is a cross section corresponding to a cross section of an internal space of said second thin-walled portion, said second die hole includes:

a second large inner diameter portion that is a portion formed on a base end side and having an inner diameter equal to said first inner diameter, a second small inner diameter portion that is a portion formed on a tip end side and having a third inner diameter that is an inner diameter corresponding to said fifth outer diameter, and a second inner diameter reducing portion that is a portion formed between said second large inner diameter portion and said second small inner diameter portion and having an inner diameter decreasing from said inner diameter equal to said first inner diameter to said third inner diameter as approaching from said second large inner diameter portion to said second small inner diameter portion, and when said extrusion processing is started in said second step, an end portion on a tip end side of said third core bar is in a same position as an end portion on a base end side of said second small inner diameter portion or in a position closer to a tip end of said first raw pipe than said end portion on said base end side of said second small inner diameter portion, in said extrusion direction.

10. The extrusion molding apparatus for a differential thickness pipe according to claim 9, wherein:

said internal space of said second thin-walled portion has a cylindrical columnar shape, and said third core bar is a core bar having a cylindrical columnar shape with a sixth outer diameter that is an outer diameter corresponding to an inner diameter of said second thin-walled portion.

11. An extrusion molding apparatus for a differential thickness pipe which comprises a first core bar having a predetermined shape, a first die having a first die hole that is a through hole having a predetermined shape, and a first drive mechanism configured so as to press said first core bar into said first die hole, and is configured so as to mold a differential thickness pipe having a predetermined shape by pressing a pair of a first raw pipe having a predetermined shape and said first core bar into said first die hole with said first drive mechanism in a state where said first core bar is inserted at a predetermined position in said first raw pipe to perform a first step that is a step in which said differential thickness pipe is molded, wherein:

said first raw pipe is a tubular member having a first wall thickness that is a predetermined wall thickness and a first outer diameter that is a predetermined outer diameter, said differential thickness pipe includes:

a first thin-walled portion that is a portion having a second wall thickness that is a predetermined wall thickness smaller than said first wall thickness and a second outer diameter that is a predetermined outer diameter smaller than said first outer diameter, and a first thick-walled portion that is a portion having an outer diameter equal to the second outer diameter and a third wall thickness that is a predetermined wall thickness larger than said second wall thickness, said first core bar includes:

a first small cross section portion that is a portion formed on a tip end side that is a downstream side in an extrusion direction and having a first cross section that is a cross section corresponding to a cross section of an internal space of said first thick-walled portion, a first large cross section portion that is a portion formed on a base end side that is an upstream side in said extrusion direction and having a second cross section that is a cross section corresponding to a cross section of an internal space of said first thin-walled portion, and a first cross section increasing portion that is a portion formed between said first small cross section portion and said first large cross section portion and having a cross section expanding from said first cross section to said second cross section as approaching from said first small cross section portion to said first large cross section portion, said first die hole includes:

a first large inner diameter portion that is a portion formed on a base end side and having a first inner diameter that is an inner diameter corresponding to said first outer diameter, a first small inner diameter portion that is a portion formed on a tip end side and having a second inner diameter that is an inner diameter corresponding to said second outer diameter, and a first inner diameter reducing portion that is a portion formed between said first large inner diameter portion and said first small inner diameter portion and having an inner diameter decreasing from said first inner diameter to said second inner diameter as approaching from said first large inner diameter portion to said first small inner diameter portion, and when said extrusion processing is started in said first step, an end portion on a base end side of said first small cross section portion is located at a position closer to a base end of said first raw pipe than an end portion on a base end side of said first small inner diameter portion, in said extrusion direction, and said extrusion molding apparatus is configured so as to perform said first step using a second raw pipe that is said first raw pipe further comprising, at an end portion on a tip end side, a second thin-walled portion that is a portion having a fourth wall thickness that is a predetermined wall thickness smaller than said third wall thickness and a fifth outer diameter that is a predetermined outer diameter equal to or less than said second outer diameter, and said differential thickness pipe further includes said second thin-walled portion closer to a tip end of said differential thickness pipe than said first thick-walled portion, and said extrusion molding apparatus further comprises a fourth core bar having a columnar shape with a fourth cross section that is a cross section corresponding to a cross section of an internal space of said second thin-walled portion, said extrusion molding apparatus is configured so as to perform said first step in a state where said fourth core bar is inserted into from a tip end side of said second raw pipe and is energized toward a direction opposite to said extrusion direction, and at least when said extrusion processing is started in the first step, an end portion on a base end side of said fourth core bar is in contact with an end portion on said tip end side of said first core bar.

12. The extrusion molding apparatus for a differential thickness pipe according to claim 11, wherein:

said internal space of said second thin-walled portion has a cylindrical columnar shape, and said fourth core bar is a core bar having a cylindrical columnar shape with a seventh outer diameter that is an outer diameter corresponding to an inner diameter of said second thin-walled portion.

13. An extrusion molding apparatus for a differential thickness pipe which comprises a first core bar having a predetermined shape, a first die having a first die hole that is a through hole having a predetermined shape, and a first drive mechanism configured so as to press said first core bar into said first die hole, and is configured so as to mold a differential thickness pipe having a predetermined shape by pressing a pair of a first raw pipe having a predetermined shape and said first core bar into said first die hole with said first drive mechanism in a state where said first core bar is inserted at a predetermined position in said first raw pipe to perform a first step that is a step in which said differential thickness pipe is molded, wherein:

said first raw pipe is a tubular member having a first wall thickness that is a predetermined wall thickness and a first outer diameter that is a predetermined outer diameter, said differential thickness pipe includes:

a first thin-walled portion that is a portion having a second wall thickness that is a predetermined wall thickness smaller than said first wall thickness and a second outer diameter that is a predetermined outer diameter smaller than said first outer diameter, and a first thick-walled portion that is a portion having an outer diameter equal to the second outer diameter and a third wall thickness that is a predetermined wall thickness larger than said second wall thickness, said first core bar includes:

a first small cross section portion that is a portion formed on a tip end side that is a downstream side in an extrusion direction and having a first cross section that is a cross section corresponding to a cross section of an internal space of said first thick-walled portion, a first large cross section portion that is a portion formed on a base end side that is an upstream side in said extrusion direction and having a second cross section that is a cross section corresponding to a cross section of an internal space of said first thin-walled portion, and a first cross section increasing portion that is a portion formed between said first small cross section portion and said first large cross section portion and having a cross section expanding from said first cross section to said second cross section as approaching from said first small cross section portion to said first large cross section portion, said first die hole includes:

a first large inner diameter portion that is a portion formed on a base end side and having a first inner diameter that is an inner diameter corresponding to said first outer diameter, a first small inner diameter portion that is a portion formed on a tip end side and having a second inner diameter that is an inner diameter corresponding to said second outer diameter, and a first inner diameter reducing portion that is a portion formed between said first large inner diameter portion and said first small inner diameter portion and having an inner diameter decreasing from said first inner diameter to said second inner diameter as approaching from said first large inner diameter portion to said first small inner diameter portion, and when said extrusion processing is started in said first step, an end portion on a base end side of said first small cross section portion is located at a position closer to said base end than an end portion on a base end side of said first small inner diameter portion, in said extrusion direction, and said extrusion molding apparatus further comprises a second core bar that is a core bar having a cylindrical columnar shape with an outer diameter equal to said second outer diameter, said extrusion molding apparatus is configured so as to perform said first step in a state where said second core bar is inserted into said first small inner diameter portion from a tip end side of said first die hole and is energized toward a direction opposite to said extrusion direction, and at least when said extrusion processing is started in said first step, an end portion on a base end side of said second core bar is in contact with an end portion on said tip end side of said first core bar.

14. An extrusion molding apparatus for a differential thickness pipe which comprises a first core bar having a predetermined shape, a first die having a first die hole that is a through hole having a predetermined shape, and a first drive mechanism configured so as to press said first core bar into said first die hole, and is configured so as to mold a differential thickness pipe having a predetermined shape by pressing a pair of a first raw pipe having a predetermined shape and said first core bar into said first die hole with said first drive mechanism in a state where said first core bar is inserted at a predetermined position in said first raw pipe to perform a first step that is a step in which said differential thickness pipe is molded, wherein:

said first raw pipe is a tubular member having a first wall thickness that is a predetermined wall thickness and a first outer diameter that is a predetermined outer diameter, said differential thickness pipe includes:

a first thin-walled portion that is a portion having a second wall thickness that is a predetermined wall thickness smaller than said first wall thickness and a second outer diameter that is a predetermined outer diameter smaller than said first outer diameter, and a first thick-walled portion that is a portion having an outer diameter equal to the second outer diameter and a third wall thickness that is a predetermined wall thickness larger than said second wall thickness, said first core bar includes:

a first small cross section portion that is a portion formed on a tip end side that is a downstream side in an extrusion direction and having a first cross section that is a cross section corresponding to a cross section of an internal space of said first thick-walled portion, a first large cross section portion that is a portion formed on a base end side that is an upstream side in said extrusion direction and having a second cross section that is a cross section corresponding to a cross section of an internal space of said first thin-walled portion, and a first cross section increasing portion that is a portion formed between said first small cross section portion and said first large cross section portion and having a cross section expanding from said first cross section to said second cross section as approaching from said first small cross section portion to said first large cross section portion, said first die hole includes:

a first large inner diameter portion that is a portion formed on a base end side and having a first inner diameter that is an inner diameter corresponding to said first outer diameter, a first small inner diameter portion that is a portion formed on a tip end side and having a second inner diameter that is an inner diameter corresponding to said second outer diameter, and a first inner diameter reducing portion that is a portion formed between said first large inner diameter portion and said first small inner diameter portion and having an inner diameter decreasing from said first inner diameter to said second inner diameter as approaching from said first large inner diameter portion to said first small inner diameter portion, and when said extrusion processing is started in said first step, an end portion on a base end side end side of said first small cross section portion is located at a position closer to a base end of said first raw pipe than an end portion on a base end side of said first small inner diameter portion, in said extrusion direction, and said first core bar further includes a first pressing portion that is a cylindrical columnar portion formed closer to a base end of said first core bar than said first large cross section portion and having an outer diameter equal to said first outer diameter, said first pressing portion is constituted by a core portion that is a cylindrical columnar portion having an outer diameter equal to said second outer diameter and an outer peripheral portion that is a cylindrical tubular portion slidably disposed outside in a radial direction of said core portion and having an outer diameter equal to said first outer diameter and an inner diameter corresponding to said second outer diameter, said extrusion molding apparatus is configured so as to:

locate a second thick-walled portion that is a portion having said first wall thickness and said first outer diameter at an end portion on a base end side of said first raw pipe by not performing said extrusion processing on a predetermined region at said end portion on said base end side of said first raw pipe, in said first step, and further perform a third step that is a step in which a portion outside said second outer diameter of said second thick-walled portion is cut off by not pressing said outer peripheral portion of said first pressing portion and pressing said core portion of said first pressing portion in said extrusion direction until a state where an end portion on a tip end side of said core portion of said first pressing portion is located closer to a tip end of said first raw pipe than an end portion on a base end side of said first small inner diameter portion of said first die hole is attained, after said first step.

15. An extrusion molding apparatus for a differential thickness pipe which comprises a first core bar having a predetermined shape, a first die having a first die hole that is a through hole having a predetermined shape, and a first drive mechanism configured so as to press said first core bar into said first die hole, and is configured so as to mold a differential thickness pipe having a predetermined shape by pressing a pair of a first raw pipe having a predetermined shape and said first core bar into said first die hole with said first drive mechanism in a state where said first core bar is inserted at a predetermined position in said first raw pipe to perform a first step that is a step in which said differential thickness pipe is molded, wherein:

said first raw pipe is a tubular member having a first wall thickness that is a predetermined wall thickness and a first outer diameter that is a predetermined outer diameter, said differential thickness pipe includes:

a first thin-walled portion that is a portion having a second wall thickness that is a predetermined wall thickness smaller than said first wall thickness and a second outer diameter that is a predetermined outer diameter smaller than said first outer diameter, and a first thick-walled portion that is a portion having an outer diameter equal to the second outer diameter and a third wall thickness that is a predetermined wall thickness larger than said second wall thickness, said first core bar includes:

a first small cross section portion that is a portion formed on a tip end side that is a downstream side in an extrusion direction and having a first cross section that is a cross section corresponding to a cross section of an internal space of said first thick-walled portion, a first large cross section portion that is a portion formed on a base end side that is an upstream side in said extrusion direction and having a second cross section that is a cross section corresponding to a cross section of an internal space of said first thin-walled portion, and a first cross section increasing portion that is a portion formed between said first small cross section portion and said first large cross section portion and having a cross section expanding from said first cross section to said second cross section as approaching from said first small cross section portion to said first large cross section portion, said first die hole includes:

a first large inner diameter portion that is a portion formed on a base end side and having a first inner diameter that is an inner diameter corresponding to said first outer diameter, a first small inner diameter portion that is a portion formed on a tip end side and having a second inner diameter that is an inner diameter corresponding to said second outer diameter, and a first inner diameter reducing portion that is a portion formed between said first large inner diameter portion and said first small inner diameter portion and having an inner diameter decreasing from said first inner diameter to said second inner diameter as approaching from said first large inner diameter portion to said first small inner diameter portion, and when said extrusion processing is started in said first step, an end portion on a base end side of said first small cross section portion is located at a position closer to a base end of said first raw pipe than an end portion on a base end side of said first small inner diameter portion, in said extrusion direction, and said extrusion molding apparatus is configured so as to perform said first step is performed using a third raw pipe that is said first raw pipe further comprising a third thin-walled portion that is a portion having a fifth wall thickness that is a predetermined wall thickness smaller than said first wall thickness and an eighth outer diameter that is a predetermined outer diameter smaller than said first outer diameter and having a cross section identical to or larger than a cross section of said internal space of said first thin-walled portion at an end portion on a base end side, said first core bar further comprises a first pressing portion that is a cylindrical columnar portion formed closer to a base end of said first core bar than said first large cross section portion and having an outer diameter equal to said first outer diameter, said first pressing portion comprises a reception portion that is a space open to an end surface on a tip end side of said first pressing portion and having a shape corresponding to said third thin-walled portion, said extrusion molding apparatus is configured so as to leave a third thick-walled portion that is a portion having said first wall thickness and said first outer diameter in an area adjacent to an end portion on a tip end side of said third thin-walled portion by performing said extrusion processing in a state where said third thin-walled portion is fitted in said reception portion, in said first step and terminating said extrusion processing before an end portion on said tip end side of said first pressing portion reaches an end portion on said tip end side of said first large inner diameter portion, and said differential thickness pipe further includes said third thick-walled portion formed at an end portion on a base end side of said thin-walled portion and said third thick-walled portion formed closer to a base end of said differential thickness pipe than said third thick-walled portion.

* * * * *